US010837213B2

(12) United States Patent
Talpe

(10) Patent No.: US 10,837,213 B2
(45) Date of Patent: Nov. 17, 2020

(54) HYDRAULICALLY DAMPED ACTUATOR

(71) Applicant: LOCINOX, Waregem (BE)

(72) Inventor: Joseph Talpe, Heestert (BE)

(73) Assignee: LOCINOX, Waregem (BE)

( * ) Notice: Subject to any disclaimer, the term of this patent is extended or adjusted under 35 U.S.C. 154(b) by 0 days.

(21) Appl. No.: 16/473,549

(22) PCT Filed: Jun. 20, 2017

(86) PCT No.: PCT/EP2017/065151
§ 371 (c)(1),
(2) Date: Jun. 25, 2019

(87) PCT Pub. No.: WO2018/121890
PCT Pub. Date: Jul. 5, 2018

(65) Prior Publication Data

US 2020/0141169 A1 May 7, 2020

(30) Foreign Application Priority Data

Dec. 27, 2016 (EP) ..... 16206970
Jun. 16, 2017 (WO) ..... PCT/EP2017/064840

(51) Int. Cl.
*E05F 3/22* (2006.01)
*E05F 3/08* (2006.01)
(Continued)

(52) U.S. Cl.
CPC ..... *E05F 3/08* (2013.01); *E05F 3/12* (2013.01); *E05F 3/20* (2013.01); *E05Y 2201/21* (2013.01);
(Continued)

(58) Field of Classification Search
CPC . Y10T 16/283; Y10T 16/304; Y10T 16/2771; Y10T 16/5387; Y10T 16/537;
(Continued)

(56) References Cited

U.S. PATENT DOCUMENTS 1,824,217 A * 9/1931 Kreiner ..... E05F 3/20 16/54
2,127,327 A * 8/1938 De Millar ..... E05F 3/08 16/54
(Continued)

FOREIGN PATENT DOCUMENTS

EP 1094185 A1 * 4/2001 ..... E05F 5/00
EP 2 295 693 A1 3/2011
(Continued)

OTHER PUBLICATIONS

International Search Report and Written Opinion of the International Searching Authority dated Sep. 21, 2017, issued in corresponding International Application No. PCT/EP2017/065151, filed Jun. 20, 2017, 9 pages.
(Continued)

*Primary Examiner* — Chuck Y Mah
(74) *Attorney, Agent, or Firm* — Christensen O'Connor Johnson Kindness PLLC

(57) ABSTRACT

A hydraulically damped actuator suitable for closing a hingedly connected closure system includes a tubular cylinder barrel, an energy storing mechanism for storing energy when the closure system is being opened and for restoring the energy to close the closure system, and a hydraulic damping mechanism for damping a closing movement of the closure system. The damping mechanism has a closed cylinder cavity that is partly formed by a collar that is integrally formed with the tubular cylinder barrel, a guiding element that is bolted to said collar and a piston that is irrotatably and slideably with respect to the tubular cylinder barrel coupled to said guiding element. The guiding element is fixedly positioned with respect to the tubular cylinder barrel, without needing a screw connection.

17 Claims, 35 Drawing Sheets

(51) Int. Cl.
*E05F 3/12* (2006.01)
*E05F 3/20* (2006.01)

(52) U.S. Cl.
CPC ... *E05Y 2201/264* (2013.01); *E05Y 2201/408* (2013.01); *E05Y 2201/456* (2013.01); *E05Y 2201/696* (2013.01); *E05Y 2900/40* (2013.01)

(58) Field of Classification Search
CPC ..... Y10T 16/5373; Y10T 16/53888; Y10T 16/2766; E05F 1/066; E05F 1/1008; E05F 1/12; E05F 1/1207; E05F 1/1223; E05F 3/00; E05F 3/04; E05F 3/08; E05F 3/10; E05F 3/12; E05F 3/20; E05F 5/00; E05D 3/02; E05D 11/02; E05D 11/04; E05D 11/084; E05D 11/1014; E05D 7/12; E05D 2005/108; E05Y 2800/00; E05Y 2201/21; E05Y 2201/264; E05Y 2201/408; E05Y 2201/456; E05Y 2201/696; E05Y 2201/628; E05Y 2201/638; E05Y 2201/256; E05Y 2900/40; E05Y 2900/132
See application file for complete search history.

(56) References Cited

U.S. PATENT DOCUMENTS 2,230,661 A 12/1941 Wennmann
2,456,537 A * 12/1948 Seaman ..... E05F 3/10 16/54
4,155,144 A * 5/1979 Koganei ..... E05F 3/20 16/54
4,829,628 A * 5/1989 Vuksic ..... E05F 3/20 16/299
6,205,619 B1 * 3/2001 Jang ..... E05D 5/10 16/352
6,658,694 B2 * 12/2003 Wang ..... E05F 1/1223 16/284
6,854,161 B2 * 2/2005 Lee ..... E05F 1/1223 16/50
8,468,650 B2 * 6/2013 Talpe ..... F16F 9/19 16/58
8,752,244 B2 * 6/2014 Talpe ..... E05F 3/14 16/58
2009/0241289 A1 * 10/2009 Choi ..... E05F 3/20 16/275
2017/0241180 A1 * 8/2017 Bacchetti ..... E05D 3/02

FOREIGN PATENT DOCUMENTS

EP 2546442 A1 * 1/2013 ..... E05F 1/1223
WO WO-9954583 A2 * 10/1999 ..... E05F 1/12

OTHER PUBLICATIONS

International Preliminary Report on Patentability dated Jul. 2, 2019, issued in corresponding International Application No. PCT/EP2017/065151, filed Jun. 20, 2017, 1 page.

* cited by examiner

HYDRAULICALLY DAMPED ACTUATOR

BACKGROUND OF THE INVENTION

The present invention relates to a hydraulically damped actuator for closing a closure system having a first member and a second member that are hingedly connected to each other. The actuator comprises a first connection element configured for connecting the actuator to the first member, the first connection element comprising a tubular cylinder barrel having a longitudinal axis and a second connection element configured for connecting the actuator to the second member. The actuator further comprises an energy storing mechanism operatively connected with said first connection element and said second connection element and configured for storing energy when said closure system is being opened and for restoring said energy to effect closure of said closure system and a hydraulic damping mechanism inside the tubular cylinder barrel and operatively connected with said first connection element and said second connection element and configured for damping a closing movement of said closure system. The damping mechanism comprises a closed cylinder cavity in said tubular cylinder barrel, the closed cylinder cavity having a longitudinal axis and being filled with a volume of hydraulic fluid; a shaft that extends into the closed cylinder cavity and is rotatable with respect to said tubular cylinder barrel about a rotation axis that substantially coincides with said longitudinal axis; a piston within said closed cylinder cavity so as to divide the closed cylinder cavity into a high pressure compartment and a low pressure compartment, the piston being operatively coupled to the shaft to be slidable with respect to the tubular cylinder barrel between two extreme positions in the direction of said longitudinal axis; and a guiding element that is rigidly fixed to the tubular cylinder barrel in the closed cylinder cavity, the piston being irrotatably and slideably in the direction of said longitudinal axis coupled to the guiding element.

Such an actuator is described in EP-A-3 162 997 which is a co-pending application in the name of Locinox, which is the same applicant as for the present application. In the described actuator the guiding element is inserted into the closed cylinder cavity through a top opening in the tubular cylinder barrel and rests on a ledge formed on an inside wall of the tubular cylinder barrel. The inside wall of the tubular cylinder barrel is also provided with a threaded portion into which a covering section is screwed thereby fixing, both in the longitudinal direction and in the rotational direction, the covering section to the tubular cylinder barrel. Due to this configuration, a bottom part of the guiding element is interposed between the ledge and the covering portion ensuring that the guiding element is fixedly positioned in the longitudinal direction of the actuator. This longitudinal fixation is necessary because the guiding element comprises a screw thread that forms part of a motion converting mechanism of the damping mechanism to convert a rotational motion of the shaft into a translational motion of the piston, and is, as such, subjected to forces in the longitudinal direction. Moreover, in the described actuator, the guiding element is provided with lugs that fit into corresponding holes in the covering element. As such, the guiding element is also rotationally fixed with respect to the tubular cylinder barrel.

A drawback of the described actuator is that, because the covering section is screwed into the tubular cylinder barrel, a sealing ring has to be provided not only between the shaft and the covering section but also between the covering section and the tubular cylinder barrel to ensure that no hydraulic fluid can escape from the closed cylinder cavity.

Another drawback of the described actuator is that the diameter of the tubular cylinder barrel is limited due the fact that the actuator is usually mounted on a post having a limited width. As such, the tubular cylinder barrel typically has a quite thin wall which makes it difficult to provide an adequate threaded portion that enables sufficiently tightly affixing the covering section and which reduces the overall strength of the actuator.

SUMMARY OF THE INVENTION

It is an object of the present invention to provide a hydraulically damped actuator having a guiding element fixed to the tubular cylinder barrel in a way that increases the mechanical strength of the actuator and the tightness of the closed cylinder cavity.

This object is achieved according to the invention in that the tubular cylinder barrel comprises an integrally formed collar that forms part of the wall of the closed cylinder cavity, and in that the guiding element is bolted to said collar by means of one or more bolts.

By bolting the guiding element directly into a collar that is integrally formed with the tubular cylinder barrel, the guiding element is fixedly positioned both in the longitudinal direction and rotationally with respect to the tubular cylinder barrel. In other words, the collar acts performs the same function as the covering section in the described actuator, without having to be screwed into the tubular cylinder barrel. As such, the actuator according to the present invention has a larger mechanical strength, since the tubular cylinder barrel has no weakened portion where the covering section is screwed into the tubular cylinder barrel. On the contrary, the collar, which is integrally formed with the tubular cylinder barrel substantially increases the mechanical strength thereof. Moreover, integrally forming the collar with the tubular cylinder barrel also provides a stronger affixation when compared to a screw threaded connection.

Furthermore, because the collar is integrally formed with the tubular cylinder barrel, there is no need to provide a sealing ring between these elements, contrary to the described actuator, so that the risk of hydraulic fluid leakage is reduced.

In an embodiment of the present invention the tubular cylinder barrel is extrusion moulded from metal, preferably aluminium, with said closed cylinder cavity and said collar being formed therein by bore milling.

In this embodiment, the risk of hydraulic fluid leakage is further reduced as extrusion moulded aluminium is less porous when compared to cast aluminium.

In an embodiment of the present invention the damping mechanism further comprises a motion converting mechanism to convert a relative rotational motion of the shaft with respect to the tubular cylinder barrel into a translational motion of the piston in the direction of said longitudinal axis. Preferably, the motion converting mechanism consists of a first screw thread that is fixedly positioned on the shaft and a second screw thread that is fixedly positioned on the piston and that directly engages the first screw thread.

In this embodiment, the guiding element does not form part of the motion converting mechanism, contrary to the described actuator. As such, the guiding element is substantially not subjected to forces in the longitudinal direction.

In an embodiment of the present invention said one or more bolts extend substantially in the direction of said longitudinal axis.

In this embodiment, the bolts may be screwed through the guiding element into the collar via a bottom end of the tubular cylinder barrel, which provides a quick and easy way to affix the guiding element.

In an embodiment of the present invention the guiding element has one or more lugs that extend in the direction of said longitudinal axis and fit in corresponding holes in the collar.

These lugs enable the guiding element to be subjected to larger rotational forces and remain fixed to the collar when compared to solely a bolted connection.

In an embodiment of the present invention the guiding element is located within said low pressure compartment. As such, no high pressure is exerted onto the rotatable seal between the shaft and the collar, which seal is more susceptible to leakage when compared to a stationary seal.

In an embodiment of the present invention the damping mechanism further comprises a pressure compensation mechanism for compensating changes of the volume of said hydraulic fluid upon temperature variations thereof, the pressure compensation mechanism preferably comprising at least one of: an amount of a gas in the hydraulic fluid to compensate said changes of the volume of the hydraulic fluid; and an expansion channel with a plunger that fits into the expansion channel and is slidably received therein, the plunger dividing the expansion channel into a first compartment which is in fluid communication with said closed cylinder cavity and a second compartment that is sealed off from the first compartment by said plunger, the second compartment allowing the plunger to slide within the expansion channel to compensate said changes of the volume of the hydraulic fluid.

Adding gas or providing an expansion channel provides sufficient space to allow the hydraulic fluid to expand without resulting in excessive pressures that could damage the closed cylinder cavity even for large outdoors temperature variations, which could cause leakage of hydraulic fluid through one or more seals used in closing the closed cylinder cavity. As such, the actuator is more resistant to temperature variations. Moreover, the plunger seals off the first compartment from the second compartment ensuring that the contents of the second compartment, e.g. gas or air, cannot enter in the first compartment. As such, the gas or air in the expansion channel cannot enter the closed cylinder cavity and thus cannot disrupt the normal operations of the hydraulic damper.

BRIEF DESCRIPTION OF THE DRAWINGS

The invention will be further explained by means of the following description and the appended figures.

DETAILED DESCRIPTION OF THE INVENTION

The present invention will be described with respect to particular embodiments and with reference to certain drawings but the invention is not limited thereto but only by the claims.

Furthermore, the various embodiments, although referred to as "preferred" are to be construed as exemplary manners in which the invention may be implemented rather than as limiting the scope of the invention.

The invention generally relates to a hydraulically damped actuator for closing a closure system having a first member and a second member that are hingedly connected to each other. The actuator typically comprises a first and a second connection element, the first connection element being configured to connect the actuator to the first member and the second connection element being configured to connect the actuator to the second member. The first member is typically a fixed support, such as a wall or a post, while the second member is typically a moveable closure member, such as a gate, a door, or a window. In particular, the hydraulically damped actuator is designed for an outdoors closure system that may be subjected to large temperature variations. The actuator comprises an energy storing mechanism and a damping mechanism, both of which are operatively connected with the members of the closure system by the first and second connection elements. The energy storing mechanism is configured for storing energy when the closure system is being opened and for restoring the energy to effect closure of the closure system. The damping mechanism is configured for damping a closing movement of the closure system.

The main idea of the invention is to mount the actuator in differently oriented positions depending on the handedness of the closure system. Specifically, for a right-handed closure system, the actuator is mounted with its longitudinal axis in a first orientation (e.g. upright or upside down), while, for a left-handed closure system, the actuator is mounted with its longitudinal axis in a second orientation that opposite to the first orientation (e.g. upside down or upright). This enables the energy storing mechanism and the damping mechanism to operate in the same way for both a right-handed closure system and a left-handed closure system.

First Embodiment

Figure 1A:
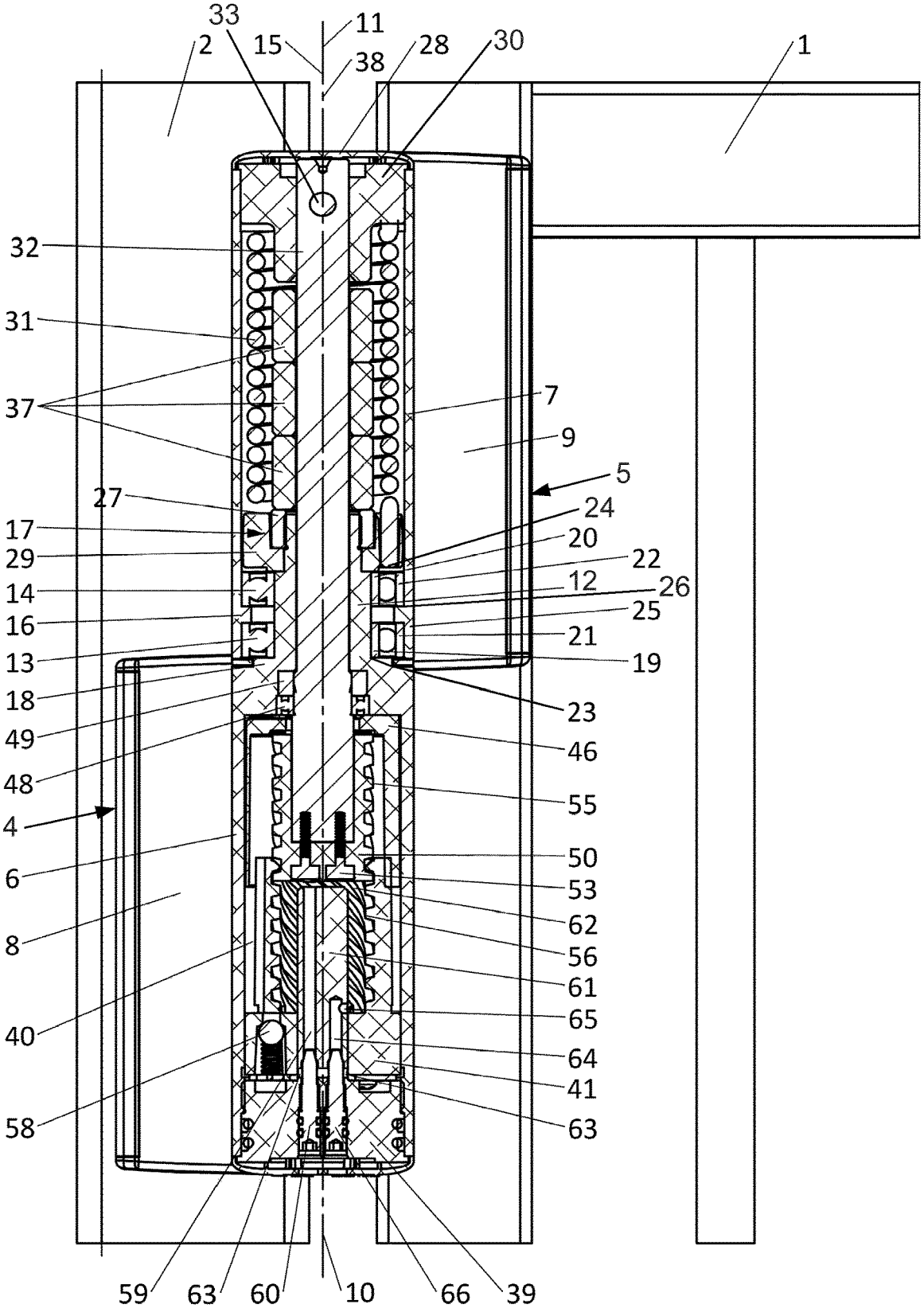
FIGS. 1A and 1B show a longitudinal cross-section of a hinge of the present invention mounted on a support and a left-handed and a right-handed closure member in the closed position of the closure member.
Figure 1B:
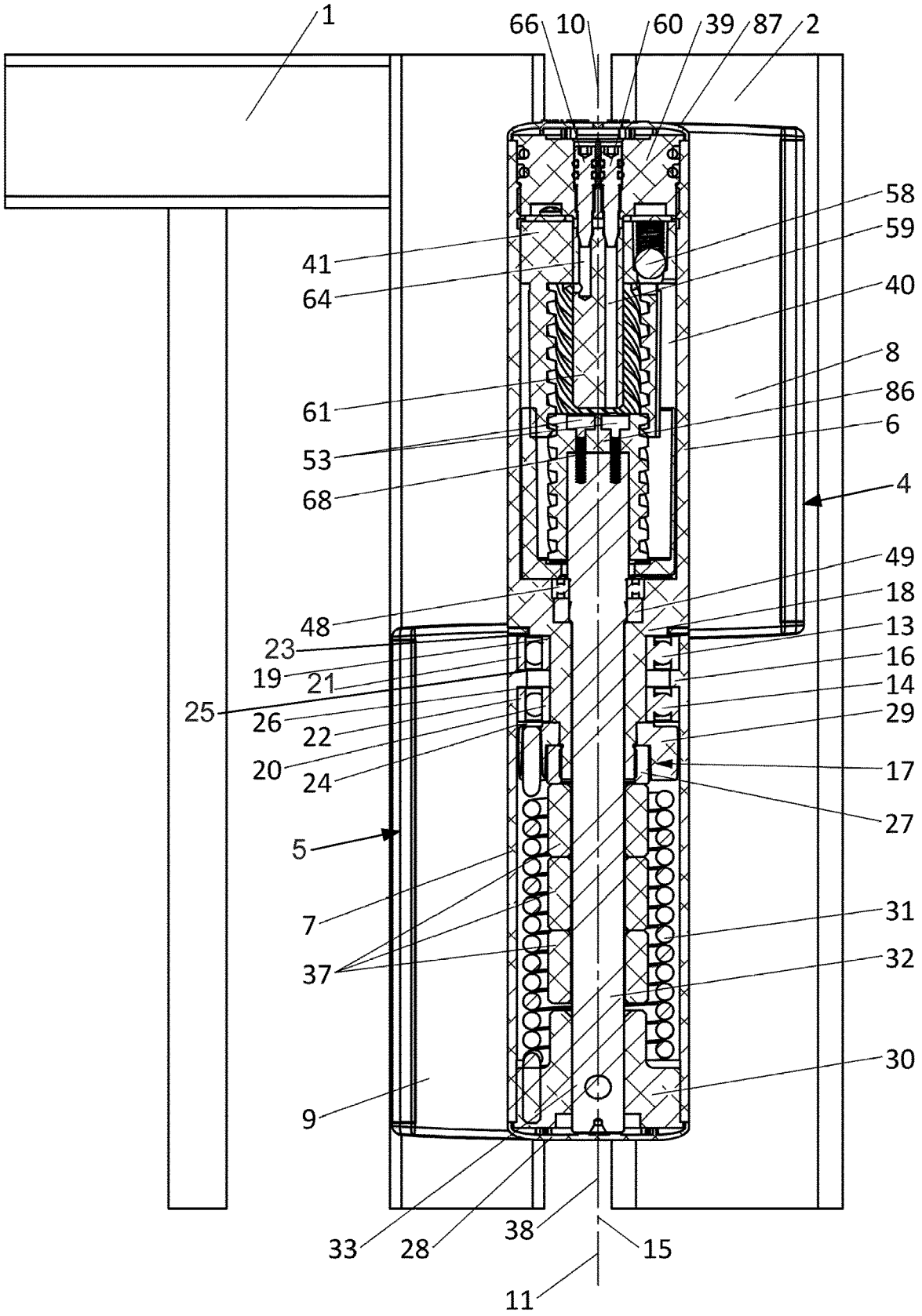

In this embodiment, the actuator is provided in the form of a hinge as illustrated in FIGS. 1A and 1B. In other words, the closure member 1 is hinged to the support 2 by means of a hydraulically damped, self-closing hinge. The hinge comprises a first and a second hinge member 4, 5 with the first hinge member 4 being fixed to the support 2 and the second hinge member 5 being fixed to the closure member 1 for both a right-handed and a left-handed closure member 1 as illustrated in FIGS. 1A and 1B respectively. In other words, the hinge is turned upside down for a left-handed closure member 1 with respect to its orientation for a right-handed closure member 1. Therefore, the first hinge member 4 may also be referred to as the fixed hinge member 4 and the second hinge member may also be referred to as the moveable hinge member 5.

As illustrated in FIGS. 1A and 1B, the fixed hinge member 4 comprises a first barrel 6, also referred to as the tubular cylinder barrel 6, fixed to a first leaf 8, also referred to as the fixed barrel 6 and the fixed leaf 8, while the moveable hinge member 4 comprises a second barrel 7 fixed to a second leaf 9, also referred to as the moveable barrel 7 and the moveable leaf 9. The leaves 8, 9 are used to fix the hinge to the closure member 1 and to the support 2 while the barrels 6, 7 function as the knuckles of the hinge and also house the energy storing and the damping mechanisms. In particular, as illustrated in FIGS. 4A and 4B, the fixed leaf 8 is angled to match an angle of the support 2 so as to be always fixed in a same position with respect to the support, i.e. in order to be always aligned with the other hinge used to hinge the closure member to the support.

Preferably, the moveable leaf 9 is arranged such that it is possible to move the hinge, in particular the hinge axis of the hinge, closer and further away with respect to the closure member 1 and the fixed leaf 9 is arranged such that it is possible to adjust the height of the closure member 1 with respect to the support 2. In an embodiment, the fixed leaf 8 comprises horizontal grooves 77 that are placed above one another (shown in FIG. 4B) that cooperate with grooves on mounting plates applied underneath the heads of the bolts 80 used to mount the fixed leaf 8 onto the support 2. The fixed leaf 9 also has two vertical slots (not shown), on above the other, for receiving the bolts 80. The cooperating grooves and the vertical slots enable to move the closure member 1 higher and/or lower with respect to the support 2. Similarly, the moveable leaf 9 comprises vertical grooves 78 that are placed sideways with respect to one another and horizontal slots 88 (shown in FIG. 4A). The vertical grooves 78 cooperate with grooves on mounting plate applied underneath the heads of the bolts 80 used to mount the moveable leaf 9 onto the closure member 1. These cooperating grooves and horizontal slots 88 enable to move the closure member 1 closer and/or further away with respect to the support 2.

Figure 4A:
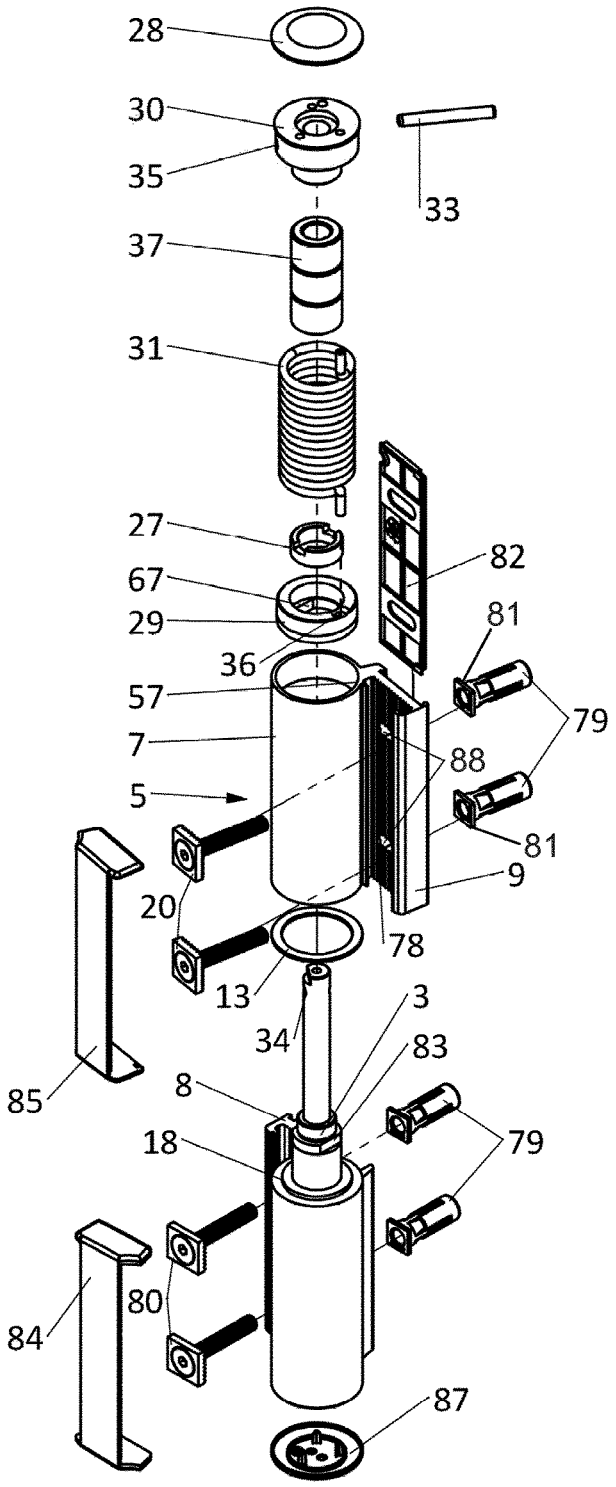
FIG. 4A shows a partly exploded view of the complete hinge.
Figure 4B:
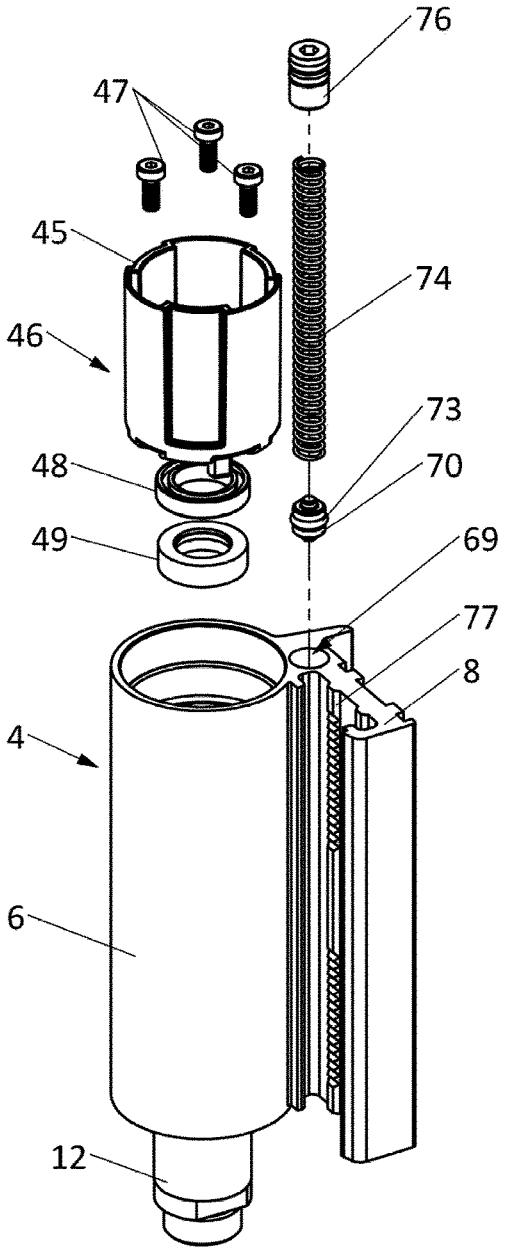
FIG. 4B shows a partly exploded view of the first hinge member.

The leaves 8, 9 are preferably fixed to the support 2 and the closure member 1 respectively using fixture sets as described in EP-B-1 907 712, i.e. by inserting bolts 80 through fixation elements 81 into nut elements 79 that automatically fasten due to a square cross-section that fits into a square section (not shown) of a locking plate 82 (shown in FIG. 4A).

In the illustrated embodiments, each of the leaves 8, 9 is covered with a cover cap 84, 85 to cover the grooves 77, 78 and the fixture sets 79, 80.

In a preferred embodiment, the hinge members 4, 5 are extruded profiles with certain sections being milled and/or grinded away to form ledges, collars, protrusions, etc.

Preferably, the hinge members 4, 5 are manufactured from extruded aluminium which is less porous as cast aluminium so that it is leak-free with respect to hydraulic fluid.

FIGS. 1A and 1B show a longitudinal cross-section of the hydraulically damped, self-closing hinge mounted on a closed right-handed and a closed left-handed closure member 1 respectively. Both barrels 6, 7 have a longitudinal direction 10, 11, which longitudinal directions 10, 11 are preferably substantially the same. The moveable barrel 7 is pivotably mounted onto a hollow shaft 12 that forms a part of the fixed barrel 6 using two ball bearings 13, 14. The barrels 6, 7 thus act as knuckles of the hinge with the moveable barrel 7 being pivotable with respect to the fixed barrel 6 around a pivot axis 15 which, preferably, extends in the longitudinal directions 10, 11.

The ball bearings 13, 14 together with a fixed collar 16 on the inner surface of the moveable barrel 7, a ring 17 fixed onto the hollow shaft 12 and a ledge 18 on the fixed barrel 6 act as the pin of the hinge to keep the two hinge members 4, 5 fixed to one another and to enable a pivoting motion of the two hinge members 4, 5 with respect to one another.

Specifically, the inner races 19, 20 of the ball bearings 13, 14 radially contact the outer surface of the hollow shaft 12 and the outer races 21, 22 of the ball bearings radially contact the inner surface of the moveable barrel 7. The ball bearings 13, 14 thus enable a pivoting motion of the moveable barrel 7 with respect to the hollow shaft 12 and thus with respect to the fixed barrel 6.

The first inner race 19, i.e. the inner race 19 of the first ball bearing 13, axially engages with the ledge 18 of the fixed barrel 6 and the first outer race 21, i.e. the outer race 21 of the first ball bearing 13, axially engages with the collar 16. Therefore, for the right-handed closure member 1 illustrated in FIG. 1A, there is the following chain of support. The first hinge member 4 is fixed to and supported by the support 2; the first ball bearing 13 is supported by the first hinge member 4 as the first inner race 19 rests upon a first abutment 23 formed by the ledge 18 of the fixed barrel 6; the first ball bearing 13 supports the second hinge member 5 as a third abutment 25 formed by the collar 16 rests upon the first outer race 21; and the closure member 1 is fixed to and supported by the second hinge member 5. As such, for a right-handed closure member 1 to which the second hinge member 5 is fixed, the closure member 1 is supported via the first ball bearing 13.

The second inner race 20, i.e. the inner race 20 of the second ball bearing 14, axially engages with the ring 17 that is fixed to the hollow shaft 12 of the fixed barrel 6 and the second outer race 22, i.e. the outer race 22 of the second ball bearing 14, axially engages with the collar 16. Therefore, for the left-handed closure member 1 illustrated in FIG. 1B, there is the following chain of support. The first hinge member 4 is fixed to and supported by the support 2; the second ball bearing 14 is supported by the first hinge member 4 as the second inner race 20 rests upon a second abutment 24 formed by the ring 17 of the fixed barrel 6; the second ball bearing 14 supports the second hinge member 5 as a fourth abutment 26 formed by the collar 16 is supported by the second outer race 22; and the closure member 1 is fixed to and supported by the second hinge member 5. As such, for a left-handed closure member 1 to which the second hinge member 5 is fixed, the closure member 1 is supported via the second ball bearing 14.

It will be appreciated that, although the ball bearings 13, 14 have been described as engaging various surfaces, in other embodiments, various spacer elements may be interposed between the ball bearings 13, 14 and the respective abutments 23, 24, 25, 26 and the outer surface of the hollow shaft 12 and the inner surface of the moveable barrel 7.

Moreover, in other embodiments, one or both the ball bearings 13, 14 may be replaced by a same number of rolling bearings including but not limited to cylindrical roller bearings, spherical roller bearings, gear bearings, tapered rolling bearings and needle roller bearings.

Furthermore, it will be appreciated that the collar 16 which acts as both the third and fourth abutments 25, 26 may be implemented in various alternative ways. For example, the collar 16 may be split into two parallel collars by an annular groove; the collar 16 may be discontinuous, e.g. a ring of protrusions from the inner surface of the moveable barrel 7 may also form the collar 16; axial protrusions may be provided onto the collar 16 in which case the third and fourth abutments 25, 26 are formed by these projections; etc. Similarly, the first abutment 23 formed by the ledge 18 on the fixed barrel 6 may also be formed by a further collar on the outer surface of the hollow shaft 12 or may be formed by multiple protrusions therefrom or by axial protrusions from the ledge 18. One continuous collar 16 on the inner surface of the moveable barrel is however preferred. This collar is preferably part of the extruded profile and is produced by widening the boring in the extruded profile above and below the collar so that the collar remains. In this way, a strong collar is obtained, which is made of extruded aluminium and which can resist high stresses.

In the illustrated embodiment, the ring 17 is formed by an actuation member of the energy storing mechanism (as described below) which is fastened to the hollow shaft 12 by a ring screw or nut 27 that is screwed onto a threaded portion 3 of the hollow shaft 12 (as illustrated in FIG. 4A). Preferably, the threaded portion 3 is located at the free end of the hollow shaft 12. The actuation member of the energy storing mechanism is rotatably locked with respect to the hollow shaft 12 by having a non-circular cross-section, in particular a flat side 67 as illustrated in FIG. 4A that abuts with a corresponding flat side 83 of the hollow shaft 12.

The configuration of the ball bearings 13, 14, the ledge 18 and the ring 17 is advantageous as it allows the hinge to be easily assembled. In particular, the fixed hinge member 4 is assembled first with the first ball bearing 13 being placed around the hollow shaft 12. Afterwards, the moveable hinge member 5 is placed onto the hollow shaft 12 with the collar 16 resting on the first ball bearing 13. The second ball bearing 14, together with the other internal elements in the moveable hinge member 5, are then placed via an opening in the top of the moveable hinge member 5 which is finally sealed with a second end cap 28.

The energy storing mechanism is contained in the moveable barrel 7 and comprises a first actuation member 29 formed by the ring 17, a second actuation member 30 and a torsion spring 31 connected with one end to the first actuation member 29 and with the other end to the second actuation member 30. The second actuation member 30 is ring-shaped and placed onto the free end of a damper shaft 32. The second actuation member 30 is rotatably locked to the moveable barrel 7 and the damper shaft 32 by a pin 33 (shown in FIG. 4A) that is placed in respective openings 34, 35, 57 in the damper shaft 32, the first actuation member 29 and the moveable hinge member 5 (shown in FIG. 4A). The second actuation member 30 further comprises a hole (not shown) in which an end of the torsion spring 31 is placed. In this way, the moveable barrel 7, the second actuation member 30, the damper shaft 32 and one end of the torsion spring 31 are all irrotatably coupled to one another and to the closure member 1. The first actuation member 29, formed by the ring 17, is irrotatably fixed to the hollow shaft 12, and thus to the fixed barrel 6, by the ring screw 27. The first actuation member 29 further comprises a hole 36 (shown in FIG. 4A) in which the other end of the torsion spring 31 is placed. This end of the torsion spring 31 is thus irrotatably coupled to the fixed hinge member 4 and thus to the support 2.

In a preferred embodiment, the energy storage mechanism also comprises padding to prevent the spring 31 from buckling due to the large forces exerted thereon. In the illustrated embodiments, the padding comprises three rings 37 placed around the damper shaft 32 in the opening between the damper shaft 32 and the torsion spring 31. The padding rings 37 are free to rotate with the damper shaft 32 and do not contact the torsion spring 31 thus causing no significant friction.

The damper shaft 32 provides the coupling between the energy storing mechanism and the damping mechanism, and more generally, transfers the opening and closing movement of the closure member 1 to the damping mechanism. The damper shaft is rotatable around a rotation axis 38 that is preferably substantially the same as the pivot axis 15 and the longitudinal directions 10, 11. The damper shaft 32 extends through the hollow shaft 12, as such entering the fixed barrel 6 in which the damping mechanism is housed.

The hydraulic damper mechanism comprises the fixed barrel 6 which forms a part of the fixed hinge member 4 and which is closed off at the bottom by an oil cap 39 to define a closed cylinder cavity 40. This cylinder cavity 40 has a longitudinal direction which is the same as the first longitudinal direction 10. The damper mechanism further comprises a piston 41 placed in the fixed barrel 6 to divide the cylinder cavity 40 into a high pressure compartment 42 and a low pressure compartment 43 (illustrated in FIGS. 2A, 2D, 3A and 3D).

Figure 5B:
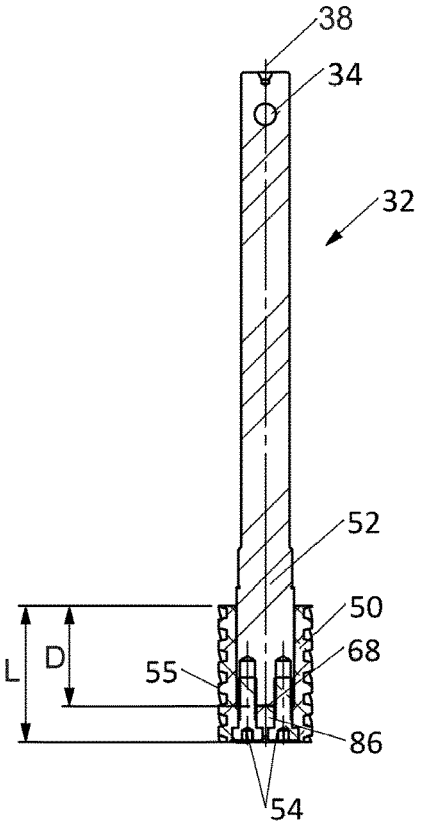
FIG. 5B shows a detailed cross-section of the spindle connected to the damper shaft.
Figure 5A:
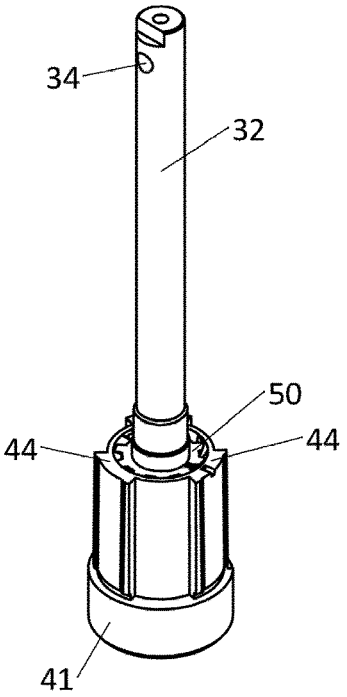
FIG. 5A shows a perspective view of the damper shaft and the piston.

A perspective view of the damper shaft 32 and the piston 41 placed thereon is shown in FIG. 5A, which illustrates that the piston 41 has three outward projections 44 which are guided in three grooves 45 in a base element 46 (shown in FIG. 4B), also referred to as a guiding element 46, which is also arranged in the cylinder cavity 40. The base element 46 fits in the fixed hinge member 4 and is irrotatably locked therein by means of three bolts 47 (shown in FIG. 4B) which are bolted into corresponding holes in the top of the fixed hinge member 4. By such a configuration, the piston 41 can substantially not rotate within the fixed barrel 6 and is slidable in the longitudinal direction 10 of the cylinder cavity 40 between two extreme positions, namely a closed position illustrated in FIGS. 1A and 1B and an open position illustrated in FIGS. 2B, 2C, 3B and 3C.

The base element 46 is described in more detail as the guiding element 151 in the second embodiment below. It will be readily appreciated that one or more of the features of the guiding element 151 may also be applied to the base element 46 of the current embodiment.

The hydraulic damper mechanism further comprises the rotating damper shaft 32. As can be seen in FIGS. 1A and 1B and as described above, the rotating damper shaft 32 is irrotatably coupled to the moveable hinge member 5. The damper shaft 32 therefore rotates together with the closure member 1. In particular, the damper shaft 32 rotates over substantially the same angle with respect to the fixed barrel 6 as the angle over which the moveable hinge member 5 rotates with respect to the fixed hinge member 4.

As illustrated in FIGS. 1A and 1B, at one end, the damper shaft 32 enters the low pressure compartment 43 of the cylinder cavity 40 through the side of the fixed barrel 6, i.e. the hollow shaft 12. A third bearing 48 and a seal 49 are provided between the damper shaft 32 and the fixed hinge member 4, as also illustrated in the exploded view of FIG. 4B. The third bearing 48 provides a smooth and easy rotation between the damper shaft 32 and the fixed barrel 6 and also aligns the damper shaft 32 with the hollow shaft 12 with a tolerance of less than 100 μm, preferably less than 20 μm. As such, friction and wear of the seal 49 can be kept to a minimum so that it remains liquid tight even after prolonged use. The hinge can thus be mounted upside down without hydraulic liquid escaping by gravity along the rotating damper shaft 32.

In order to convert the rotational motion of the damper shaft 32 into a translational motion of the piston 41 in the cylinder cavity 40, a spindle 50 is provided between the damper shaft 32 and the piston 41, which spindle is preferably made of a synthetic material which can easily be moulded into the required shape. Preferably, the spindle 50 is injection moulded from a thermoplastic material. Specifically, the spindle 50 is mounted onto an end 52 of the damper shaft 32. In order to convert the rotational motion of the spindle 50 into a translational motion of the piston 41 in the cylinder cavity 40, the spindle 50 is provided with an outer threaded portion 55 that engages an inner threaded portion 56 on the piston 41. Specifically, the outer threaded portion 55 is provided with a first, external (male) screw thread which has a screw axis which substantially coincides with the rotation axis 38 of the damper shaft 32 and which co-operates with an internal (female) screw thread on the piston 41. Since the piston 41 is irrotatably fixed within the fixed barrel 6, via the upward projections 44 and grooves 45, the piston 41 slides with respect to the fixed barrel 6. In particular, the piston 41 moves towards the damper shaft 32 when the closure member 1 is opened and it moves away from the damper shaft 32 when the closure member 1 is closed. In the illustrated embodiments, the screw threads are therefore right-handed screw threads.

To keep the hinge as compact as possible, no gearing or reduction is provided between the damper shaft 32 and the piston 41. As such, the threaded portions 55, 56 have a screw thread with a high lead angle. Preferably, the outer threaded portion 55 has a lead angle of at least 45° and more preferably at least 55° and most preferably at least 60°. In the illustrated embodiment, the lead angle is equal to about 66°. Moreover, the outer threaded portion 55 preferably has at least 5 starts and more preferably at least 7 starts and 10 starts in the illustrated embodiments. The larger lead angle increases the amount of force that is exerted onto the spindle 50 when transferring a rotation from the damper shaft 32 to a sliding motion of the piston 41. These large forces are known to lead to a deformation of the spindle 50 after a period of time.

Figure 5C:
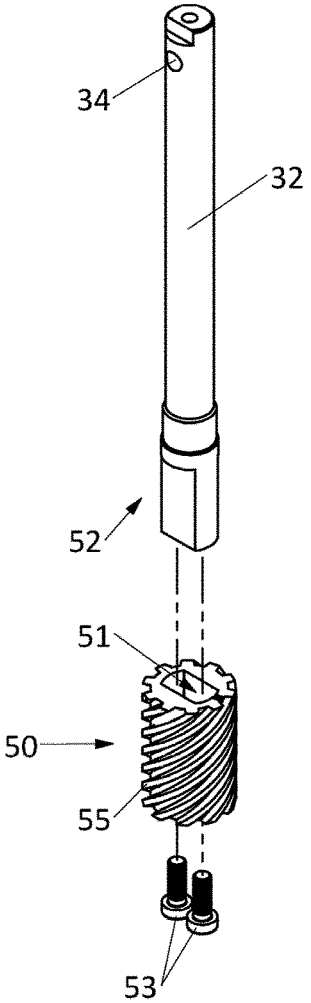
FIG. 5C shows an exploded view of the damper shaft and the spindle illustrated in FIG. 5B.

To counter such problems, the spindle 50 is irrotatably coupled to the damper shaft 32 in two ways as shown in the exploded view of FIG. 5C. First, the spindle 50 is provided with a recess 51 having a non-circular cross-section, specifically, with two flat sections. The proximal end 52 of the damper shaft 32 is provided with a corresponding non-circular cross section on which the spindle 50 is mounted. Moreover, the spindle 50 is fastened to the end face 68 of the damper shaft 32 with two bolts 53. The bolts 53 are bolted through a bottom 86 of the spindle 50 into the end face 68 of the damper shaft 32 as illustrated in the cross-sectional view of FIG. 5B. In particular, each of the bolts 53 is offset with respect to the rotation axis 38 of the damper shaft 32 and has a head 54 that is sunk into the spindle 50. The head 54 of the bolt 53 used to fix the spindle 50 to the damper shaft 32 has, in general, a circular cross-section so that it can engage the inner wall of the recess in the bottom of the spindle wherein it is received. Preferably, the lateral side of the circular head has a height which is equal to at least 1 mm, more preferably of at least 2 mm. In this configuration, the bolts 53 transfer a significant part of the rotation of the damper shaft 32 to the spindle 50 causing a significant decrease in pressure on the recess 51 and thus a lower chance that the plastic spindle 50, in particular the recess 51 therein, may be deformed due to excessive forces on the spindle 50.

It will be readily appreciated that only one bolt 53, or more than two bolts 53, may also be provided to fix the spindle 50 to the damper shaft 32 as long as the bolt(s) 53 is/are offset with respect to the rotation axis 38 of the damper shaft 32 and thus transfer(s) a significant part of the rotation of the damper shaft 32 to the spindle 50.

In the illustrated embodiments, the bolts 53 are bolted in a direction that is substantially parallel to the rotation axis 38 of the damper shaft, but it will be appreciated that other orientations of the bolts 53 are also possible. For example, the bolts 53 could be angled with respect to the damper shaft 32.

In the illustrated embodiments, the spindle 50 has the overall shape of a cup that is filled by the end 52 of the damper shaft 32. Specifically, the spindle 50 does not extend beyond the bolts 53, but rather the first threaded portion 55 is provided between the bolts 53 and the base element 46. In particular, the spindle 50 has a length L and the recess 51 has a depth D, both measured in the direction of the rotation axis 38 of the damper shaft 32 (as illustrated in FIG. 5B), with the depth D comprising at least 50%, preferably at least 60% and more preferably at least 70% of the length L of the spindle 50. This configuration further enhances the overall strength of the spindle 50 and thus its durability.

As shown in FIGS. 1A and 1B, the hydraulic damper mechanism comprises a one-way valve 58 which allows the hydraulic fluid to flow from the low pressure compartment 43 of the cylinder cavity 40 to the high pressure compartment 42 thereof when the closure member 1 is opened. The opening movement of the closure member 1 is therefore not damped or at least to a smaller extent than the closing movement. In the illustrated embodiments, this one-way valve 58 is provided in the piston 41.

To achieve the damping action upon closing of the closure member 1 by the energy storing mechanism, at least one restricted fluid passage is provided between the two compartments 42, 43 of the cylinder cavity 40. One restricted fluid passage is formed by a channel 59 connecting, in all the possible positions of the piston 41, i.e. in all positions between its two extreme positions, the low pressure compartment 43 with the high pressure compartment 42 thereof. This channel 59 is provided with an adjustable valve 60, in particular a needle valve, so that the flow of hydraulic liquid through this channel 59 can be controlled.

The channel 59 could be provided in the cylindrical wall of the fixed hinge member 4, but, in the illustrated embodiments, this channel 59 is provided in a tubular member 61 that is integrally formed with the oil cap 39 at and end of the cylinder cavity 40 that is closed off by a first end cap 87. The tubular member 38 projects into the cylinder cavity 40 in the longitudinal direction 11 thereof. The needle of the adjustable valve 60 is screwed through an opening in the oil cap 39 into the tubular member 61 so that the adjustable valve 60 is adjustable from the outside upon removal of the first end cap 87.

The channel 59 in the tubular member 61 has a first opening 62 ending above the piston 41 in the low pressure compartment 43 of the cylinder cavity 40 and two second openings 63 ending below the piston 41 in the high pressure compartment 42 of the cylinder cavity 40.

The tubular member 61 further comprises a second channel 64 that has a first opening 65 about midway of the tubular member 61 and the two second openings 63 ending below the piston 41. When the piston 41 approaches its most downward extreme position, hydraulic fluid can flow along the second channel 64 from the high pressure compartment 42 of the cylinder cavity 40 to the low pressure compartment 43 thereof. As such, the second channel 64 forms a by-pass which causes an increase of the closing speed at the end of the closing movement, i.e. a final snap, to ensure that the closure member 1 is reliably closed. A second adjustable valve 66, in particular a needle valve, is provided so that the flow of hydraulic liquid through the channel 64 can be controlled to control the closing speed of the closure member 1 during the final snap.

The operation of the energy storing mechanism and the damper mechanism will be explained with respect to FIGS. 2A to 2D for a right-handed closure member 1 and with respect to FIGS. 3A to 3D for a left-handed closure member 1.

Figure 2A:
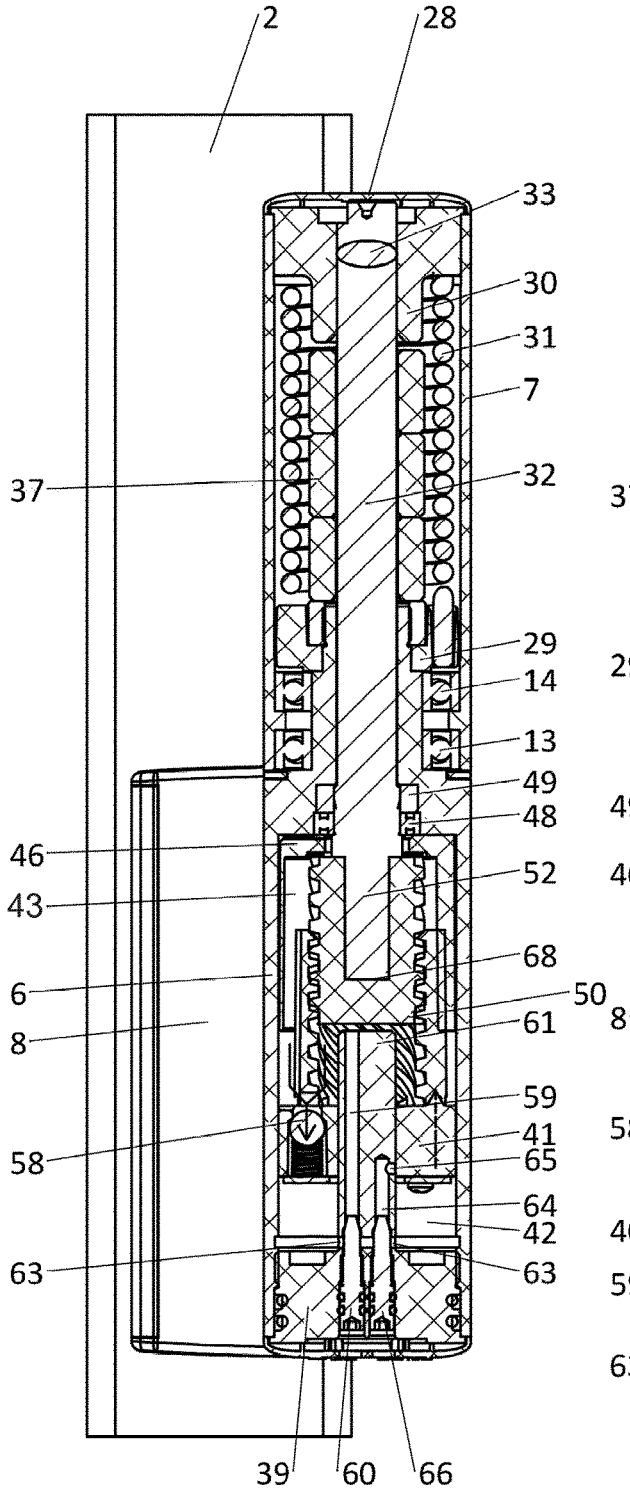
FIGS. 2A to 2D show the same longitudinal cross-section as FIG. 1A with the closure member being opened over 90°; fully opened over 180°; and starting to close; and half closed over 90°.
Figure 2B:
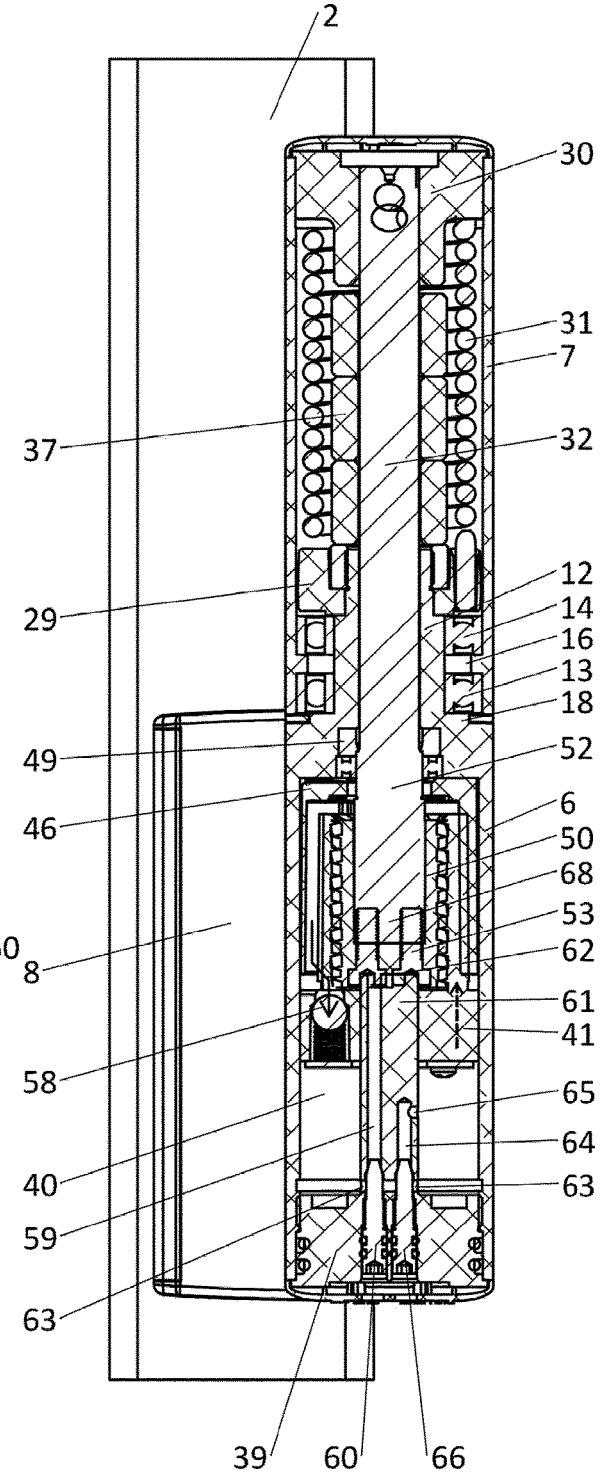
Figure 3A:
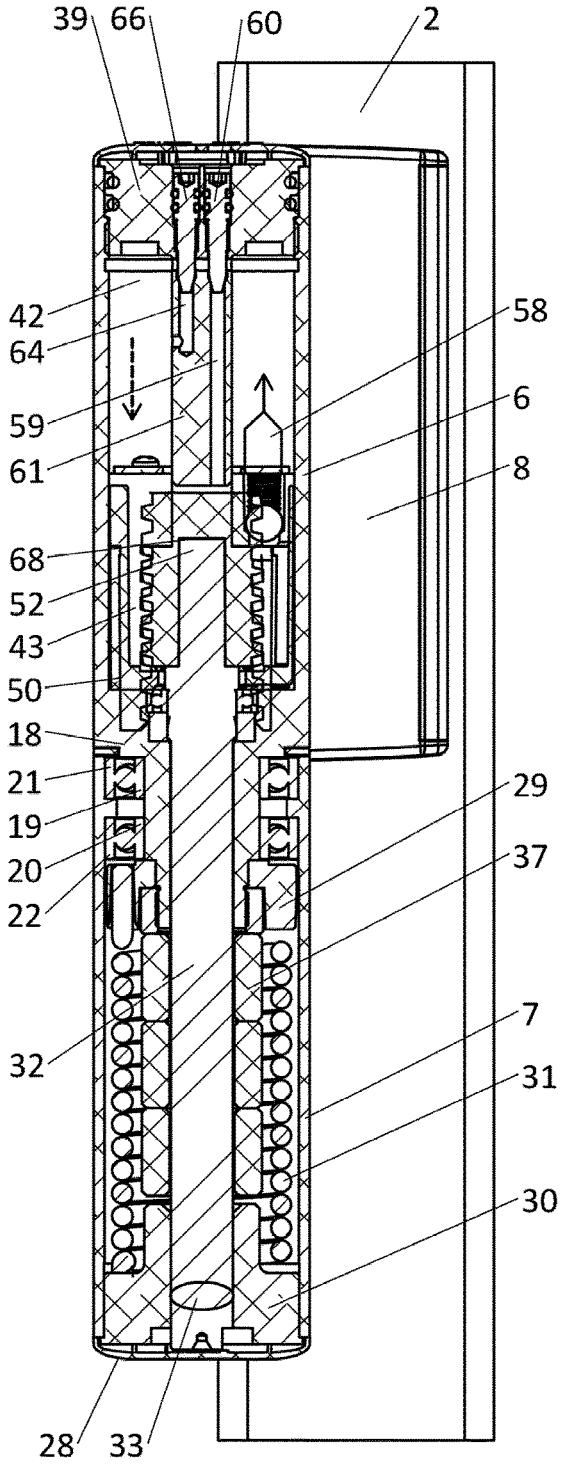
FIGS. 3A to 3D show the same longitudinal cross-section as FIG. 1B with the closure member being opened over 90°; fully opened over 180°; and starting to close; and half closed over 90°.
Figure 3B:
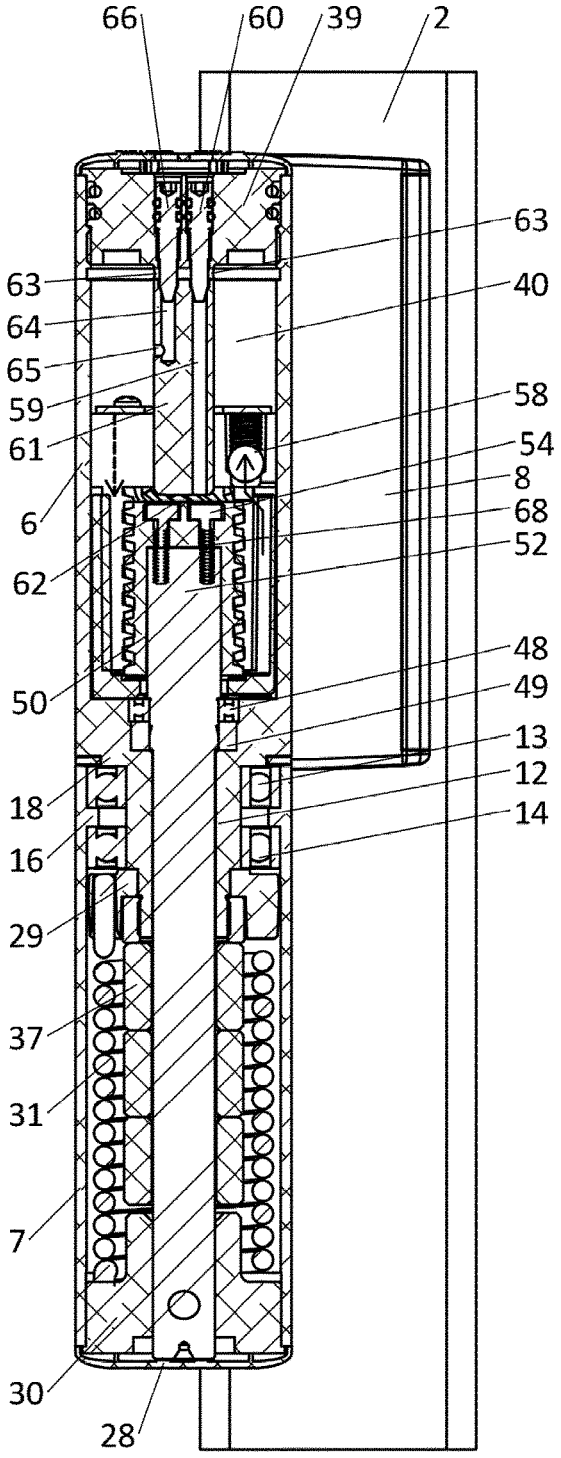

FIGS. 2A and 3A show a cross-sectional view of a right-handed and a left-handed closure member 1 respectively when it is halfway opened, e.g. when the closure member 1 has been rotated approximately 90° with respect to the support 2. When comparing with FIGS. 1A and 1B respectively, it is clear that the first actuation member 29 has remained stationary, while the second actuation member 30 has rotated over 90° thereby storing energy in the torsion spring 31. The damper shaft 32 has transferred the same rotation to the damping mechanism causing the piston 41 to move towards the damper shaft 32 as indicated by the dashed arrow. As the cylinder cavity 40 is filled with hydraulic fluid, the motion of the piston 41 results in a motion of the hydraulic fluid (indicated by the full arrow) across the one-way valve 58 from the low pressure compartment 43 to the high pressure compartment 42. It will be appreciated that the hydraulic fluid may also pass to some extent via the restricted fluid passage formed by channel 59. These motions continue until the closure member 1 is fully opened over 180° as illustrated in FIGS. 2B and 3B respectively.

Figure 2C:
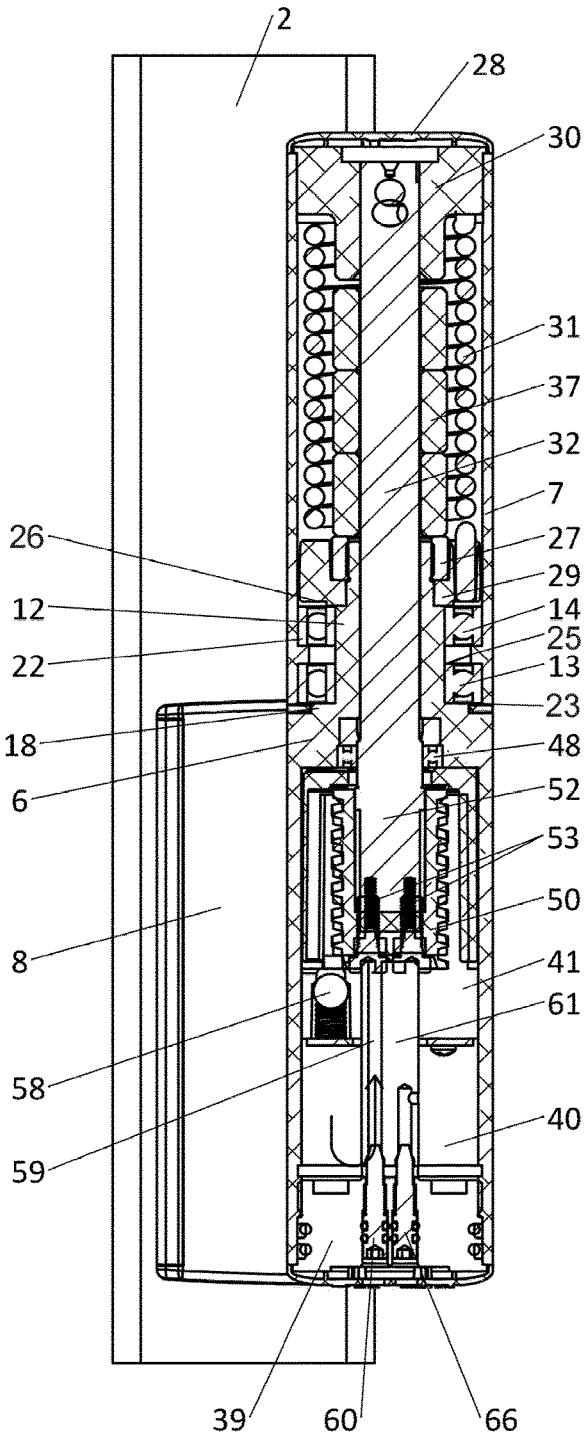
Figure 2D:
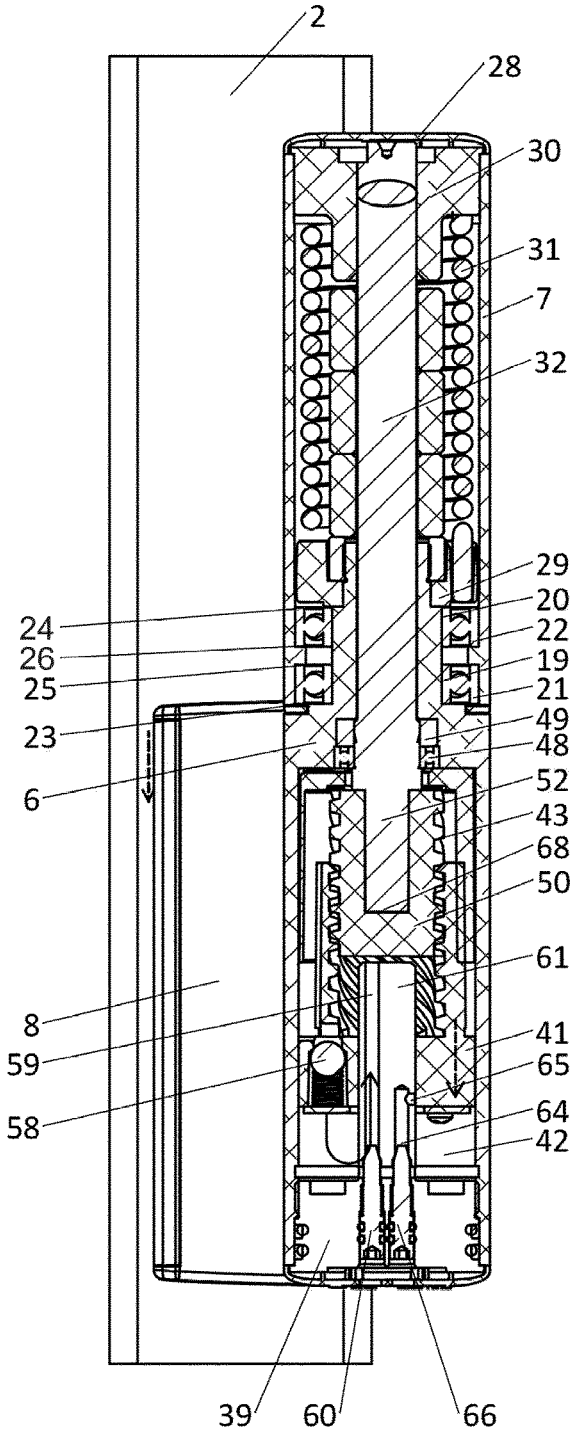
Figure 3C:
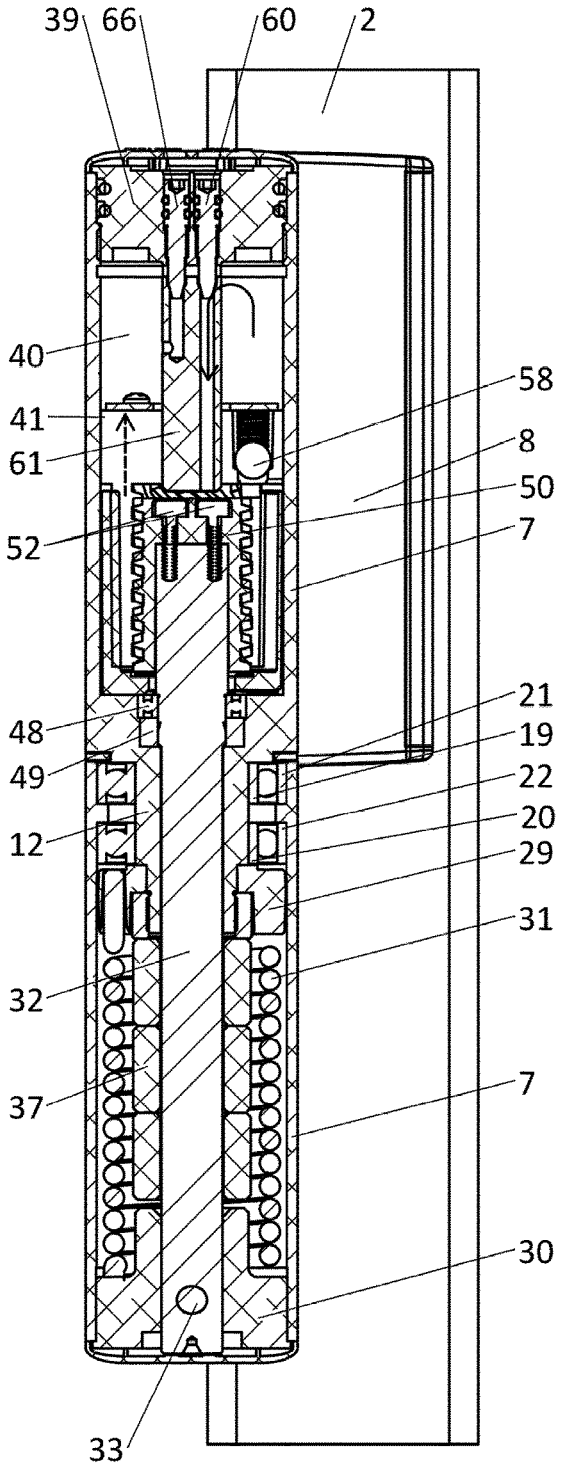
Figure 3D:
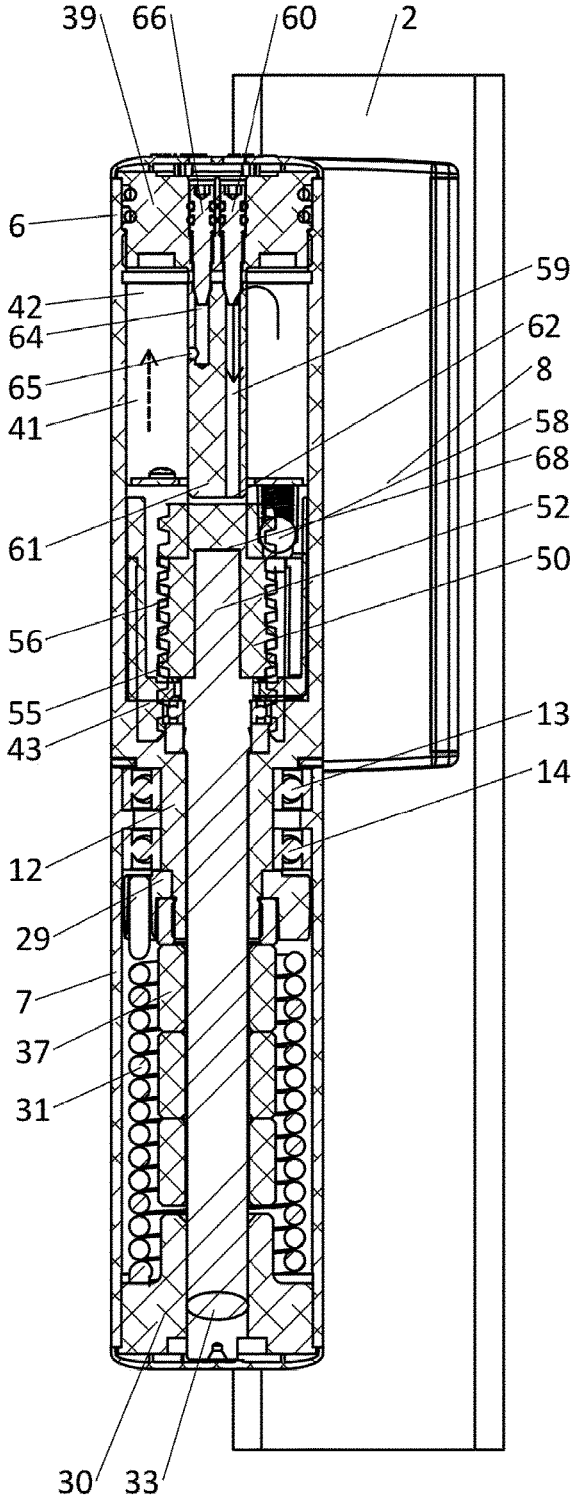

FIGS. 2C and 3C illustrate the fully opened position of a right-handed and a left-handed closure member 1 respectively. The energy that was stored in the spring 31 is now restored to close the closure member 1. Specifically, the spring 31 urges the second actuation member 30 to move relative to the first actuation member 29. Because the second actuation member 30 is fixed to the damper shaft 32 and the moveable hinge member 5, these are also urged to rotate. The damper shaft 32 transfers this rotation to the piston 41 which is now moved away from the damper shaft 32 as indicated by the dashed arrow. The one-way valve 58 is now shut and the hydraulic fluid is forced through the restricted fluid passage formed by channel 59 in the tubular member 61. This restricted flow thus damps the closing movement. These motions continue as illustrated in FIGS. 2D and 3D which show the closure member 1 half closed, e.g. rotated over approximately 90° degrees. It is clear from FIGS. 2D and 3D that when the piston 41 continues to move away from the damper shaft 32, the first opening 65 of the second channel 64 in the tubular member 61 will not be blocked by the piston 41 anymore allowing hydraulic fluid to flow from the high pressure compartment 42 to the low pressure compartment 43 to decrease the damping to reliably close the closure member 1.

The hinge described above is mainly used outdoors where large temperature variations are not uncommon. For example, summer temperatures up to 70° C. when the hinge is exposed to sunlight and winter temperatures below −30° C. are not uncommon, i.e. temperature variations up to and possibly even exceeding 100° C. are possible. Moreover, there are also daily temperature variations between night and day which can easily exceed 30° C. when the hinge is subjected to direct sunshine. These temperature variations cause expansion, and also contraction, of the hydraulic fluid, which could affect the operation of the damping mechanism. In particular, the expansion due to temperature variations can be up to 1% of the volume of hydraulic fluid for a temperature variation of 10° C., depending on the expansion coefficient of the hydraulic fluid. As such, an expansion of, for example, up to 3 cc for a temperature difference of 50° C. is possible.

To counter this expansion, a small amount of gas such as air could be provided in the hydraulic fluid itself. However, it has been found that this gas may interfere with the good working of the hinge, especially when gas bubbles, or an emulsion of the gas in the hydraulic fluid, passes through the restricted flow passage and provides a smaller damping effect than pure hydraulic fluid. Consequently, the hydraulic fluid is preferably free of gas bubbles.

In the hinge illustrated in the drawings, expansion of the hydraulic fluid is therefore countered by means of an expansion channel 69 with a moveable plunger 70 therein as shown in FIGS. 7A, 7B, 8A and 8B. The plunger 70 divides the expansion channel 69 into a first compartment 71 having a first volume that is in fluid communication with the cylinder cavity 40 via a fluid channel 75 and a second compartment 72 having a second volume. The plunger 70 has a ring-shaped seal 73 on its outside to prevent leaks between the hydraulic fluid and the pressure relief compartments 71, 72. As such, the plunger 70 acts a moveable seal. It will be readily appreciated that multiple ring-shaped seals 73 may also be provided. When the hinge is exposed to a temperature increase, the volume of the hydraulic fluid increases pushing the plunger 70 deeper into the expansion channel 69 and when the volume of the hydraulic fluid decreases, the plunger 70 is sucked back to close the expansion channel 69.

Figure 6A:
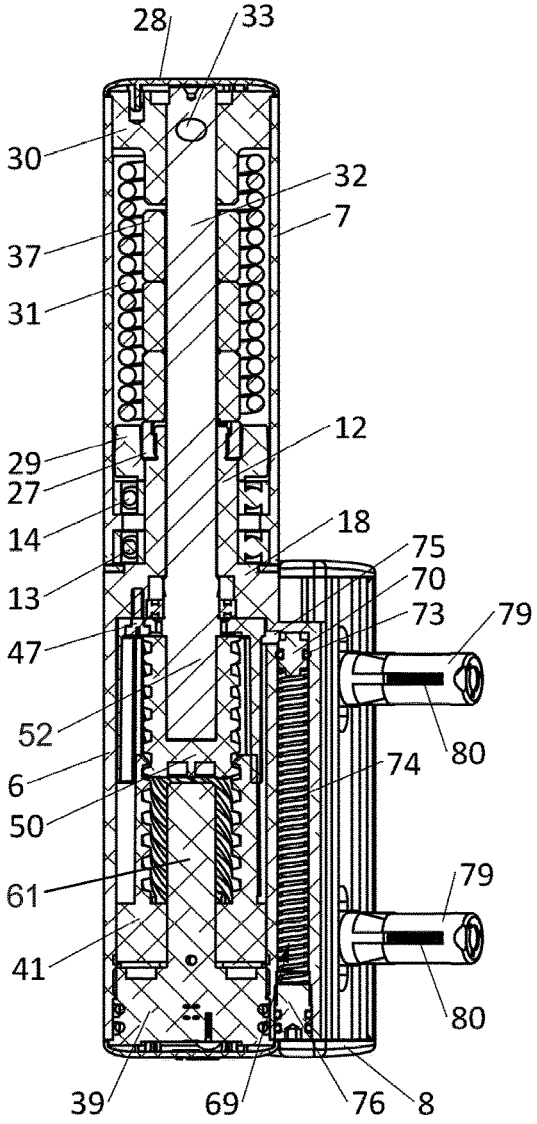
FIGS. 6A and 6B show a longitudinal cross-section of the hinge at the location of the expansion channel present therein.
Figure 6B:
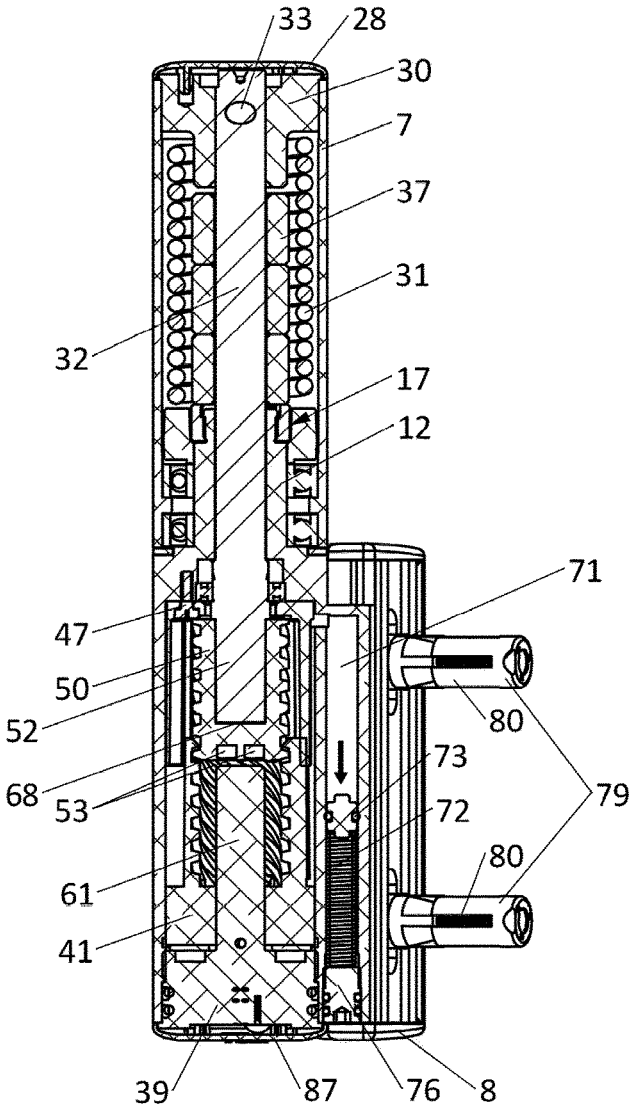
Figure 7A:
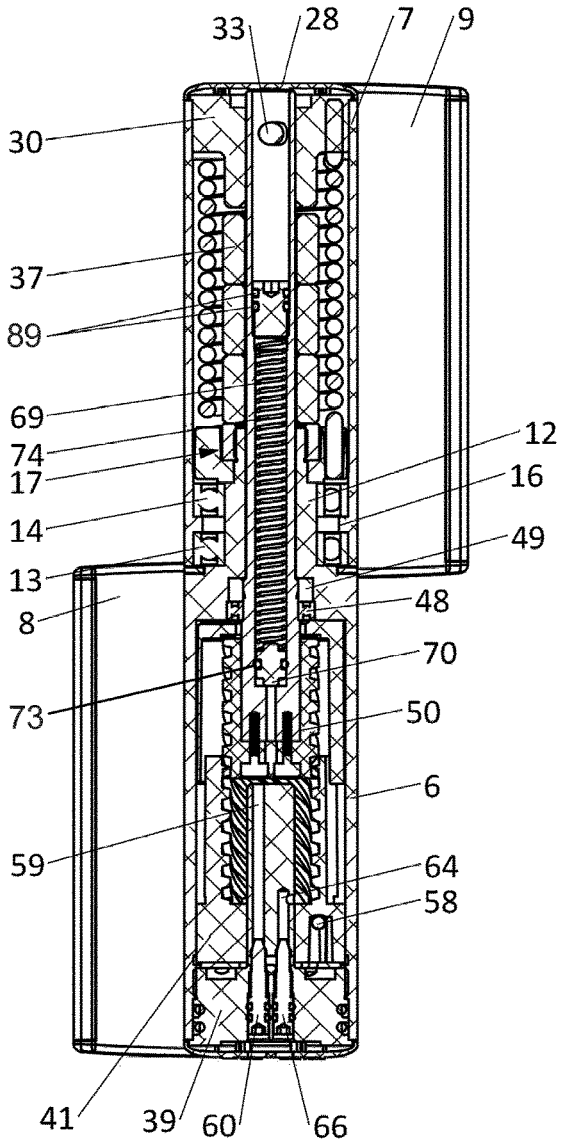
FIGS. 7A and 7B show a longitudinal cross-section at the location of an alternative expansion channel of the hinge.
Figure 7B:
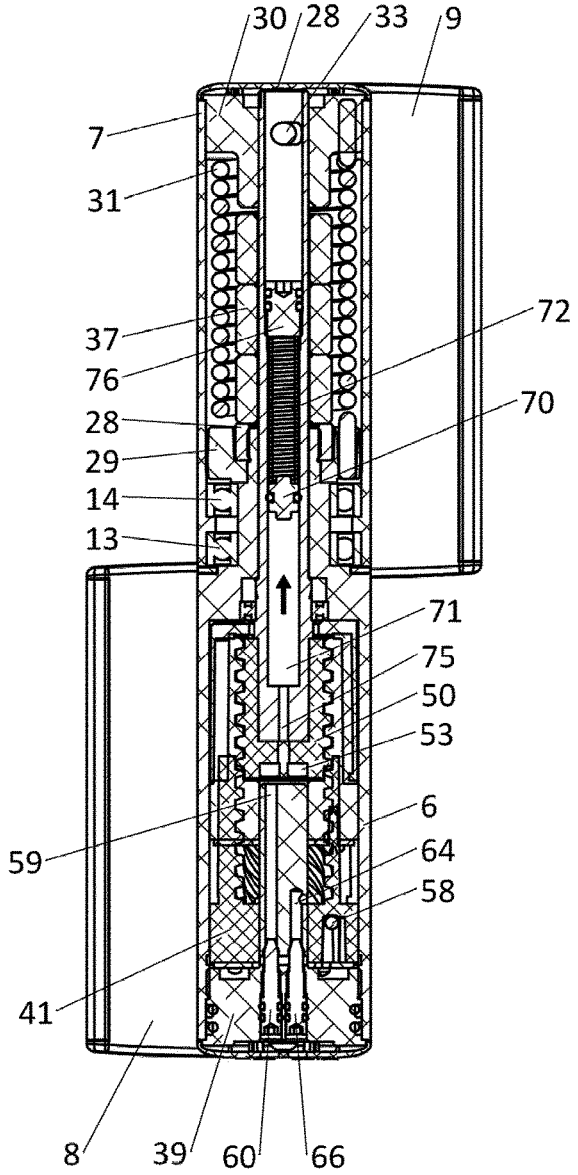

Turning to FIGS. 6A and 6B the expansion channel 69 is provided adjacent to the fixed barrel 6, i.e. it is formed as a part of the fixed leaf 8. In an alternative embodiment, illustrated in FIGS. 7A and 7B, the expansion channel 69 is provided in the damper shaft 32. In both embodiments, the first compartment 71 is in fluid communication with the low pressure compartment 43 of the cylinder cavity 40. As such, the plunger 70 is not exposed to the high pressures that result from the normal operation of the damping mechanism. This is advantageous as, exposing the first compartment 71 to the high pressure compartment 42 would affect the closing movement of the closure member 1, i.e. the hydraulic fluid would not only flow via the channel 59 but would also enter the first compartment 71 by displacing the plunger 70.

In the illustrated embodiments, the second compartment 72 is also provided with a biasing member formed by a compression spring 74 and an end cap 76 that seals off the expansion channel 69 from the outside and that urges the plunger 70 towards the fluid channel 75. The effect of this spring 74 is that the hydraulic fluid is pressurised so that negative pressures in the hydraulic fluid are alleviated. Specifically, the hydraulic fluid is usually added at room temperature, e.g. near 20° C. When the hinge is exposed to temperatures down to −30° C. a negative pressure would occur in the hydraulic fluid in the absence of the compression spring 74. When the hinge is first exposed to temperatures up to 70° C., and then cooled down to a low temperature, the increased friction between the ring-shaped seal 73 and the expansion channel 69 (as a result of the fact that the seal becomes less flexible at lower temperatures) could result, in absence of the compression spring 74, in an additional negative pressure in the hydraulic fluid which could result in air getting sucked into the cylinder cavity 40 via the seal 49 around the damper shaft 32 or via the seal 73 on the plunger 70. This problem is solved by the compression spring which pressurizes the hydraulic fluid, even at low temperatures, so that any risk of air being sucked into the cylinder cavity being avoided. In the illustrated embodiments, the pressure relief compartment 76 is filled, besides the compression spring 74, with air and is closed off by the end cap 76. When, the end cap 76 provides an airtight seal, the gas in the pressure relief compartment 76 could be pressurised to assist or replace the compression spring 74.

The volume of the expansion channel 69 and the first and second volumes are mainly determined in function of the expected increase in volume of the hydraulic fluid. In the illustrated embodiments, the first volume is preferably at least 1.5 cc, more preferably at least 2 cc, advantageously at least 2.5 cc and more advantageously at least 3 cc when the plunger 70 is pushed as far back as possible into the expansion channel 69, i.e. when the first volume is maximal. The maximal second volume is preferably substantially the same as the maximal first volume to provide enough space for the compression spring 74.

It will be readily appreciated that, in other embodiments, the first hinge member 4 may be fixed to the closure member 1 and the second hinge member 5 may be fixed to the support 2 without modifying the internal structure of the hinge as described above.

Second Embodiment

FIGS. 8A through 14B illustrate another embodiment of a hydraulically damped actuator 100. In this embodiment, the actuator 100 is designed to be used in a closure system having a support 101 with a closure member 102 hingedly attached thereto by means of an eyebolt hinge 103. The eyebolt hinge 103 comprises a, preferably threaded, rod portion 104 which enables to adjust the distance between the closure member 102 and the support 101. More preferably, the closure member 102 is hinged to the support 101 with a hinge arranged in front of the support 201, described for example in EP-B-1 528 202.

Figure 9A:
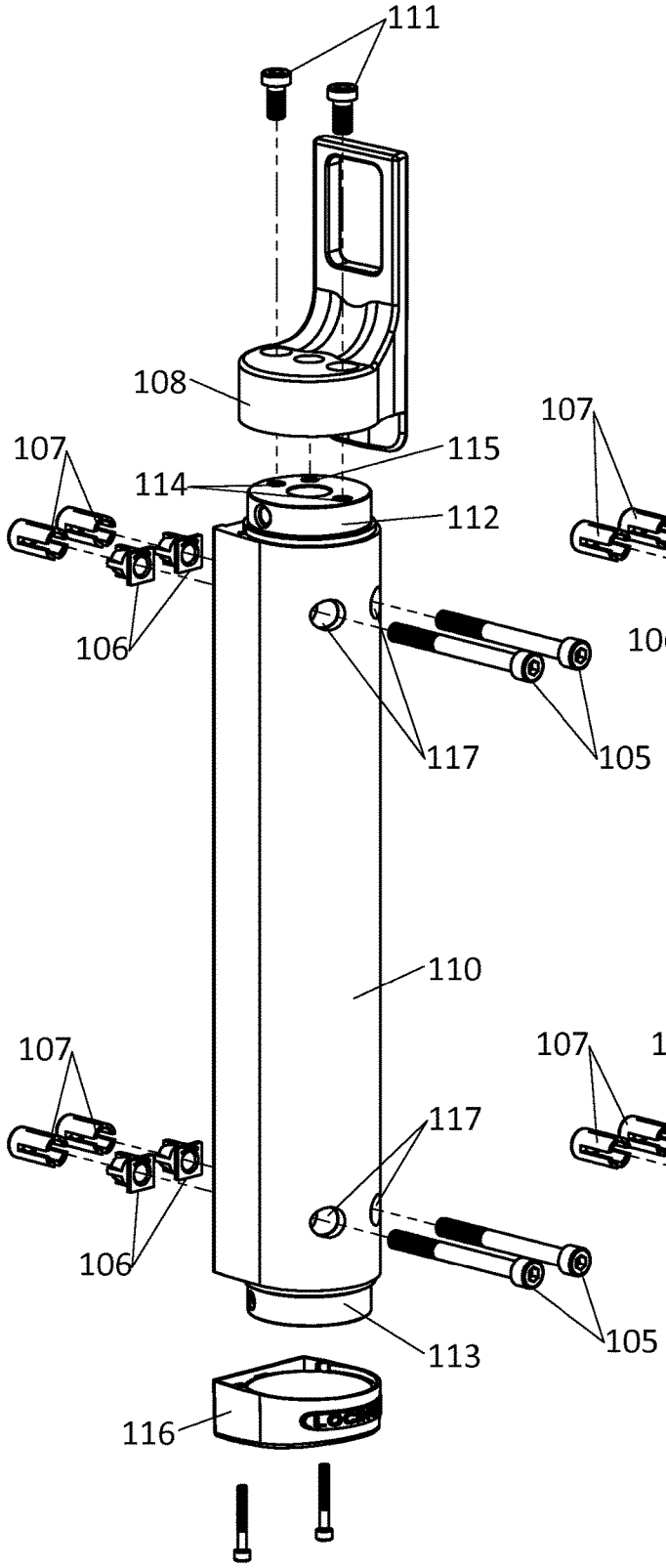
FIGS. 9A and 9B show how the mechanical connector element is mounted to the main body of the actuator in FIGS. 8A and 8B respectively.
Figure 9B:
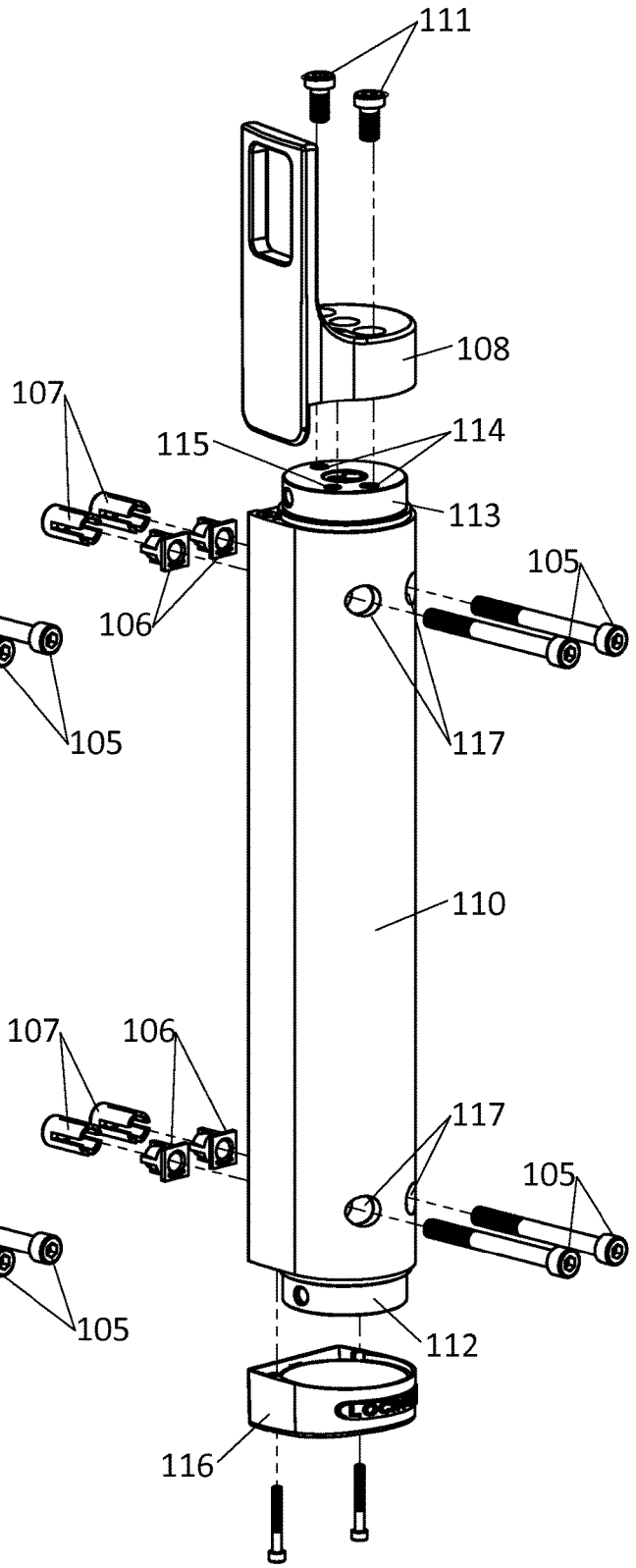

The actuator 100 is fixed to the support using four fixture sets as described in EP-B-1 907 712. In particular, as illustrated in FIGS. 9A and 9B, for each fixture set, a bolt 105 is inserted through the actuator 100 into a fixation element 106 having a square cross-section that fits into a square section (not shown) on the backside of the actuator 100. For each fixture set, the bolt 105 is screwed into an automatically fastening nut element 107 that is located inside the support 102. It will be readily appreciated that more or fewer fixture sets may also be used to fix the actuator 100 to the support 101.

Figure 8A:
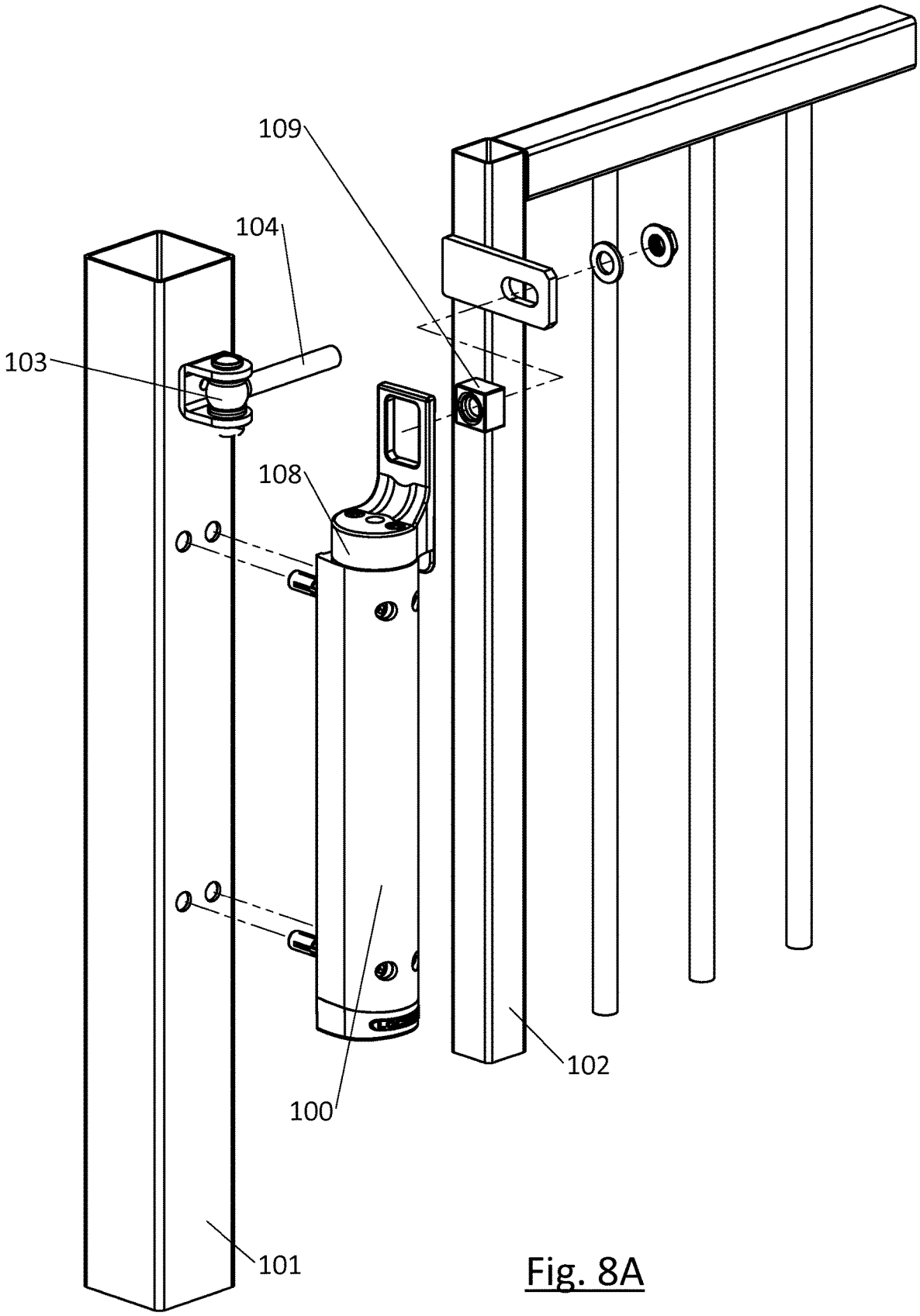
FIGS. 8A and 8B show how a hydraulically damped actuator according to an embodiment of the present invention is to be mounted onto a left-handed closure system and a right-handed closure system respectively.
Figure 8B:
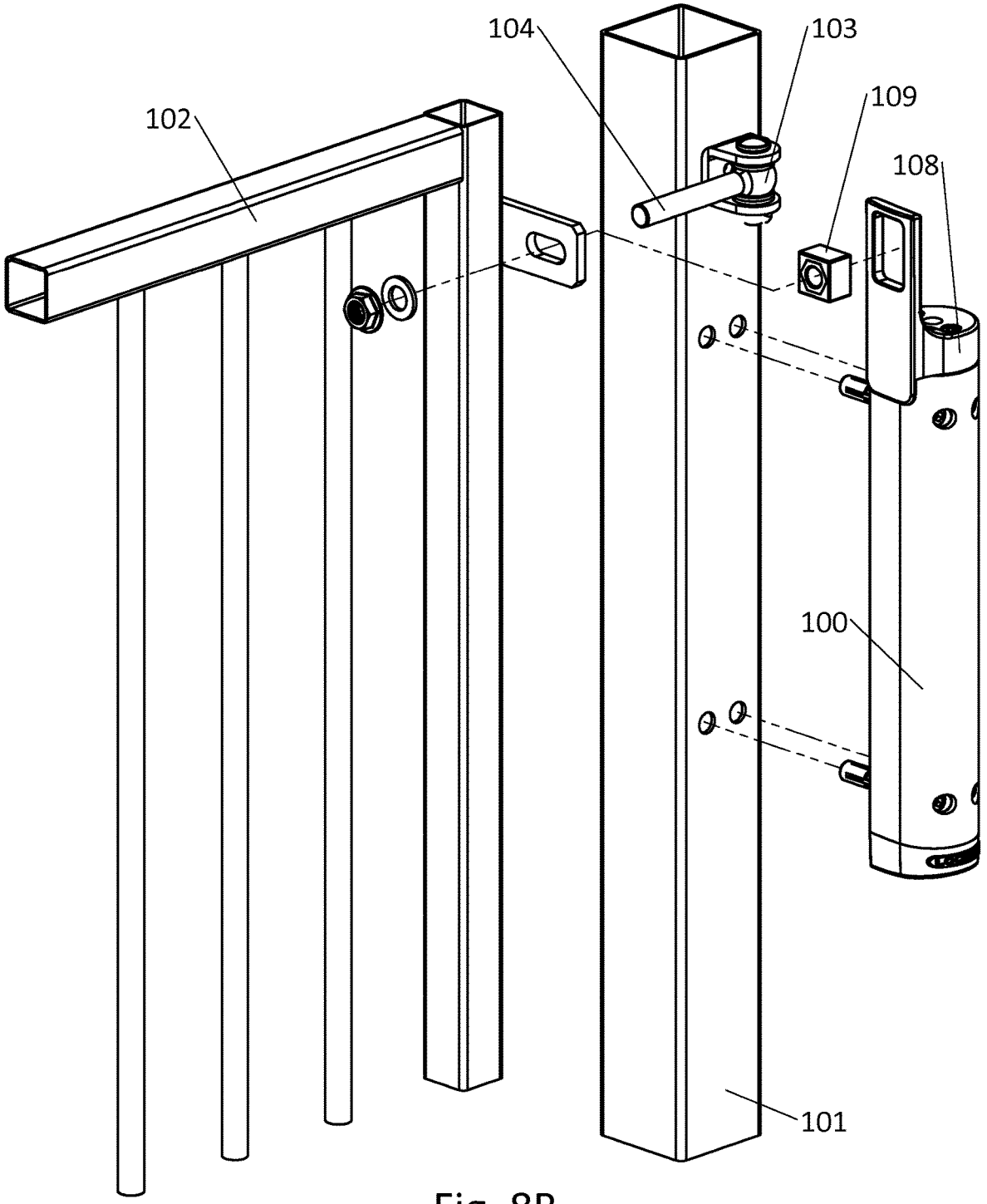

The actuator 100 further comprises a mechanical connector element 108 having an opening through which the arm of the eyebolt hinge 103 runs. Preferably, as illustrated in FIGS. 8A and 8B, a nut 109 is provided on the arm of the eyebolt hinge 103, which nut 109 is disposed in the opening of the mechanical connector element 108. As described in EP-A-3 162 997, when the closure member 102 is being opened or closed, the play of the nut 109 in the opening should preferably remain substantially constant upon rotation of the nut 109.

From FIGS. 8A and 8B, it is clear that the nut 109 is located close to the hinge axis 129 (illustrated in FIG. 10A) of the closure system. In other words, there is no long fulcrum between the nut 109, at which point forces are transmitted to and from the actuator 100, and the hinge axis 129. Moreover, the actuator 100 of the present embodiment is typically used for heavy closure members 102. Therefore, the actuator 100 of the present embodiment needs to be able to handle large forces in order to close the closure system.

Figure 10A:
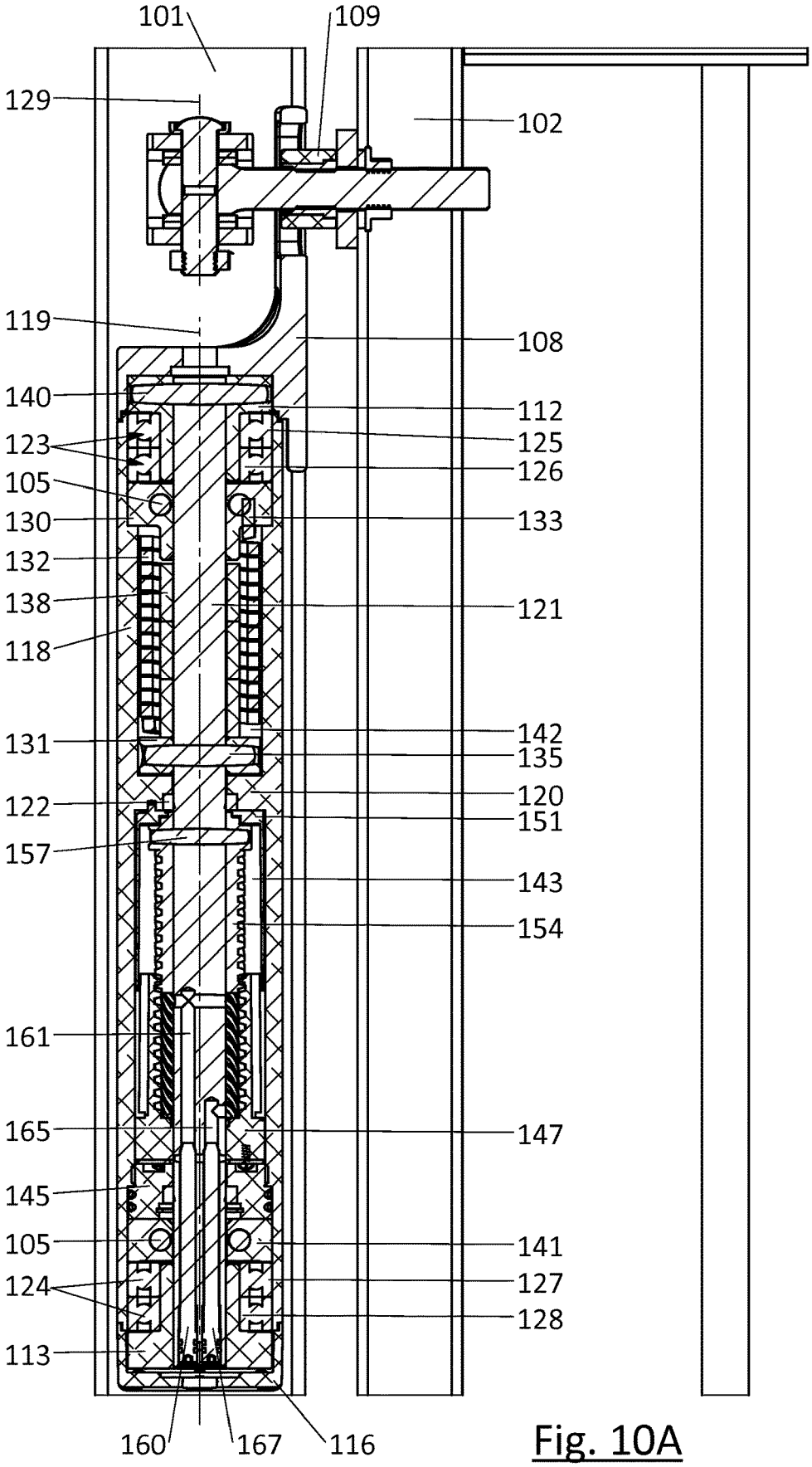
FIGS. 10A and 10B show a longitudinal cross-section through the actuator of FIGS. 8A and 8B respectively when mounted on the support.
Figure 10B:
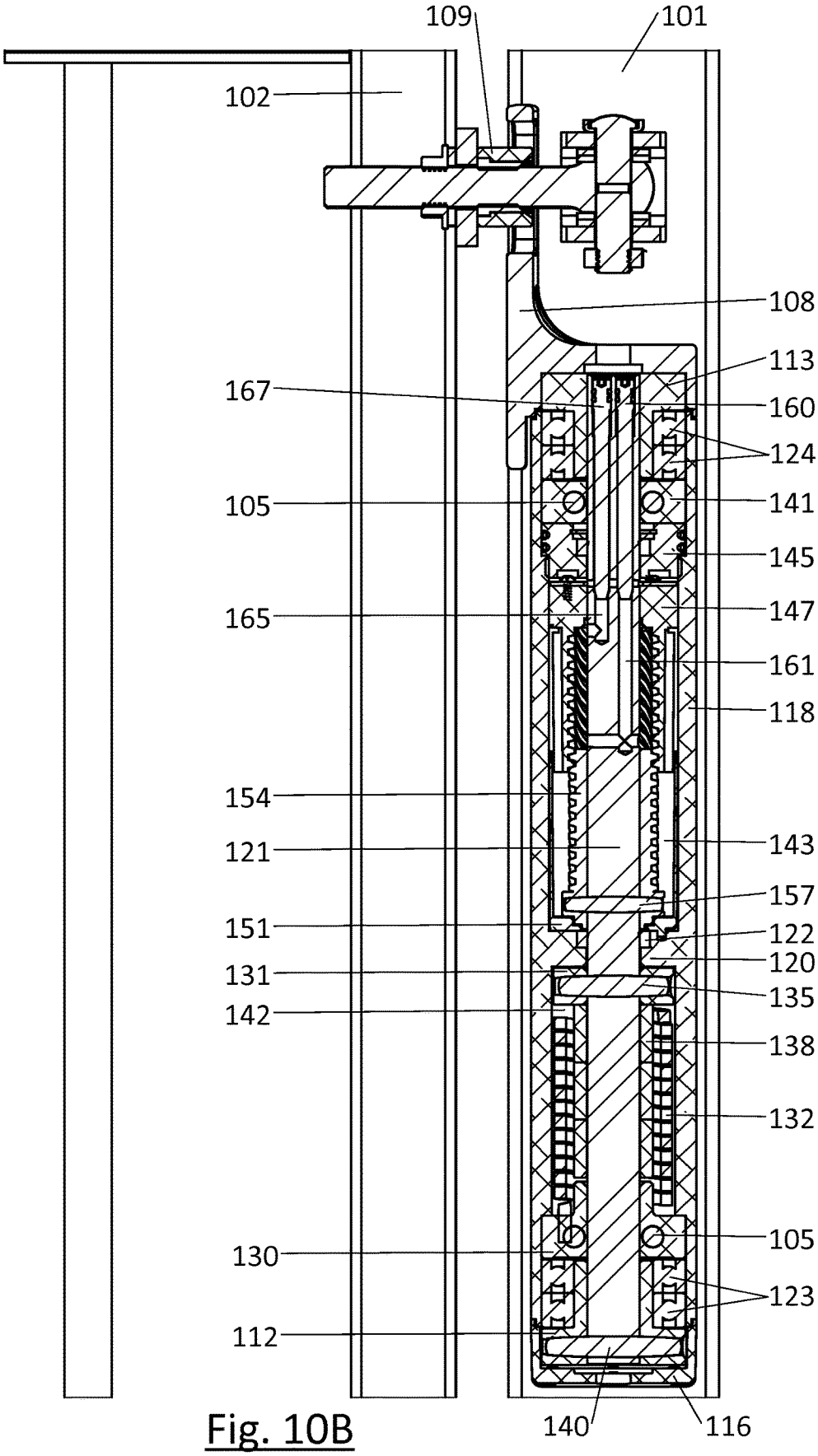

As illustrated in FIGS. 9A and 9B, the mechanical connector element 108 may be fixed to both ends of the main body 110 of the actuator 100 by using two bolts 111. Specifically, the main body 110 has two opposing ends, each being provided with a connection member 112, 113 that has two holes 114 into which the bolts 111 may be screwed. As such, the mechanical connector element 108 can be fixed to either connection member 112, 113 thereby enabling the main body 110 to be mounted in two different orientations. In particular, FIGS. 9A and 10A illustrate the main body 110 of the actuator in the first orientation, while FIGS. 9B and 10B illustrate the main body 110 of the actuator in the second orientation that is opposite to the first orientation.

It will be readily appreciated that more or fewer bolts 111 may also be used to fix the mechanical connector element 108 to the main body 110 of the actuator 100. For example, only a single bolt may be used that is bolted in the centre of the connection members 112, 113. However, especially considering the large forces in the present embodiment of the actuator 100, offsetting the bolt(s) 111 with respect to the centre of the connection members 112, 113 is advantageous to transfer the rotational motion to and from the mechanical connector element 108.

Furthermore, other means to fix the mechanical connector element 108 to the main body 110 of the actuator 100 may also be possible. For example, a pin may be placed transversally through both the mechanical connector element 108 and the connection members 112, 113.

Each of the connection members 112, 113 is also provided with an additional hole 115 that cooperates with a projection (not shown) on the bottom side of the mechanical connector element 108 thereby ensuring a unique alignment between the mechanical connector element 108 and the main body 110 of the actuator 100. In other words, there is only a single possible position to mount the mechanical connector element 108 on either of the connection members 112, 113. This is done such that the mechanical connector element 108 is mounted with the plate-like part having the opening oriented towards the closure member 102 for both a right-handed and a left-handed closure system as illustrated in FIGS. 8A and 8B.

It will be readily appreciated that alternative means may also be provided to ensure a unique alignment between the mechanical connector element 108 and the main body 110 of the actuator 100. For example, a groove along the inner side of the mechanical connector piece with a corresponding projection on the outer side of the connection members 112, 113.

The actuator 100 preferably also comprises an end-cap 116 used to cover the free connection member 112, 113, i.e. the connection member not used for mounting the mechanical connector element 108. In FIGS. 9A and 9B, the end-cap 116 is mounted to the main body 110 of the actuator 100 using two bolts, but it will be appreciated that more or fewer bolts may be used. The end-cap 116 is beneficial as it prevents dirt and/or water from entering the main body 110 of the actuator 100.

In an alternative, non-illustrated, embodiment, the end-cap 116 may directly mounted to the support 101 using a fixture set as described above. The advantage thereof is that it provides an additional fixation point of the actuator 100, which fixation point is located as far as possible from the region where rotational forces are transmitted from and to the closure member 102, i.e. near the connection member 112, 113 onto which the mechanical connector piece 108 is mounted.

Figure 11A:
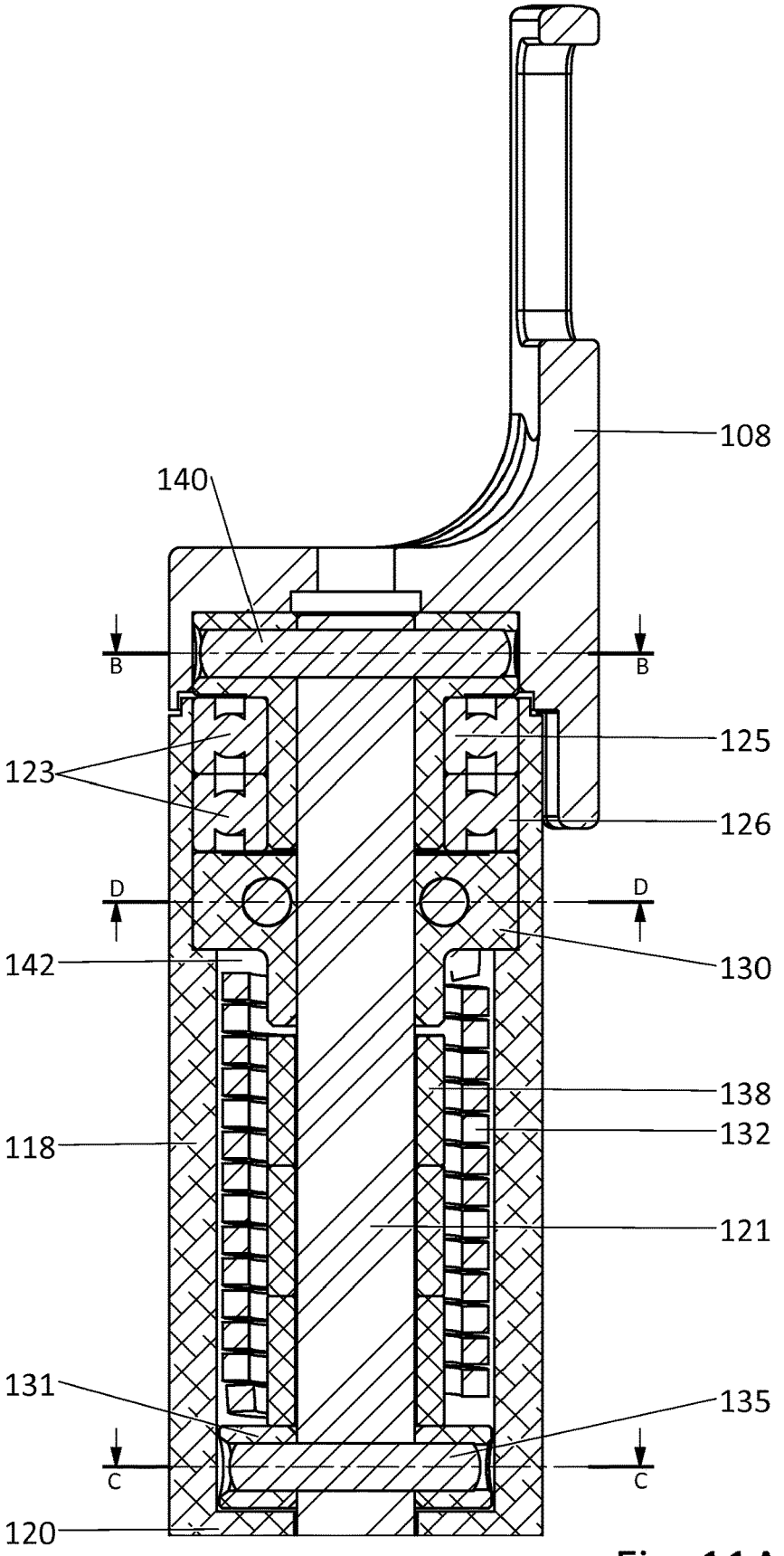
FIGS. 11A and 11B show a longitudinal cross-section through the actuator of FIG. 8A respectively for the top part and the bottom part of the actuator.
Figure 11B:
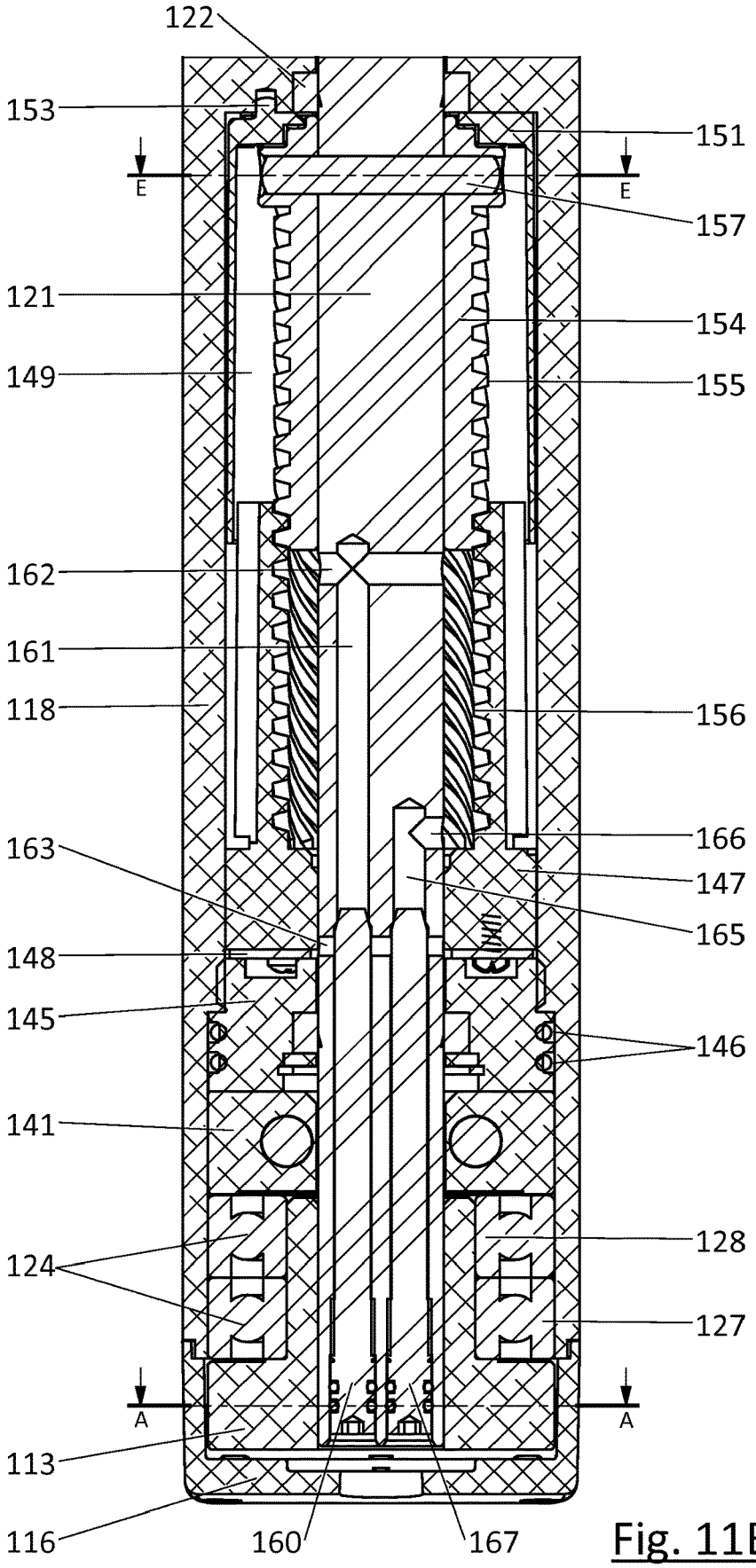

FIGS. 10A and 10B show a longitudinal cross-section through the actuator 100 of when mounted onto a right-handed and a left-handed closure system respectively. FIGS. 11A and 11B illustrate a same view as FIG. 10A but on a larger scale focussed on respectively the top half and the bottom half of the actuator 100. These Figures will be used to describe details relating to the internal mechanisms of the actuator 100.

The actuator 100 is mainly formed by a tubular cylinder barrel 118 having a longitudinal axis 119. The tubular cylinder barrel 118 has an internal collar 120 that divides the tubular cylinder barrel 118 into a first tubular part 142 housing the energy storing mechanism and a second tubular part 143 housing the hydraulic damping mechanism. The tubular cylinder barrel 118 is preferably manufactured from extruded aluminium which is less porous, and which therefore also has a larger strength, when compared with cast aluminium so that it is leak-free with respect to hydraulic fluid. Moreover, it is advantageous if the first tubular part 142 and the second tubular part 143 are bore milled from the extruded aluminium as this results in the collar 120 being integrally formed with the tubular cylinder barrel 118, which is itself also integrally formed, thereby providing a substantially leak-free barrier between the first tubular part 142 and the second tubular part 143. Advantageously, each tubular part 142, 143 has a decreasing diameter when approaching the collar 120 thereby enabling all the elements of the energy storing and damping mechanism to be inserted from either the first end or the second end of the tubular cylinder barrel 118.

The actuator comprises a first fixation member formed by a ring 130 and a second fixation member formed by a ring 141. Each of these fixation members 130, 141 has two openings 117 through which bolts 105 of the fixture sets are placed to fix the tubular cylinder barrel 118 to the support 101. It is advantageous to provide these fixation members 130, 141 as near the ends of the tubular cylinder barrel 118 as possible, because the forces generated with opening and closing the closure system will be largest near the ends of the tubular cylinder barrel 118.

The actuator 100 comprises a shaft 121 that extends along the length of the tubular cylinder barrel 118 and has a rotation axis that substantially coincides with the longitudinal axis 119 of the tubular cylinder barrel 118. As such, the shaft 121 is placed within the circular opening provided by the collar 120. Near the collar 120, a sealing ring 122 is placed around the shaft 121 to ensure that the hydraulic fluid from the hydraulic damping mechanism in the second tubular part 143 does not enter the first tubular part 142 that houses the energy storing mechanism, especially when the actuator 100 is mounted in its second orientation as illustrated in FIG. 10B. The shaft 121 has a first extremity onto which the first connection member 112 is mounted and a second extremity onto which the second connection member 113 is mounted. The shaft 121 is preferably manufactured from steel, preferably stainless steel, but it will be appreciated that other materials may be used.

Figure 12A:
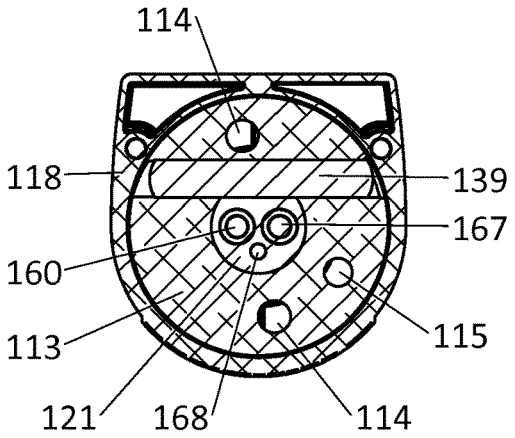
FIGS. 12A to 12E show horizontal cross-sections through the actuator along the planes indicated in FIGS. 11A and 11B.

FIG. 12A shows a horizontal cross-section through the actuator 100 along line "A" indicated in FIG. 11B. FIG. 12A illustrates how the second connection member 113 is fixed the second extremity of the shaft 121. Specifically, a pin 139 is inserted transversally through the second connection member 113 and partly through the shaft 121 thereby irrotatably locking the second connection member 113 to the shaft 121. In the illustrated embodiment, the pin 139 is offset with respect to the longitudinal axis 119. This is advantageous as it enables providing adjustable valves for the hydraulic damping mechanism centrally in the shaft 121.

Figure 12B:
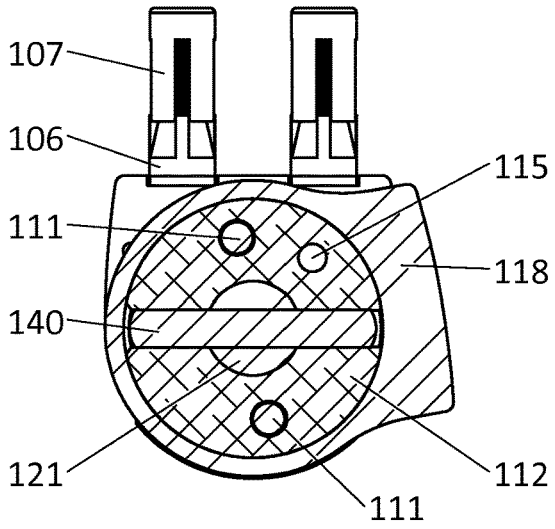

FIG. 12B shows a horizontal cross-section through an alternative actuator 100 along line "B" indicated in FIG. 11A. This horizontal cross-section illustrates that a pin 140 is provided to fix the first connection member 112 to the first extremity of the shaft 121. Contrary to the pin 139, the pin 140 is placed centrally through the shaft 121 and the first actuation member 130. The advantage of a central pin 140 is that it provides a more robust connection between the shaft 121 and the first connection member 112.

It will be readily appreciated that, such a central pin may also be used for the second connection member 113 in an embodiment of the actuator 100 that does not include adjustable valves in the shaft 121. Furthermore, the pin 140 may also be offset with respect to the longitudinal axis 119. Moreover, the pins 139, 140 may be threaded to provide a more secure connection.

Returning to FIGS. 10A to 11B, two roller bearings 123, in particular steel roller bearings, are provided between the tubular cylinder barrel 118 and the first connection member 112 and another two roller bearings 124, in particular steel roller bearings, are provided between the tubular cylinder barrel 118 and the second connection member 113. Hereinafter, the term "double roller bearing" may also be used to describe the stacked roller bearings 123 and/or the stacked roller bearings 124. Both of the roller bearings 123 have an outer race 125 that radially engages an inner surface of the tubular cylinder barrel 118 and an inner race 126 that radially engages an outer surface of the first connection member 112, in particular an outer surface of an annular sleeve portion of the first connection member 112. Both of the roller bearings 124 have an outer race 127 that radially engages an inner surface of the tubular cylinder barrel 118 and an inner race 128 that radially engages an outer surface of the second connection member 113, in particular an outer surface of an annular sleeve portion of the second connection member 113. These roller bearings 123, 124 enable an almost frictionless relative rotation of the shaft 121 with respect to the tubular cylinder barrel 118.

FIGS. 10A to 11B also illustrate that the outer races 125 of the first roller bearings 123 axially engage the first connection member 112, while the inner races 126 of the first roller bearings 123 axially engage a transverse surface formed by the first fixation member 130. FIGS. 10A and 10B further illustrate that the outer races 127 of the second roller bearings 124 axially engage the second connection member 113, while the inner races 128 of the second roller bearings 124 axially engage a transverse surface formed by the second fixation member 141. Such a configuration is advantageous when considering that the shaft 121 may be subjected to a force in the direction of the longitudinal axis 119, such a force may be generated by the damping mechanism. Such a force will either pull the first connection member 112 towards the first roller bearings 123 or the second connection member 113 towards the second roller bearings 124. In both of these cases, the roller bearings 123, 124 will transmit, via the inner races 126, 128 to the outer races 125, 127, this longitudinally oriented force to respective ones of the first and second fixation members 130, 141, which are directly fixed to the support 101. In other words, the configuration of the roller bearings 123, 124 ensures that the shaft 121 is securely fixed in the direction of the longitudinal axis 119. Preferably, the double roller bearings 123, 124 are ball bearings, in particular steel ball bearings, as these are more suited to transmit forces in the axial direction.

It will be readily appreciated that only a single roller bearing 123, 124 could be provided between each connection member 112, 113 and the tubular cylinder barrel 118. However, as described above, the actuator 100 of the present embodiment needs to handle large forces, therefore, providing two roller bearings 123, 124 is advantageous.

Moreover, the double roller bearings 123, 124 could also be placed with their inner race 126, 128 directly contacting the shaft 121. This could be achieved by having connection members 112, 113 that do not include the annular sleeve portion and by providing roller bearings 123, 124 having a smaller diameter. However, as described above, the double roller bearings 123, 124 need to transfer longitudinally directed forces, therefore, providing roller bearings 123, 124 having a larger diameter, i.e. having a larger surface area of the races 125, 126, 127, 128, is clearly advantageous.

The energy storing mechanism in the first tubular part 142 of the tubular cylinder barrel 118 is shown in FIGS. 10A to 11A. The energy storing mechanism comprises a first actuation member formed by the ring 130 (which ring 130 also forms the first fixation member in this embodiment), a second actuation member formed by a ring 131 and a torsion spring 132 connected with a first end 133 (shown in FIG. 12D) to the first actuation member 130 and with a second end 134 to the second actuation member 131. Both actuation members 130, 131 are annular and are placed around the shaft 121. The torsion spring 132 is preferably pre-tensioned during assembly of the actuator 100 in the sense that, irrespective of the relative positions of the actuation members 130, 131, the torsion spring 132 always has a minimum amount of energy stored. This ensures that the closure system will be properly closed.

It will be readily appreciated that, although the ring 130 in the illustrated embodiment has a double function, two rings may also be provided, a first of these rings forming the first fixation member and a second of these rings forming the first actuation member.

It will be appreciated that, in an alternative, non-illustrated embodiment, the energy storing mechanism may also be provided with a compression spring and a sliding piston.

Figure 12C:
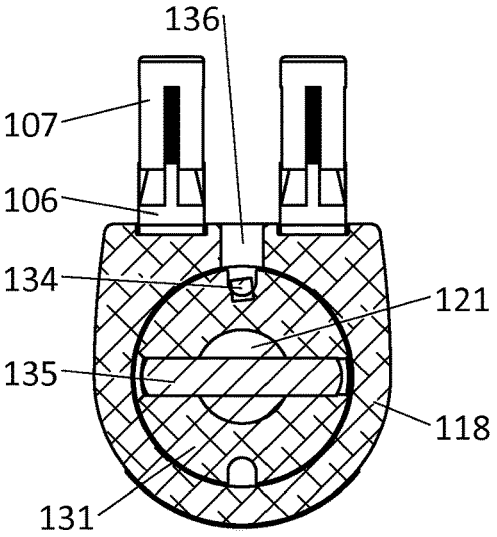

FIG. 12C shows a horizontal cross-section through the actuator 100 along line "C" indicated in FIG. 11A. During assembly of the actuator 100, a pin 135 is transversely inserted through the opening 136 in the back of the tubular cylinder barrel 118 into openings provided in the second actuation member 131 and the shaft 121. As such, the second actuation member 131 is irrotatably fixed to the shaft 121. FIG. 12C also illustrates that the second end 134 of the torsion spring 132 is placed into a hole provided in the second actuation member 131. As such, the second end 134 of the torsion spring 132 is also irrotatably fixed to the shaft 121.

Figure 12D:
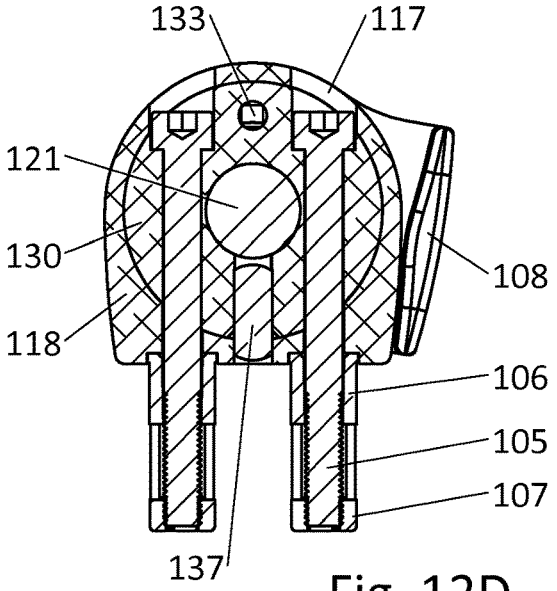

FIG. 12D shows a horizontal cross-section through the actuator 100 along line "D" indicated in FIG. 11A. During assembly of the actuator 100, a pin 137 is transversely inserted through an opening in the back of the tubular cylinder barrel 118 into an opening provided in the first actuation member 130. As such, the first actuation member 130 is irrotatably fixed to the tubular cylinder barrel 118. FIG. 12C also illustrates that the first end 133 of the torsion spring 132 is placed into a hole provided in the first actuation member 130. As such, the first end 133 of the torsion spring 132 is also irrotatably fixed to the tubular cylinder barrel 118.

It will be readily appreciated that the pins 135, 137 may be threaded to provide a more secure connection.

FIG. 12D further illustrates that the ring 130 acts both as the first actuation member and as the first fixation member with bolts 105 of the fixture sets being inserted through both the tubular cylinder barrel 118 and the first actuation member. Therefore, when the actuator 100 is mounted to the support 101, the pin 137 no longer serves a purpose. However, before the actuator 100 is mounted to the support 101, the pin 137 is advantageous as it enables the torsion spring 132 to be pre-tensioned.

Returning to FIGS. 10A to 11B, in a preferred embodiment, the energy storage mechanism also comprises padding 138 to prevent the torsion spring 132 from buckling due to the large forces exerted thereon. In the illustrated embodiments, the padding 138 comprises three rings placed around the shaft 121 in the space between the shaft 121 and the torsion spring 132. The padding 138 is free to rotate with the shaft 121 and does not contact the torsion spring 132 thus causing no significant friction. FIGS. 10A to 11B further provide details on the hydraulic damping mechanism. The shaft 121 provides the coupling between the energy storing mechanism and the damping mechanism, and more generally, transfers the opening and closing movement of the closure system to the damping mechanism.

The hydraulic damping mechanism comprises a closed cylinder cavity 144 formed inside the second tubular part 143. The closed cylinder cavity 144 is closed at one end by the collar 120, preferably in combination with the sealing ring 122, and at the other end by an annular closing member 145. This annular closing member 145 is preferably screwed in the tubular cylinder barrel 118 and includes at least one additional sealing ring 146 to ensure a leak-tight connection between the tubular cylinder barrel 118 and the annular closing member 145. The closed cylinder cavity 144 has a longitudinal direction which is the same as the direction of the longitudinal axis 119. The closed cylinder cavity 144 is filled with a hydraulic fluid.

The damping mechanism further comprises a piston 147 placed in the closed cylinder cavity 144 to divide the closed cylinder cavity 144 into a high pressure compartment 148 and a low pressure compartment 149 (illustrated in FIG. 11B). The piston 147 is preferably made from a synthetic material, in particular a thermoplastic material and is more preferably injection moulded.

Figure 12E:
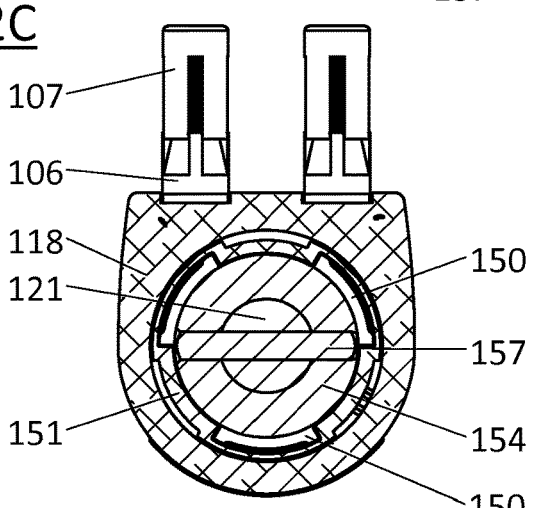

As illustrated in the horizontal cross-section in FIG. 12E, which cross-section runs along the line "E" indicated in FIG. 11B, the piston 147 has three outward projections 150 which are guided in three grooves in a guiding element 151 which is also arranged in the closed cylinder cavity 144. As illustrated in FIGS. 10A to 11B, the guiding element 151 fits in the second tubular part 143 and is irrotatably locked therein by means of at least one bolt (not shown in the Figures illustrating this embodiment, but shown indicated in FIG. 17B with reference number 252), which is bolted into at least one corresponding hole in the collar 120. FIG. 11B further illustrates that the guiding element 151 also has at least one projection 153 that fits into a recess in the collar 120, which projection 153 further ensures that the guiding element 151 is irrotatably fixed to the tubular cylinder barrel 118. By such a configuration, the piston 147 can substantially not rotate within the closed cylinder cavity 144 and is slidable in the longitudinal direction of the closed cylinder cavity 144 between two extreme positions, namely a closed position and an open position.

It will be readily appreciated that, in other embodiments, more bolts and/or projections 153 may be used, or that only bolts or only projections 153 may be used to irrotatably lock the guiding element 151 in the second tubular part 143. Moreover, other means may be suitable to irrotatably lock the guiding element 151 in the second tubular part 143. For example, bolts may be inserted transversally through the tubular cylinder barrel 118 into the guiding element 151. However, this would result in at least one opening in the closed cylinder cavity 144, which opening is used to insert the bolt, which may lead to a leak of hydraulic fluid.

It will be further appreciated that more or less grooves may be provided in the guiding element 151. The guiding element 151 is preferably made from a synthetic material, in particular a thermoplastic material. Furthermore, the guiding element 151 is preferably injection moulded.

The hydraulic damping mechanism further comprises the rotatable shaft 121, which runs through both the high pressure and the low pressure compartments 148, 149 of the closed cylinder cavity 144.

In order to convert the rotational motion of the shaft 121 into a translational motion of the piston 147, a spindle 154 is provided between the shaft 121 and the piston 147. In particular, the spindle 154 is made, preferably injection moulded, of a synthetic material, preferably a thermoplastic material, which can easily be moulded into the required shape. As illustrated in FIG. 12E, during assembly of the actuator 100, a pin 157 is transversely inserted through the spindle 154 and through the shaft 121. In order to convert the rotational motion of the spindle 154 into a translational motion of the piston 147, the spindle 154 is provided with an outer threaded portion 155 that engages an inner threaded portion 156 on the piston 147. In particular, the outer threaded portion 155 is provided with a first, external (male) screw thread which has a screw axis which substantially coincides with the longitudinal axis 119 and which co-operates with an internal (female) screw thread on the piston 147. Since the piston 147 is irrotatably positioned within the closed cylinder cavity 144, the piston 147 slides with respect to the closed cylinder cavity 144. In particular, the piston 147 moves towards the collar 120 when the closure system is being opened and it moves away from the collar 120 when the closure system is being closed. In the illustrated embodiments, the screw threads are therefore right-handed screw threads.

It will be readily appreciated that the pin 157 may be threaded to provide a more secure connection.

It will be readily appreciated that the spindle 154 may also be integrally formed with the shaft 121 as illustrated in the embodiment of the present invention described below with respect to FIGS. 19A to 24B. In other words, the shaft 121 may be provided with the outer threaded portion 155.

To keep the actuator 100 as compact as possible, no gearing or reduction is provided between the shaft 121 and the piston 147. As such, the threaded portions 155, 156 have a screw thread with a high lead angle. Preferably, the outer threaded portion 155 has a lead angle of at least 45° and more preferably at least 55° and most preferably at least 60°. In the illustrated embodiment, the lead angle is equal to about 66°. Moreover, the outer threaded portion 155 preferably has at least 5 starts and more preferably at least 7 starts and 10 starts in the illustrated embodiments.

The hydraulic damping mechanism further comprises a one-way valve (not shown in the Figures illustrating this embodiment, but indicated in FIG. 17B with reference number 258) which allows the hydraulic fluid to flow from the low pressure compartment 149 of the closed cylinder cavity 144 to the high pressure compartment 148 thereof when the closure system is being opened. The opening movement of the closure system is therefore not damped or at least to a smaller extent than the closing movement. This one-way valve 158 is typically provided in the piston 147.

To achieve the damping action upon closing of the closure system by the energy storing mechanism, at least one restricted fluid passage is provided between the two compartments 148, 149 of the closed cylinder cavity 144. One restricted fluid passage is formed by a channel connecting, in all the possible positions of the piston 147, i.e. in all positions between its two extreme positions, the low pressure compartment 149 with the high pressure compartment 148. This channel is provided with an adjustable valve 160, in particular a needle valve, so that the flow of hydraulic liquid through this channel can be controlled. In this embodiment, the channel is provided in by at least three bores in the shaft 121 (as detailed in FIG. 11B), i.e. a first bore 161 in the direction of the longitudinal axis 119, a second bore 163 transverse to the direction of the longitudinal axis 119 at the extremity of the low pressure compartment 148, and a third bore 162 transverse to the direction of the longitudinal axis 119 at the extremity of the high pressure compartment 148. The needle of the adjustable valve 160 is screwed into the extension of the first bore 161 that runs to the end face of the second extremity of the shaft 121 so that the adjustable valve 160 is adjustable from the outside when the actuator is mounted on the support 101.

The shaft further comprises a second restricted fluid passage formed by channel that also comprises three bores as detailed in FIG. 11B. Specifically, a first bore 165 in the direction of the longitudinal axis 119, a second bore 162 transverse to the direction of the longitudinal axis 119 just above the piston 147, when the piston 147 is in its closed position, and a third bore corresponding to the third bore 163 of channel, i.e. at the extremity of the high pressure compartment 148. As such, the second channel forms a by-pass which causes an increase of the closing speed at the end of the closing movement, i.e. a final snap, to ensure that the closure system is reliably closed. A second adjustable valve 167, in particular a needle valve, is provided so that the flow of hydraulic liquid through the channel can be controlled to control the closing speed of the closure system during the final snap. Again, the needle of the adjustable valve 167 is screwed into the extension of the first bore 165 that runs to the end face of the second extremity of the shaft 121 so that the adjustable valve 167 is adjustable from the outside when the actuator is mounted on the support 101.

As illustrated in FIG. 12A, a hole 168 is provided in the second extremity of the shaft 121 near the adjustable valves 160, 167. This hole 168 is provided to insert a fixation element 169, e.g. a bolt, pin, etc., (illustrated in FIG. 13) having a flattened head to ensure that the adjustable valves 160, 167 are securely inserted in their respective bore 161, 165.

It will be appreciated that the restricted fluid passages may also be provided in the wall of the tubular cylinder barrel 118 with the adjustable valves 160, 167 being provided in the collar 120 as will be described below with respect to the embodiment of the present invention illustrated in FIGS. 19A to 24B.

The operation of the energy storing mechanism and the damping mechanism will be explained with respect to FIG. 10A for a right-handed closure system and with respect to FIG. 10B for a left-handed closure system.

In FIG. 10A, the actuator 100 is mounted on a right-handed closed closure system with the tubular cylinder barrel 118 fixed to the support 101 and with the shaft 121 being coupled to the closure member 102 via the mechanical connector element 108 and the first connection member 112. When the closure member 102 is being opened, the closure member 102 will rotate in a first direction, which rotation is transferred, via the mechanical connector 108, to the shaft 121 which will also rotate in the first direction. The first actuation member 130 is fixed to the support 101 and will therefore remain stationary, while the second actuation member 131 is fixed to the shaft 121 and will also rotate in the first direction, thereby tensioning the torsion spring 132, i.e. storing energy therein. Concurrently, the shaft 121 has transferred the same rotation to the damping mechanism causing the piston 147 to move towards the collar 120. As the closed cylinder cavity 144 is filled with hydraulic fluid, the motion of the piston 147 results in a motion of the hydraulic fluid across the one-way valve from the low pressure compartment 149 to the high pressure compartment 148. It will be appreciated that the hydraulic fluid may also pass to some extent via the restricted fluid passage formed by channel. These motions may continue until the closure system is fully opened.

When the closure system is fully or partially opened and no force is applied to the closure system, the energy storing mechanism will release its energy to close the closure system. Specifically, the torsion spring 132 will try to relax, thereby rotating the second actuation member 131 in a second direction, opposite to the first direction. Because the second actuation member 131 is fixed to the shaft 121 and the closure member 102, via the mechanical connector 108, these are also urged to rotate. The shaft 121 also transfers this rotation to the piston 147 which is now moved away from the collar 120. The one-way valve is now shut and the hydraulic fluid is forced through the restricted fluid passage in the shaft 121. This restricted flow thus damps the closing movement. When the closure system is almost closed, the piston 147 will no longer block the second bore 166 thus allowing hydraulic fluid to flow from the high pressure compartment 148 to the low pressure compartment 148 via both restricted fluid passage to decrease the damping rate thereby reliably closing the closure system.

In FIG. 10B, the actuator 100 is mounted on a left-handed closed closure system with the tubular cylinder barrel 118 fixed to the support 101 and with the shaft 121 being coupled to the closure member 102 via the mechanical connector element 108 and the second connection member 113. The operation of the actuator 100 is identical because the upside down orientation of the actuator 100 compensates for the difference in rotation of a left-handed closure system. In other words, both the energy storing mechanism and the damping mechanism operate in the exact same manner for both a right-handed and a left-handed closure system.

The actuator 100 described above is mainly used outdoors where large temperature variations are not uncommon. For example, summer temperatures up to 70° C. when the actuator 100 is exposed to sunlight and winter temperatures below −30° C. are not uncommon, i.e. temperature variations up to and possibly even exceeding 100° C. are possible. Moreover, there are also daily temperature variations between night and day which can easily exceed 30° C. when the actuator 100 is subjected to direct sunshine. These temperature variations cause expansion, and also contraction, of the hydraulic fluid, which could affect the operation of the damping mechanism. In particular, the expansion due to temperature variations can be up to 1% of the volume of hydraulic fluid for a temperature variation of 10° C., depending on the expansion coefficient of the hydraulic fluid. As such, an expansion of, for example, up to 3 ml for a temperature difference of 50° C. is possible.

To counter this expansion, a small amount of gas such as air could be provided in the hydraulic fluid itself. However, it has been found that this gas may interfere with the good working of the actuator 100, especially when gas bubbles, or an emulsion of the gas in the hydraulic fluid, passes through the restricted flow passage(s) and provides a smaller damping effect than pure hydraulic fluid. Consequently, the hydraulic fluid is preferably free of gas bubbles.

Figure 13:
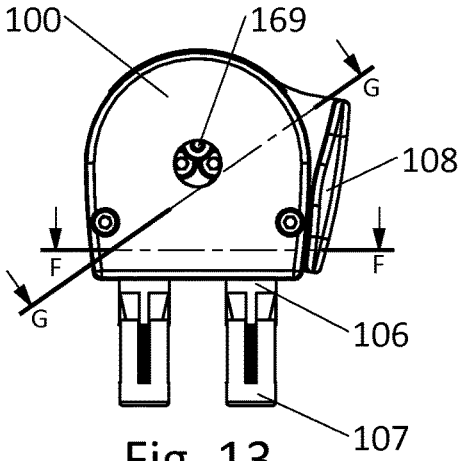
FIG. 13 shows a top view of the actuator illustrated in FIGS. 8A and 8B.
Figure 14A:
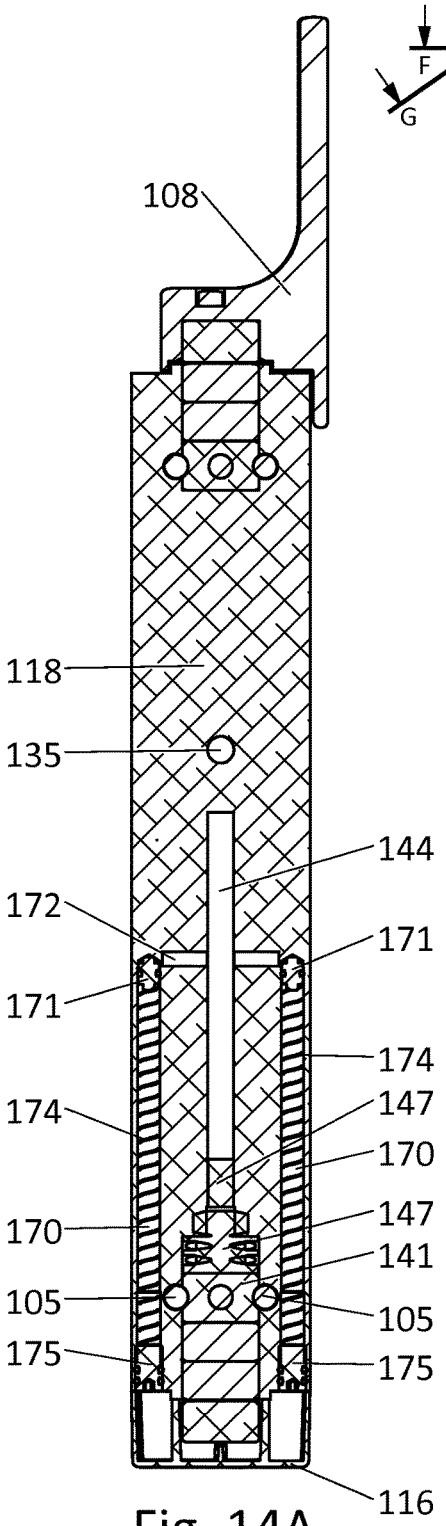
FIGS. 14A and 14B show a longitudinal cross-section along the lines "F" and "G" indicated in FIG. 13.

In the actuator 100 illustrated in the drawings, expansion of the hydraulic fluid is countered by means of two expansion channels 170 that are provided in two bores in the tubular cylinder barrel as illustrated in FIG. 14A which shows a longitudinal cross-section along line "F" in FIG. 13. The expansion channels 170 each have a moveable plunger 171 inserted therein. The plunger 171 divides the expansion channel 170 into a hydraulic fluid compartment having a first volume that is in fluid communication with the closed cylinder cavity 144 via a channel 172 and a pressure relief compartment having a second volume. The plunger 171 has a ring-shaped seal 173 on its outside to prevent leaks between the hydraulic fluid and the pressure relief compartments. It will be readily appreciated that multiple ring-shaped seals 173 may also be provided. When the actuator 100 is exposed to a temperature increase, the volume of the hydraulic fluid increases pushing the plungers 171 deeper into the expansion channels 170 and when the volume of the hydraulic fluid decreases, the plungers 171 are sucked back thereby closing the expansion channels 170.

Figure 14B:
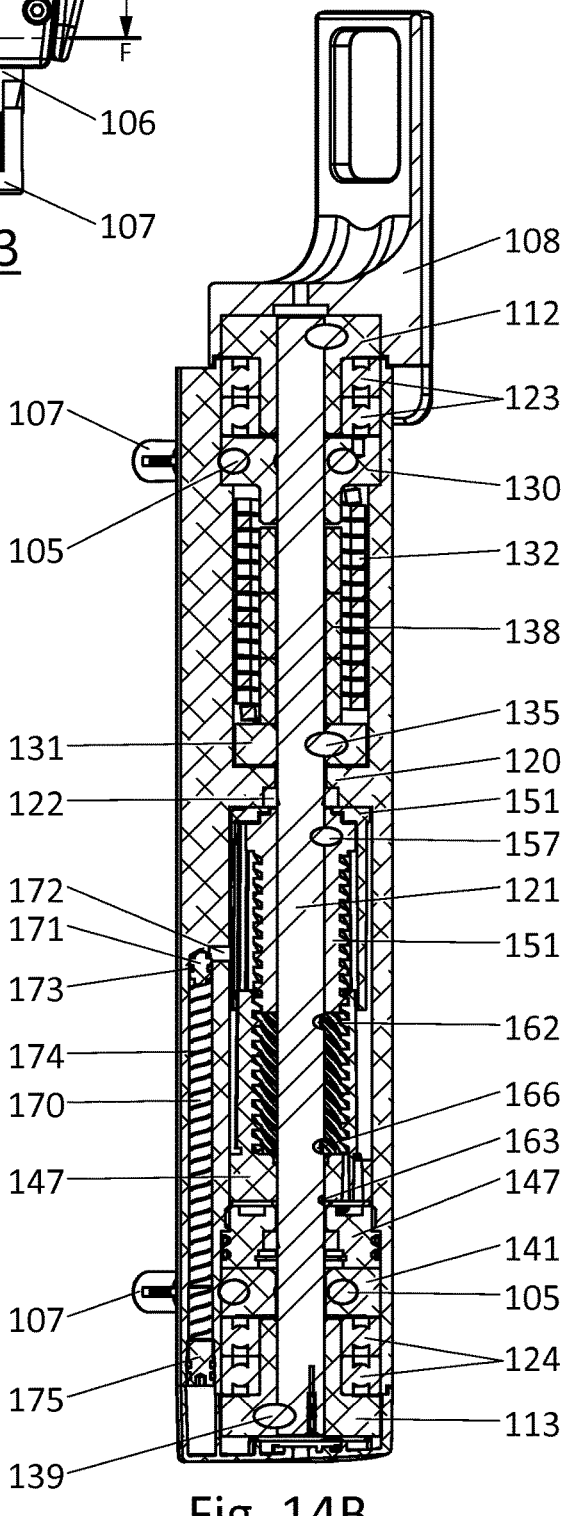
Figure 15:
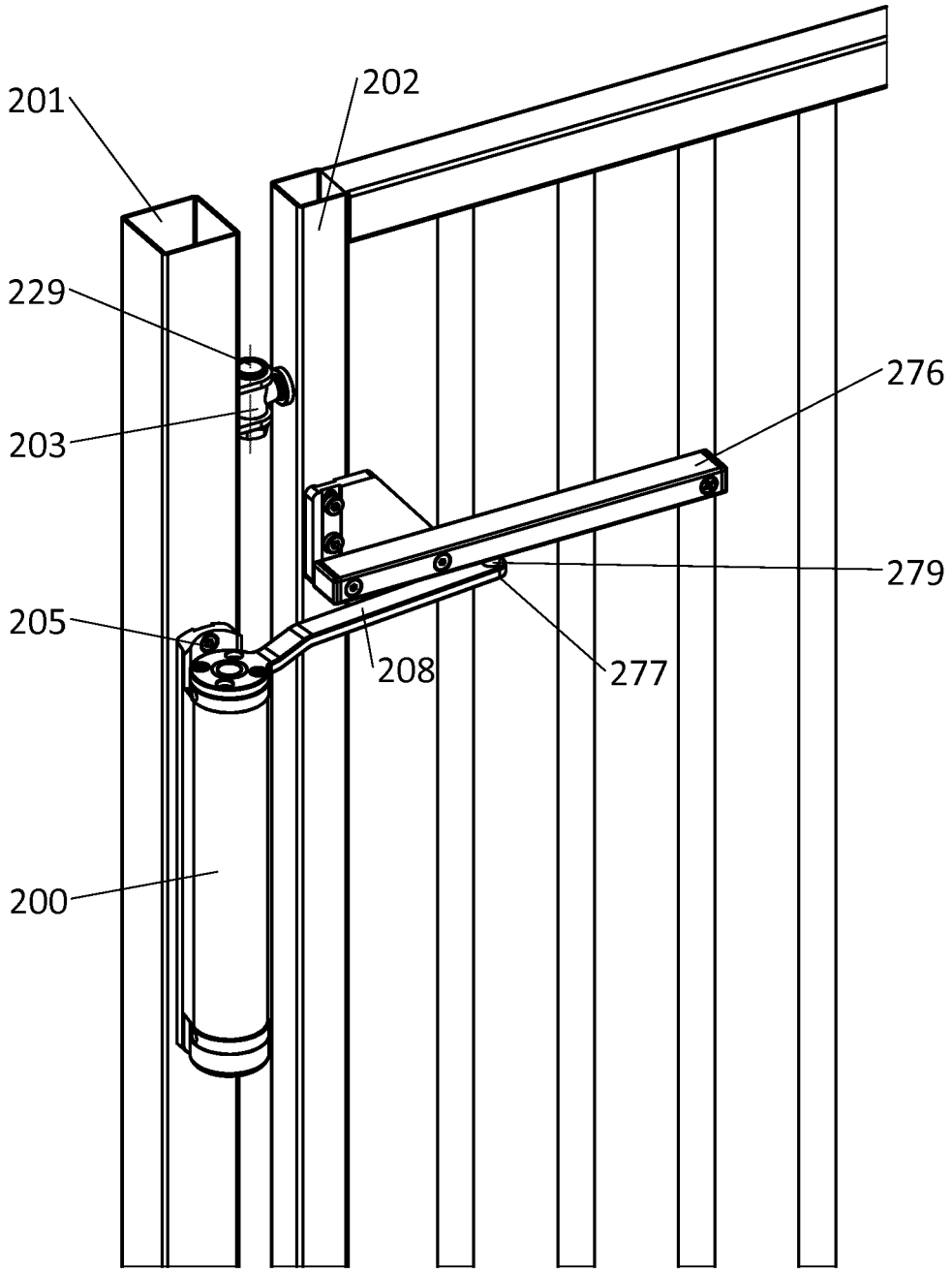
FIG. 15 shows a hydraulically damped actuator according to another embodiment of the present invention mounted on a right-handed closure system.

As illustrated in FIG. 14B, the hydraulic fluid compartment is in fluid communication with the low pressure compartment 149 of the closed cylinder cavity 144. As such, the plunger 171 is not exposed to the high pressures that result from the normal operation of the damping mechanism. This is advantageous as, exposing the hydraulic fluid compartment to the high pressure compartment 149 would affect the closing movement of the closure system, i.e. the hydraulic fluid would not only flow via the channel but would also enter the hydraulic fluid compartment of the expansion channel 170 by displacing the plunger 171.

In the illustrated embodiment, the pressure relief compartment is also provided with a biasing member formed by a compression spring 174 and an end cap 175 that seals off the expansion channel 170 from the outside and that urges the plunger 171 towards the channel 172. The effect of this spring 174 is that the hydraulic fluid is pressurised so that negative pressures in the hydraulic fluid are alleviated. Specifically, the hydraulic fluid is usually added at room temperature, e.g. near 20° C. When the hinge is exposed to temperatures down to −30° C. a negative pressure would occur in the hydraulic fluid in the absence of the compression spring 174. Furthermore, when the actuator 100 is first exposed to temperatures up to 70° C., and then cooled down to a lower temperature, the increased friction between the ring-shaped seal 173 and the expansion channel 170 (as a result of the fact that the seal 173 becomes less flexible at lower temperatures) could result, in absence of the compression spring 174, in an additional negative pressure in the hydraulic fluid which could result in air getting sucked into the closed cylinder cavity 144 via the sealing ring 122 around the shaft 121 or via the seal 173 on the plunger 171. This problem is solved by the compression spring 174 which pressurizes the hydraulic fluid, even at low temperatures, so that any risk of air being sucked into the cylinder cavity being avoided.

In the illustrated embodiments, the pressure relief compartment is filled, besides with the compression spring 174, with air and is closed off by the end cap 175. When, the end cap 175 provides an airtight seal, the gas in the pressure relief compartment may be pressurised to assist or replace the compression spring 174.

The volume of the expansion channels 170 and their first and second volumes are mainly determined in function of the expected increase in volume of the hydraulic fluid. In the illustrated embodiments, the first volume is preferably at least 1.5 ml, more preferably at least 2 ml, advantageously at least 2.5 ml and more advantageously at least 3 ml when the plunger 171 is pushed as far back as possible into the expansion channel 170, i.e. when the first volume is maximal. The maximal second volume is preferably substantially the same as the maximal first volume to provide enough space for the compression spring 174.

It will be readily appreciated that, in other embodiments, only a single expansion channel 170 may be provided when the expected expansion and/or contraction of the hydraulic fluid may be compensated by the available volume of a single expansion channel 170.

Third Embodiment

FIGS. 8 to 18C illustrate another embodiment of an actuator 200 according to the present invention. Elements or components previously described with reference to FIGS. 8A to 14B bear the same last two digits but preceded by a '2'.

The actuator 200 is designed to be used in a closure system having a support 201 with a closure member 202 hingedly attached thereto by means of an eyebolt hinge 203. A main difference with respect to the first embodiment is that the actuator 200 is not placed in line with the hinge axis 229 of the closure system. As such, the closure system may only be rotated about 90°, while the closure system used in conjunction with the actuator 100 may be rotated about 180°. In particular, the closure member 202 is hinged to the support 201 with a hinge arranged inbetween the support 201 and the closure member 202, as disclosed for example in EP-B-2 778 330.

Furthermore, the mechanical connector element of the first embodiment has been replaced by an extended arm 208 that is slidably mounted to a rail 276 that is fixed to the closure member 202. Specifically, a distal part 277 of the extended arm 208 is provided with a projection 279 that is slideably received in the rail 276. The advantage of the extended arm 208 is that there is a relative long fulcrum between the distal part of the extended arm 208, at which point forces are transmitted to and from the actuator 200, and the hinge axis 229. Therefore, the actuator 200 of the present embodiment does not need to be able to handle the same large forces as the actuator 100 of the previous embodiment.

It will be readily appreciated that other types of extended arms may be suitable to transfer the rotational motion to and from the actuator 200. For example, the extended arm 208 may also comprises multiple sections that are pivotable with respect to one another, with the most distal section being fixedly connected to the closure member 202. Another example may be that the extended arm 208 is provided with a rail into which an element is slideably received, which element is fixedly connected to the closure member 202.

Figure 16:
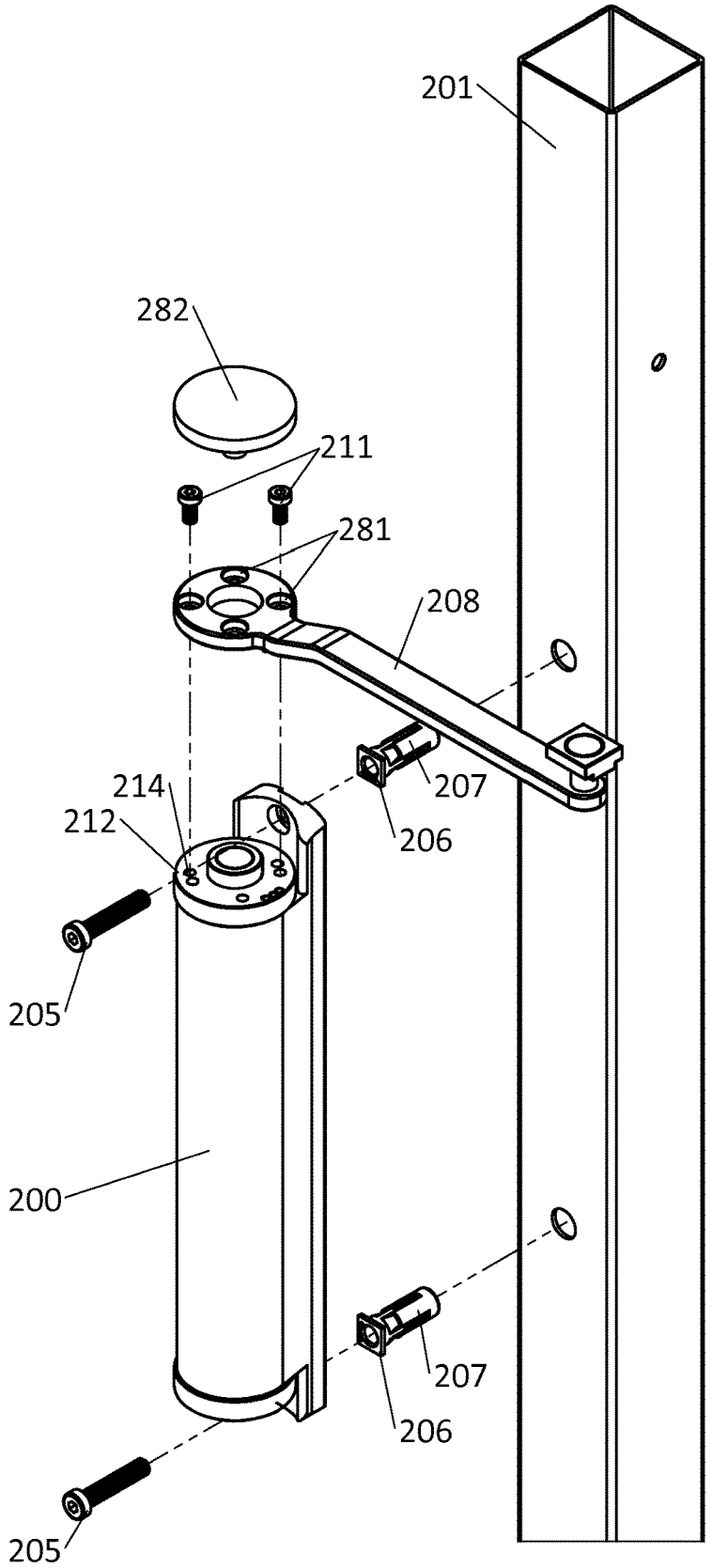
FIG. 16 shows how the actuator of FIG. 15 is mounted to the support.

FIG. 16 shows how the actuator 200 is mounted to the support 201 for a right-handed closure system. As illustrated, two fixture sets 205, 206, 207 are used that are inserted through openings above and beneath the connection members 212, 213 thereby fixing the main body 210, i.e. the tubular cylinder barrel 218, to the support 201. For a left-handed closure system, the main body 210 of the actuator 200 is inverted. In this embodiment, only two fixture sets are needed because the extended arm 208 decreases the magnitude of the force that the actuator 200 has to handle.

After the main body 210 has been securely fixed to the support 201, the extended arm 208 is fixed to either the first connection member 212 (as illustrated in FIG. 16) or the second connection member 213 depending on the orientation of the main body 210. Specifically, the extended arm 208 is provided with an annular portion 280 at its proximal end, which annular portion 280 has four openings 281 that may be aligned with six openings 214 in one of both connection members 212, 213. Two bolts 211 are then used to securely fix the extended arm 208 to one of the connection members 212, 213. The four openings 281 together with the six holes 214 enable the extended arm 208 to be mounted in three different positions, each position having a different orientation of the extended arm 208 with respect to the main body 210 of the actuator 200. This is advantageous as it enables to compensate for changes in the relative positioning of the support 201 and the closure member 202. Preferably, the three positions differ from one another by at least 5°, preferably at least 10° and most preferably at least 15°. Finally, an end-cap 282 is placed to conceal the connection between the extended arm 208 and the connection member 212, 213.

It will be readily appreciated that more or fewer bolts 211 may also be used to fix the extended arm 208 to the main body 210 of the actuator 200. For example, only a single bolt may be used that is bolted in the centre of the connection members 212, 213. However, a centrally placed bolt 211 also means that the one or more adjustable valves 260, 267 cannot be placed centrally in the shaft 221.

Figure 17A:
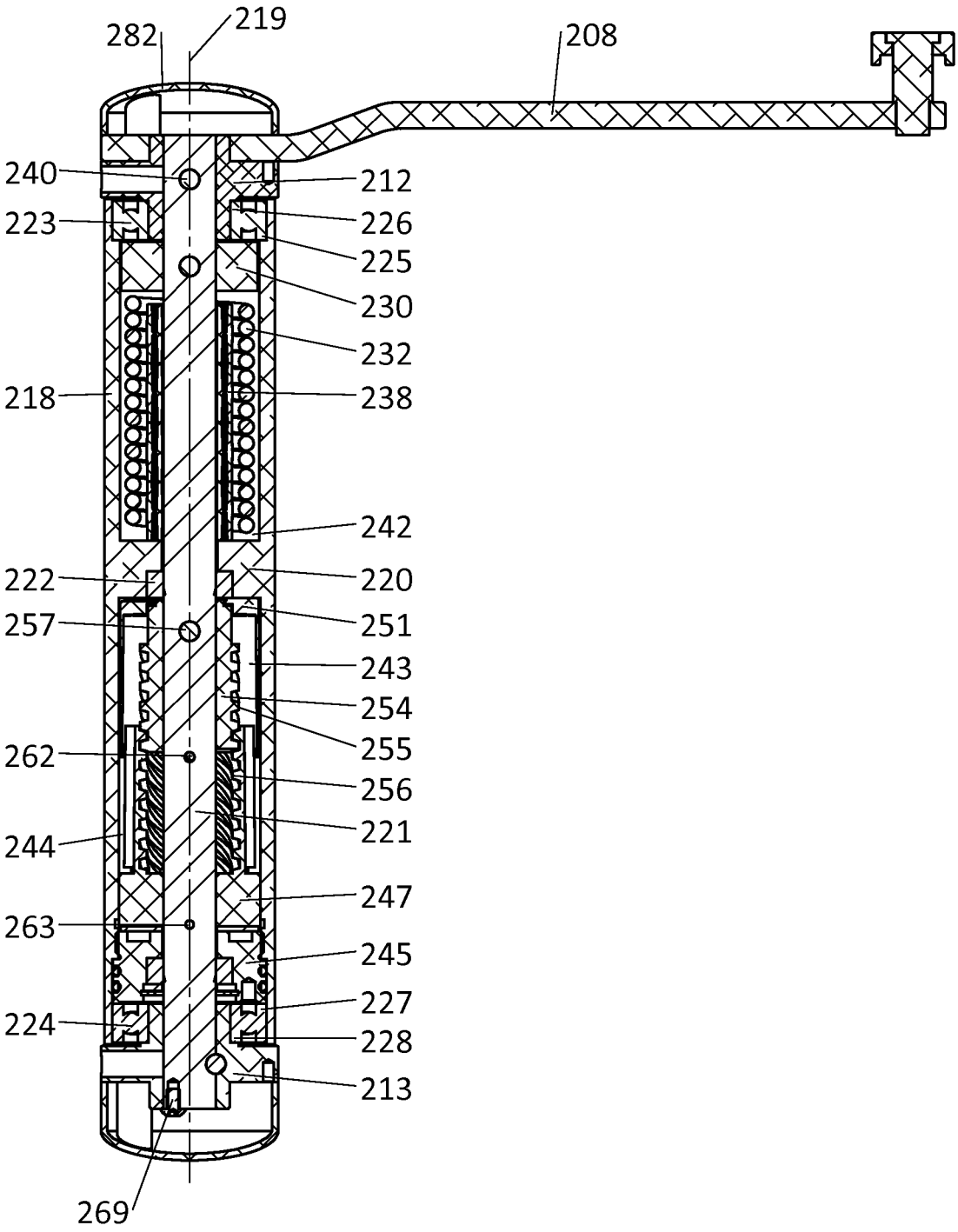
FIG. 17A to 17C show longitudinal cross-sections through the actuator of FIG. 15.
Figure 17B:
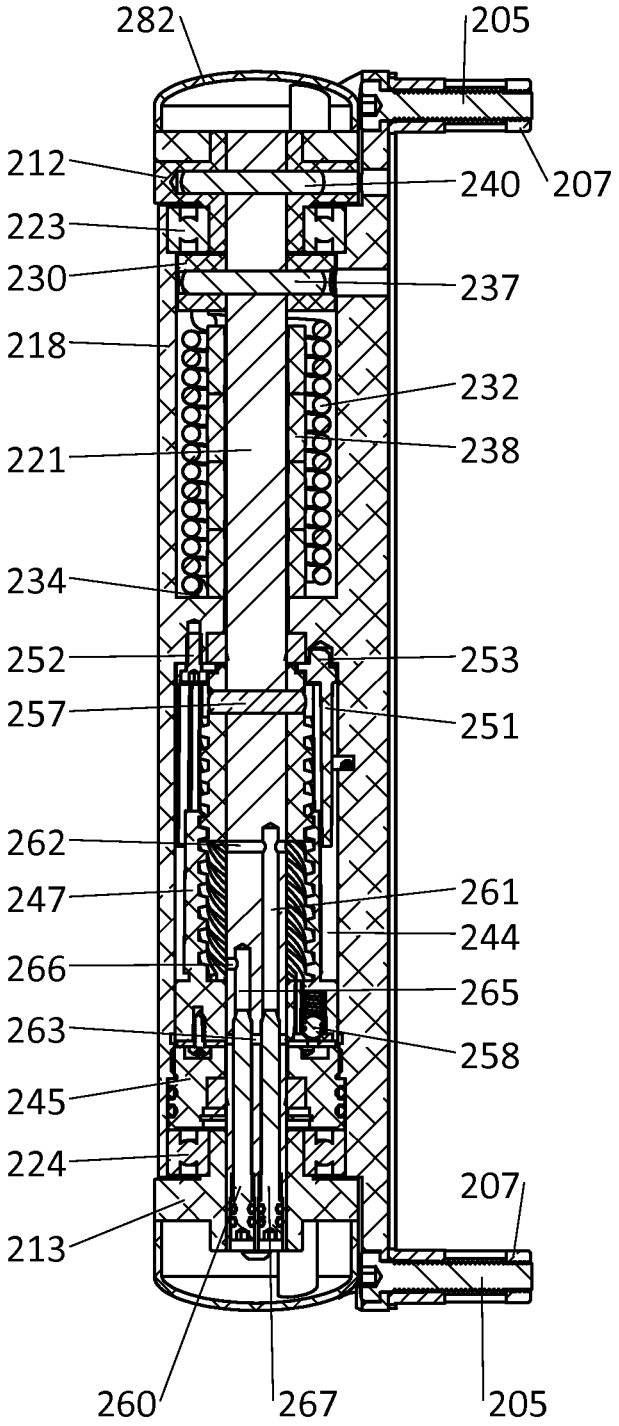

It will be readily appreciated that other means may be used to enable adjusting the relative orientation of the extended arm 208 with respect to the main body 210 of the actuator 200. For example, the annular portion 280 may have a larger internal diameter than the connection members 212, 213, in which case the annular portion 280 may be slid around the connection members 212, 213. When the inner surface of the annular portion 280 is provided with a plurality of projections that cooperate with multiple grooves on the outside surface of the connection members 212, 213, this will also enable adjusting the orientation of the extended arm 208 with respect to the main body 210 of the actuator 200. FIGS. 17A and 17B show two longitudinal cross-sections through the actuator 200. Generally, the actuator 200 has a similar internal structure as the actuator 100. Specifically, the actuator 200 also comprises a damping mechanism having a closed cylinder cavity 244 with a guiding element 251 bolted into the collar 220, by at least one bolt 252, preventing rotation of the piston 247, a spindle 254 that drives a piston 247 to slideably move inside the closed cylinder cavity 244, a one-way valve 258 enabling hydraulic fluid to flow from the high pressure compartment to the low pressure compartment when opening the closure system, and restricted fluid passages formed in the shaft 221 with the adjustable valves 260, 267 positioned in the shaft 221 to be accessible when the actuator 200 is mounted onto the support 201.

The main difference with the actuator 100 will now be described, which main difference is mainly due to the strength of the actuator 200, as it does not need to handle as large a force as the actuator 100. Therefore, fewer fixture sets 205, 206, 207 may be used, which also do not need to be inserted through the actuator 200 in the region between the roller bearings 223, 224. Therefore, there are no fixation members 130, 141 in the actuator 200 and only a single roller bearing 123, 124 is provided between each connection member 212, 213 and the tubular cylinder barrel 218.

Moreover, since the ring 230 only functions as the first actuation member and not, contrary to actuator 100, as a fixation member, it is possible to interchange the roles of the actuation members 230, 231. As such, the first actuation member 230 may be coupled to the shaft 221 with the second actuation member being formed by the collar 220, thereby reducing the total height of the actuator 200.

It will be readily appreciated that, in other embodiments, the collar 220 does not form the second actuation member, but a separate ring 231 is provided that is irrotatably fixed to the tubular cylinder barrel 218 by a pin 237. Moreover, the roles of the actuation members 230, 231 may also be interchanged thereby forming an energy storing mechanism that is identical to the one in the actuator 100.

As with the actuator 100, the roller bearings 223, 224 are axially fixed. Specifically, the outer race 225 axially engages a transverse surface formed on the tubular cylinder barrel 218, the inner race 226 axially engages a transverse surface formed by the first connection member 212, the outer race 227 axially engages a transverse surface formed by the second connection member 213, and the inner race 228 axially engages a transverse surface formed by the annular closing member 245, which is preferably screwed in the tubular cylinder barrel 218. This, as described above, is an advantageous configuration as it enables the bearings 223, 224 to transfer longitudinally directed forces from the shaft 221 to the tubular cylinder barrel 218.

Figure 17C:
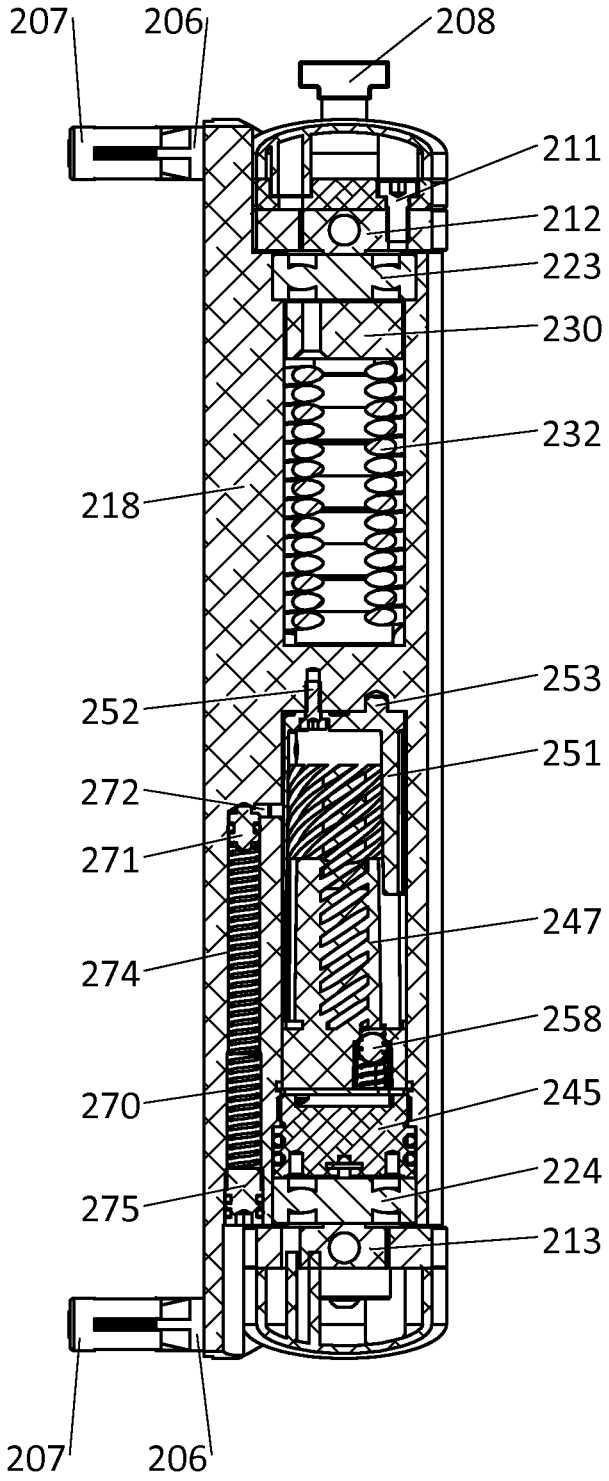

FIG. 17C shows another longitudinal cross-section through the actuator 200, illustrating one of the expansion channels 270. Specifically, the expansion channel 270 is connected to the low pressure compartment of the closed cylinder cavity 244 via a channel 272. The expansion channel 270 comprises a compression spring 274 and a slideable piston 271 and is closed of by the end cap 275. The expansion channels 270 operate in an identical fashion as described above for actuator 100.

Figure 18A:
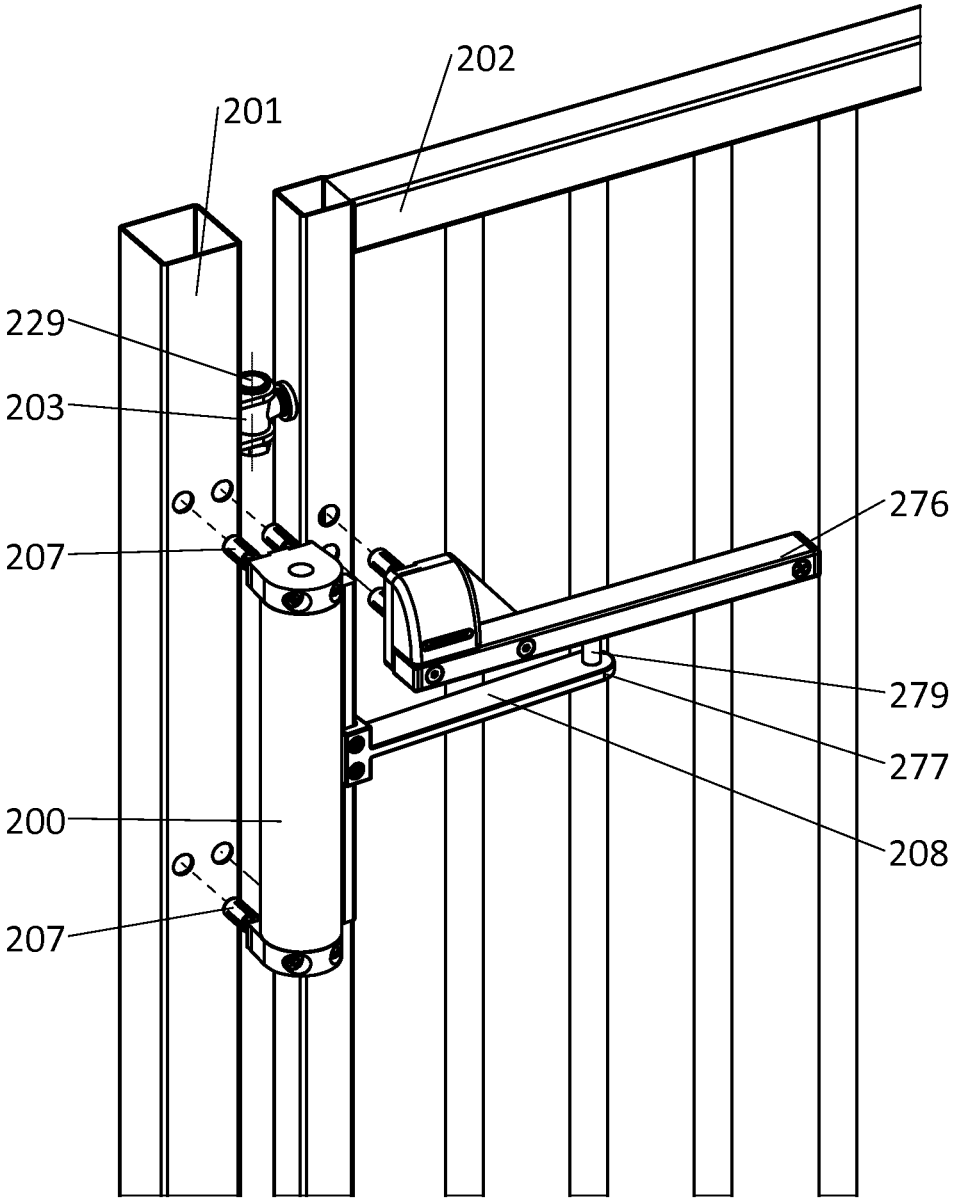
FIG. 18A shows a variant of the actuator of FIG. 15.

FIG. 18A shows a variant of the actuator 200. In this variant, the shaft 221 is fixed to the support 201 and the extended arm 208 irrotatably fixes the tubular cylinder barrel 218 to the closure member 201. More generally, in this variant, the first member of the closure system is the closure member 202 and the second member of the closure system is the support 201.

Figure 18B:
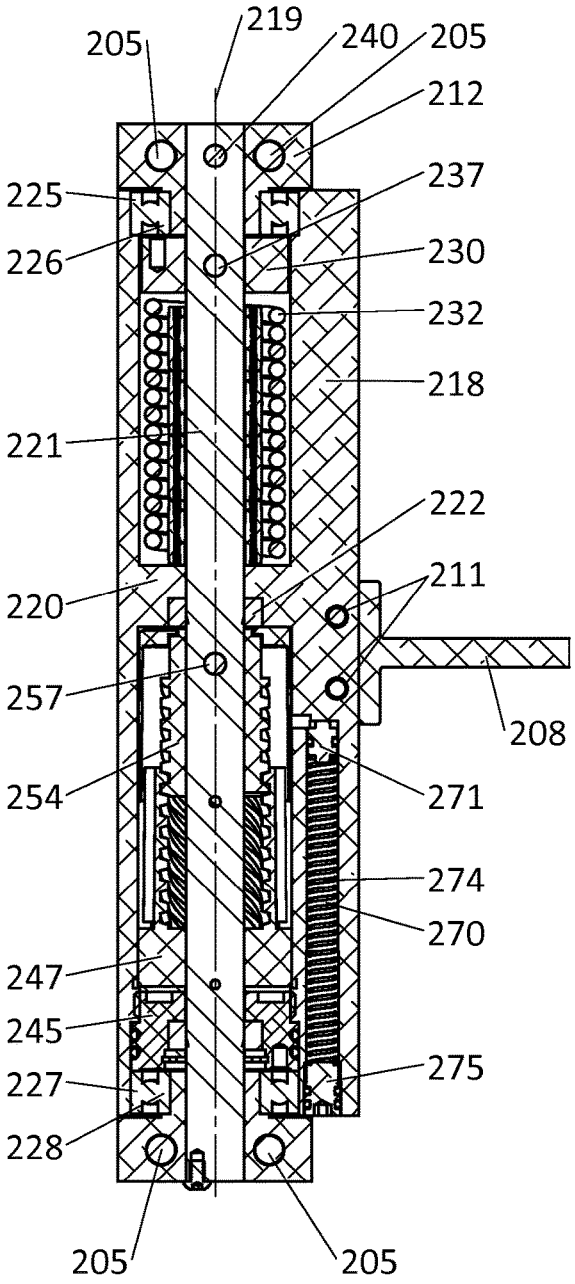
FIGS. 18B and 18C show longitudinal cross-sections through the actuator of FIG. 18A.
Figure 18C:
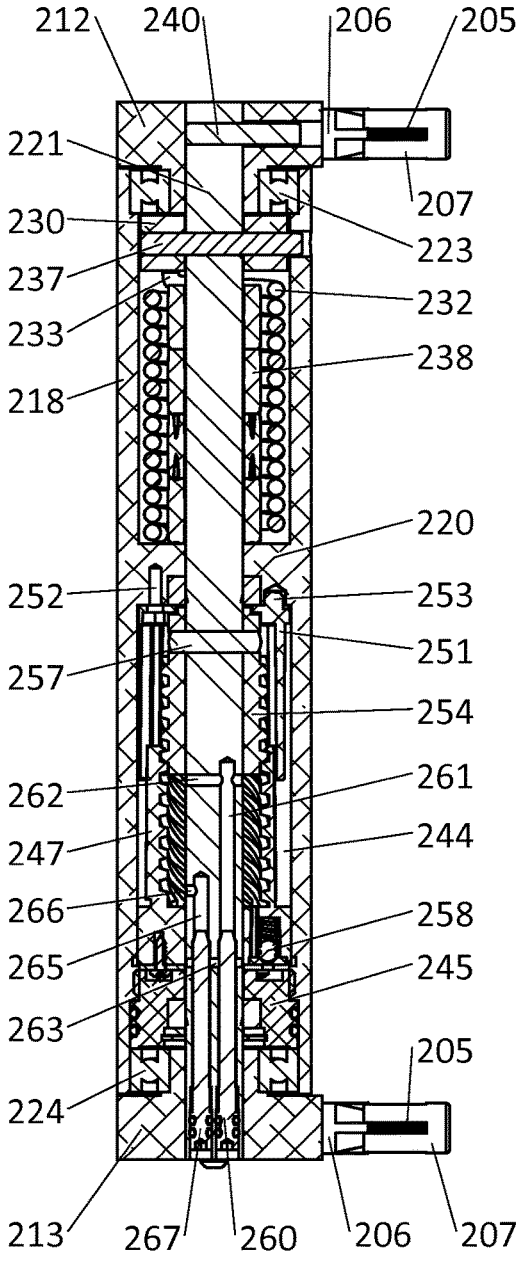

FIGS. 18B and 18C show longitudinal cross-sections through the variant of the actuator 200. The main difference with actuator 200 is that the connection members 212, 213 are now directly bolted to the support 201 using four fixture sets 205, 206, 207, while the extended arm 208 is fixed to the outside of the tubular cylinder barrel 208 by bolts 211. Both the energy storing mechanism and the damping mechanism are identical to actuator 200 as the shaft 221, although being fixed, will still be relatively rotating with respect to the tubular cylinder barrel 218, that will rotate upon opening or closing the closure system.

Fourth Embodiment

FIGS. 19A to 24B illustrate another embodiment of an actuator 300 according to the present invention. Elements or components previously described with reference to FIGS. 8A to 18C bear the same last two digits but preceded by a '3'.

The actuator 300 is designed to be used as a hinge in a closure system having a support 301 with a closure member 302. Specifically, the actuator 300 is designed to be inserted in the closure member 302 with the mechanical connector 308 comprising multiple components. The tubular cylinder barrel 318 is irrotatably fixed to the closure member 302 due to its rectangular, in particular square, shape and is preferably also bolted thereto by at least one, preferably at least two, bolts 399. As such, as with the variant of actuator 200 described with respect to FIGS. 18A to 18C, the first member of the closure system is the closure member 302 and the second member of the closure system is the support 301.

The mechanical connector 308 comprises a support element 383 that is fixedly connected to the support 301 using two fixture sets 305, 306, 307. The mechanical connector 308 further comprises a connection element 384 in which an extremity of the shaft 321 is securely fixed by a bolt 385, the connection element 384 being securely fixed to the support element 383 as described below. The support element 383, the connection element 384, and the bolt 385 thus act similar to the connection members 112, 113, 212, 213 and the bolts 111, 211 of the actuators 100, 200, i.e. to fix the shaft 321 to one of the members 301, 302 of the closure system. It will be readily appreciated that the support element 383 and the connection element 384 may be integrally formed. It will be further appreciated that the support element 383 may be omitted from the mechanical connector 308, especially in an embodiment where the closure member 302 is mounted directly to a ground surface. In such a case, the connection element 384 may be fitted into a corresponding hole in the ground surface, in which case the ground directly forms the support 301 and there is no need for a support element 383. As such, in this embodiment, the mechanical connector comprises the connection element 384 and the bolt 385.

It will also be appreciated that the extremities of the shaft 321 may have a non-circular horizontal cross-section that matches a non-circular opening in the connection element 384. These non-circular cross-sections then also irrotatably fix the connection element 384 to the shaft 321. In other words, the bolt 385 is also not necessarily provided as a part of the mechanical connector 308.

In the illustrated embodiment, see in particular FIGS. 20A to 21B, hinge elements are provided between the mechanical connector 308 and the closure member 302 thereby enabling a smooth rotation of the closure member 302, including the tubular cylinder barrel 318, with respect to the shaft 321 that is fixedly connected to the support 301. The hinge elements include a roller bearing 386, in particular a steel roller bearing, that is mounted in a support member 387 that is bolted to the support element 383 by a bolt 388. The support member 387 is shaped such that the connection element 384 fits therein and is thereby fixed between the support member 387 and the support element 383 that are fixedly connected by the bolt 388. The roller bearing 386 has an outer race 391 that is supported by the support member 387, i.e. the outer race 391 both radially and axially engages the support member 387. Moreover, in the illustrated embodiment, see in particular FIGS. 20A to 21B, a connection member 389 is also provided that is fixedly connected to the closure member 302 by a fixture set 305, 306, 307. This connection member 389 is also placed around the shaft 321 and is free to rotate with respect to the shaft 321. Specifically, the connection member 389 is designed such that the inner race 390 of the roller bearing 386 is both radially and axially engaged by the connection member 389.

The configuration of the roller bearing 386 with the connection member 389 and the support member 387 ensures that the longitudinal, i.e. axially directed, forces generated by, in particular the weight of, the closure member 302 are transmitted from the connection member 389 via the roller bearing 386, in particular from the inner race 390 to the outer race 391, to the support member 387 that is fixedly connected to the support 301. Preferably, the roller bearing 386 is a ball bearing, in particular a steel ball bearing, as this is more suited to transmit forces in the axial direction.

It will be readily appreciated that the hinge elements 386, 387, 388, 389 may be omitted, in which case the weight of the closure member 302 will be borne by the roller bearings 323, 324 inside the actuator 300. It will be appreciated that, as with the actuator 100, the longitudinal axis 319 of the actuator 300 is also in line with the hinge axis 329, specifically, both axes 319, 329 are identical, because, the actuator 300 acts as the hinge for the closure system.

Moreover, the roller bearing 386 could also be placed with its inner race 390 directly contacting the shaft 321 and its outer race 391 engaging the connection member 389. This could be achieved by providing a connection member 389 that does not include the annular sleeve portion and by providing a roller bearing 386 having a smaller diameter. However, as described above for actuator 100, the roller bearing 386 needs to transfer longitudinally directed forces, therefore, providing a roller bearing 386 having a larger diameter, i.e. having a larger surface area of the races 390, 391, is clearly advantageous.

Figure 19A:
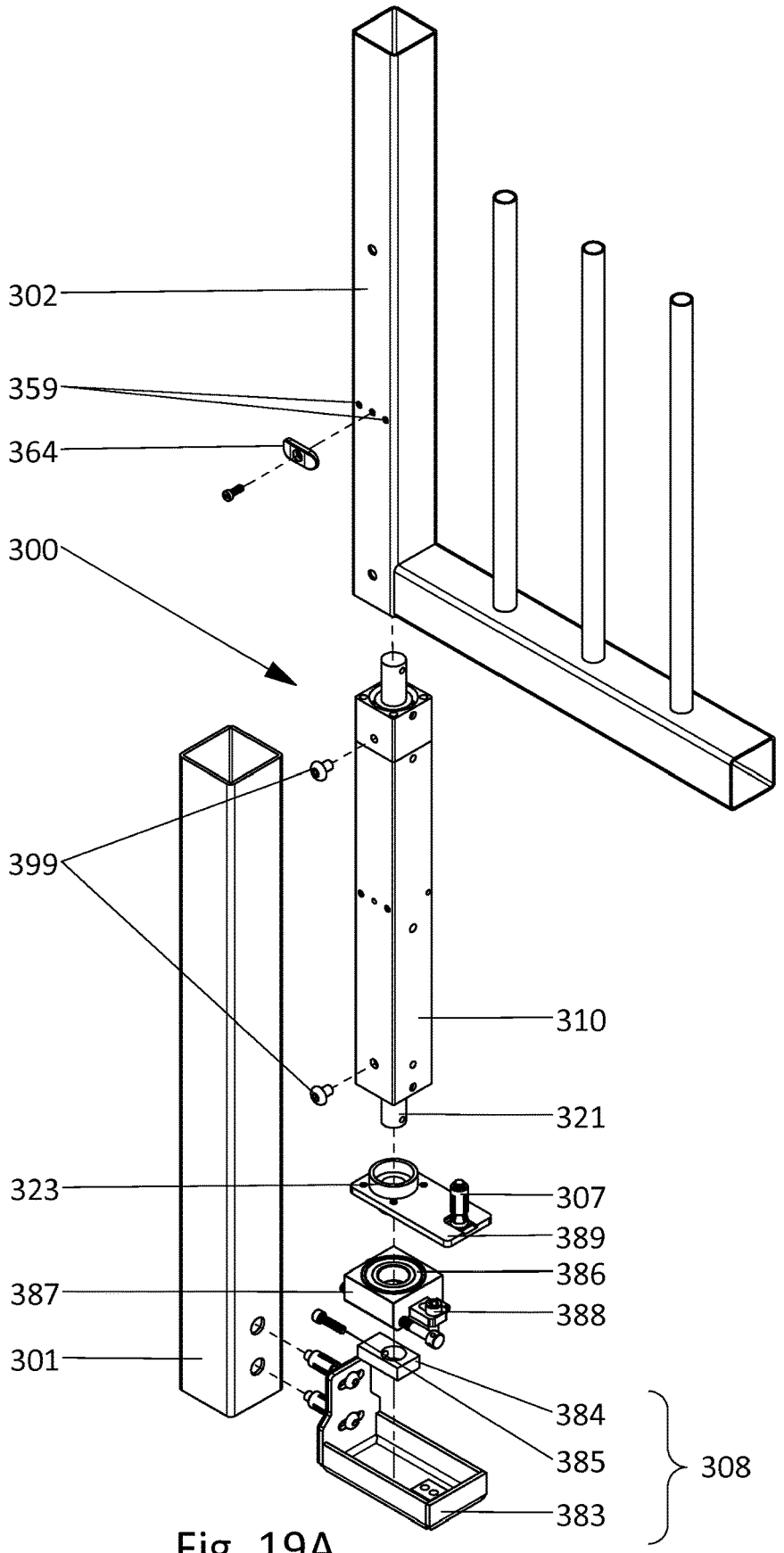
FIGS. 19A and 19B show how a hydraulically damped actuator according to yet another embodiment of the present invention is to be mounted into a closure member of a left-handed closure system and into a closure member of a right-handed closure system respectively.
Figure 19B:
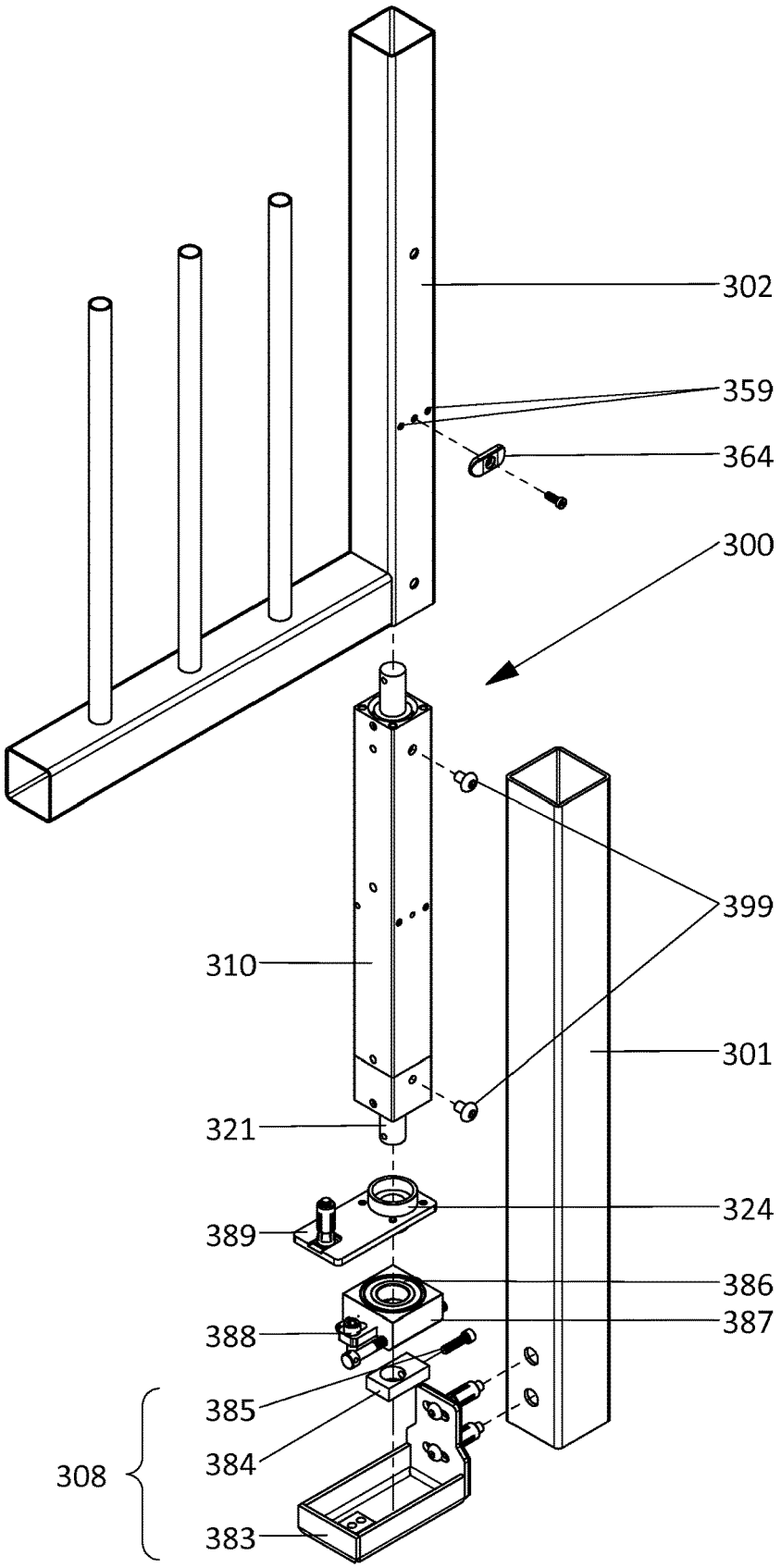

FIG. 19A shows how the actuator 300 is mounted for a right-handed closure system, while FIG. 19B shows how the actuator 300 is mounted for a left-handed closure system. The main difference is that the main body 310 of the actuator 300 is mounted in opposite orientations, as is clearly visible in the longitudinal cross-sections in FIGS. 20A to 21B.

Figure 20A:
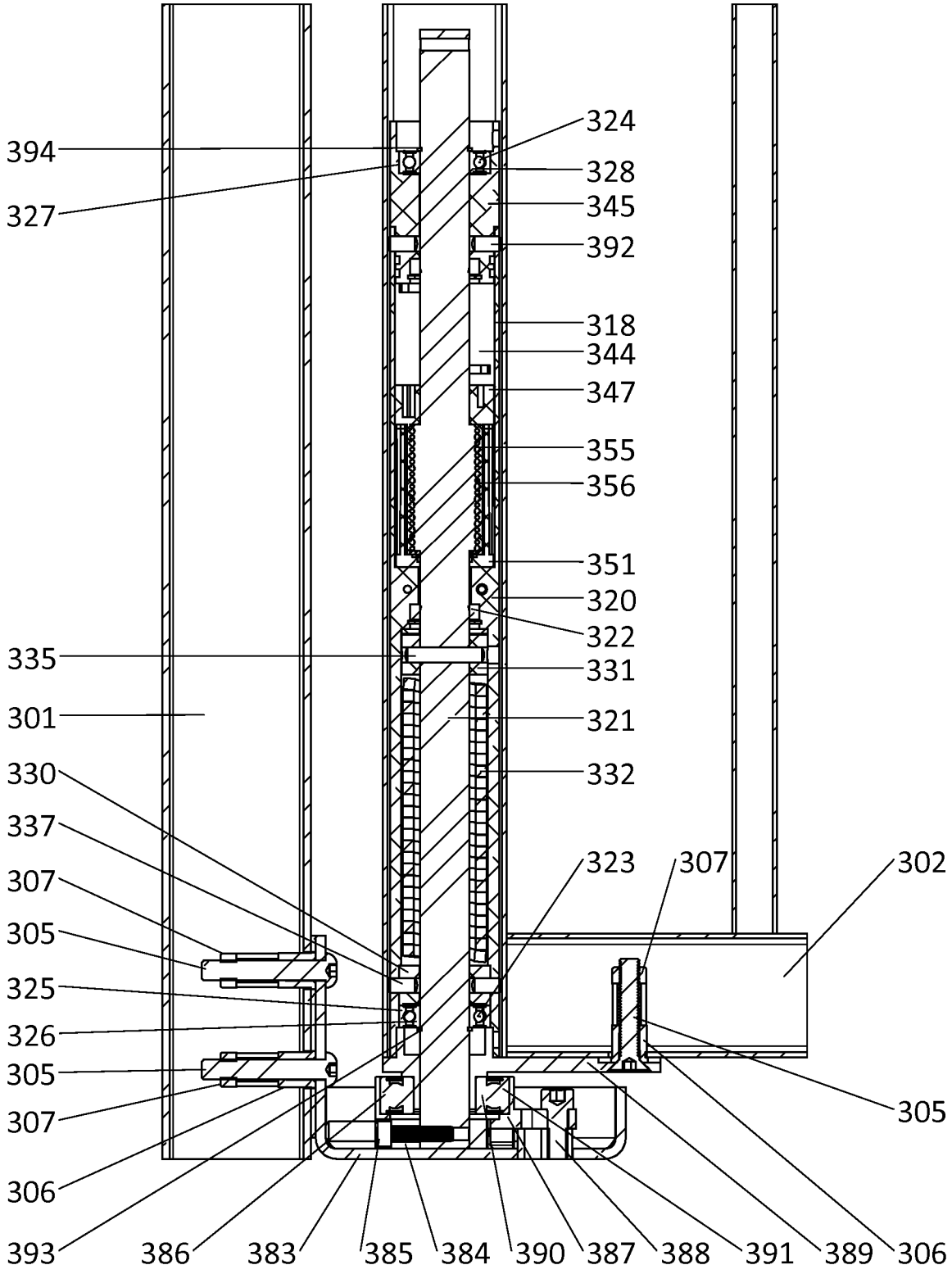
FIGS. 20A and 20B show a longitudinal cross-section through the actuator of FIGS. 19A and 19B respectively when mounted in the closure member.
Figure 20B:
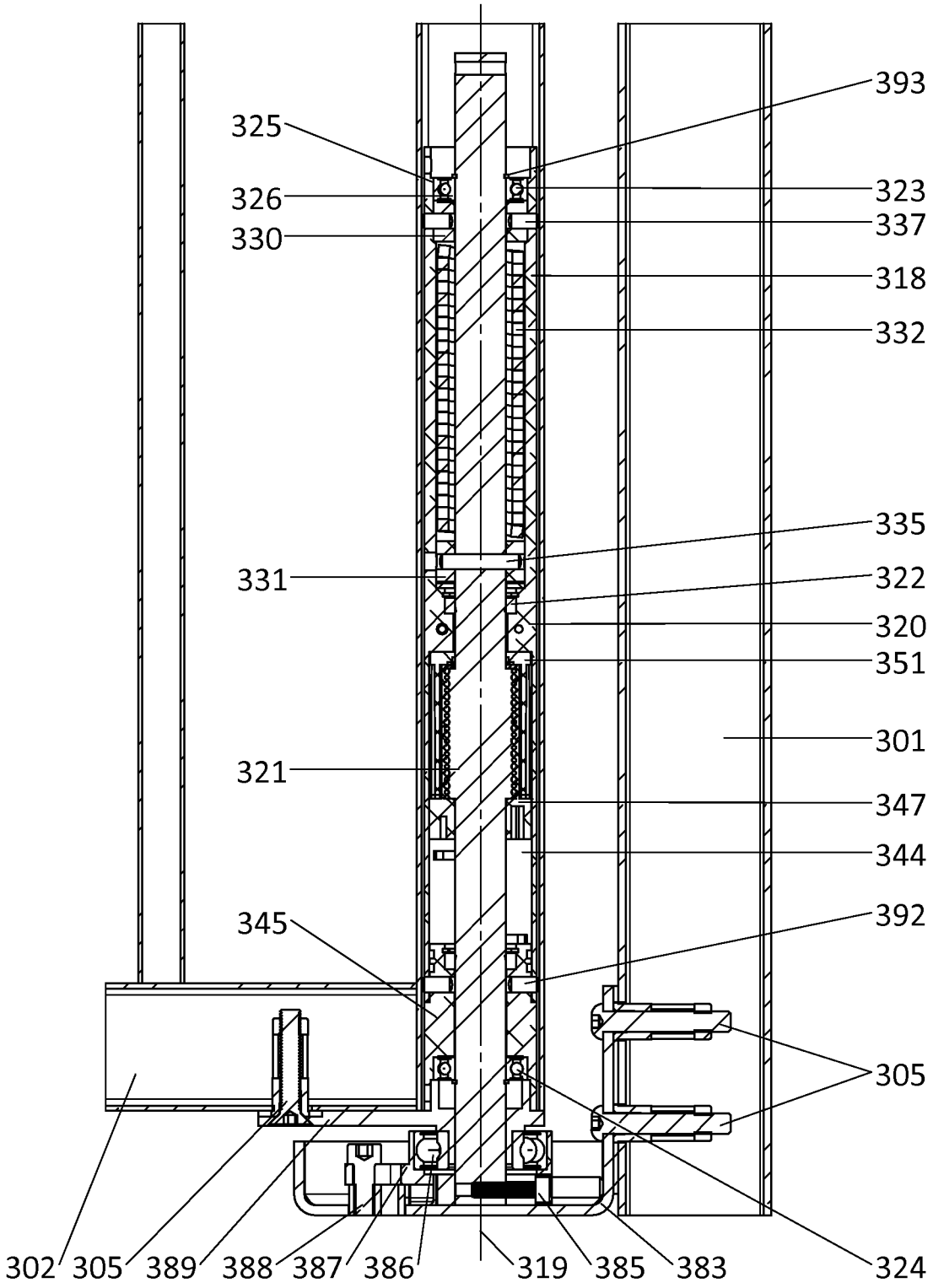

FIGS. 20A and 20B show two longitudinal cross-sections through the actuator 300. Generally, the actuator 300 has a similar internal structure as the actuators 100, 200. Specifically, the energy storing mechanism also comprises two actuation members 330, 331 with a torsion spring 332 between them, one of the actuation members 330, 331 being fixed to the shaft 321 by a pin 335 and the other one to the tubular cylinder barrel 318 by a pin 337, in particular two such pins. In the illustrated embodiment, no padding 338 is provided between the torsion spring 132 and the shaft 321, but it will be appreciated that this may be included. As with the actuator 200, the roles of the actuation members 330, 331 may be interchanged, i.e. the first actuation member 330 may be coupled to the shaft 321 with the second actuation member 331 being coupled to the tubular cylinder barrel 318. Advantageously, because the second actuation member 331 is located adjacent to the collar 320, it is also possible that the collar 320 acts as the second actuation member 331 thereby reducing the total height of the actuator 300 as illustrated for actuator 200 in FIGS. 17A and 17B.

Furthermore, as in the actuators 100, 200, the roller bearings 323, 324 also ensure that the shaft 321 cannot move in the direction along the longitudinal axis 319. Specifically, both of the roller bearings 323, 324 are radially engaged with their outer races 325, 327 to the tubular cylinder barrel 318 and are axially engaged with their outer races 325, 327 against an element that is fixed to the tubular cylinder barrel 318, i.e. the first actuation member 330 for roller bearing 323 and the annular closing member 345 for the roller bearing 324. Moreover, both of the roller bearings 323, 324 are radially engaged with their inner races 326, 328 to the shaft 321 and are axially engaged with their inner races 326, 328 against a fastening ring 393, 394 that is fixed in a groove in the shaft 321 as illustrated in FIGS. 20A and 20B.

Figure 21A:
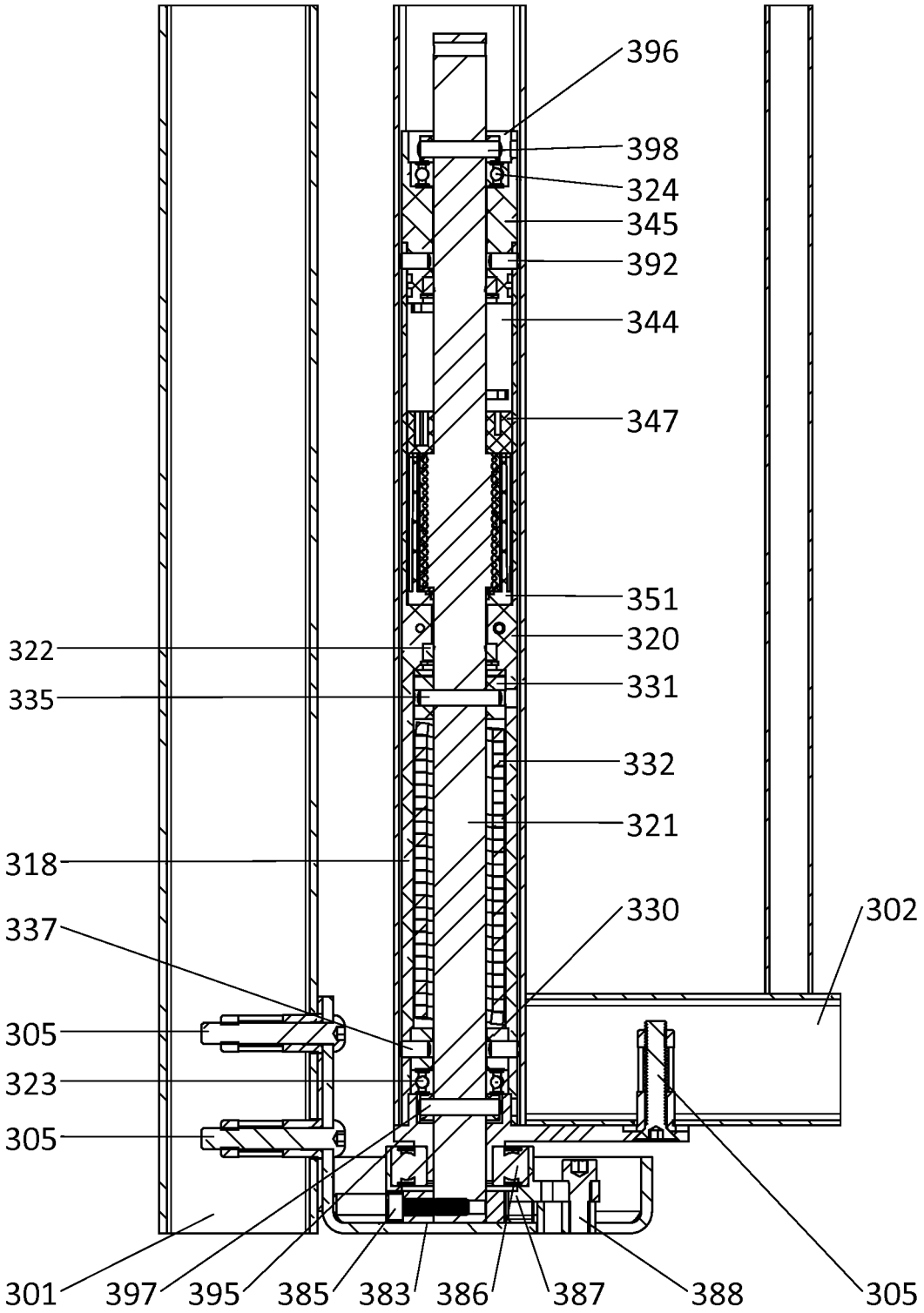
FIGS. 21A and 21B show a longitudinal cross-section through a minor variation of the actuator of FIGS. 19A and 19B respectively when mounted in the closure member.
Figure 21B:
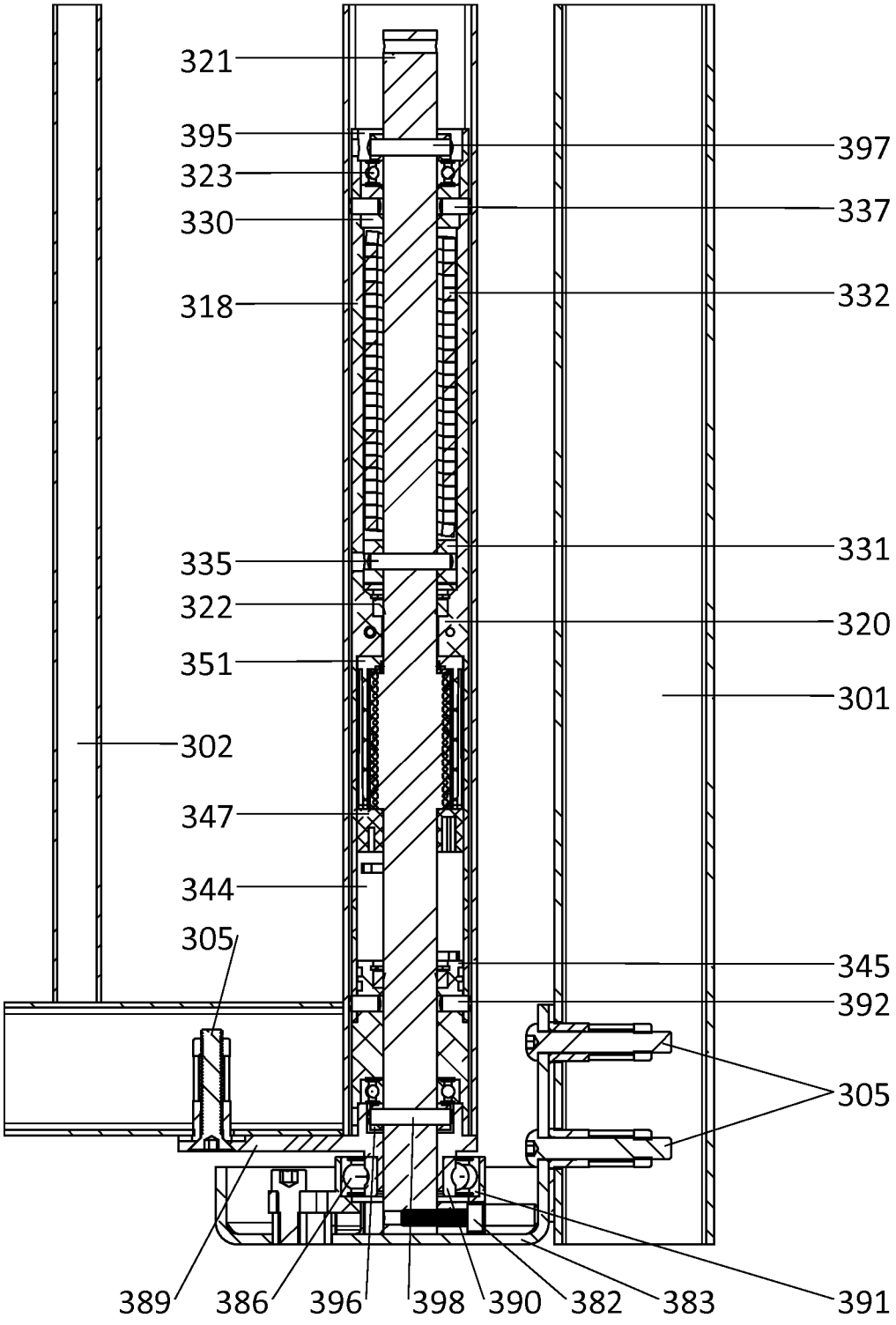

FIGS. 21A and 21B show a minor variation by replacing the fastening rings 393, 394 with rings 395, 396 that are fixed to the shaft 321 with transversally inserted pins 397, 398. This is advantageous as the rings 395, 396 are more securely fixed to the shaft 321.

The actuator 300 also comprises a damping mechanism having a closed cylinder cavity 344 with a guiding element 351 bolted into the collar 320 preventing rotation of the piston 347. Contrary to the actuators 100, 200, there is no separate spindle, rather this is integrally formed with the shaft 321. In other words, the shaft 321 is provided with the outer threaded portion 355 that cooperates with the inner threaded portion 356 on the piston 347. Therefore, the shaft 321 directly drives the piston 347 to slideably move inside the closed cylinder cavity 344. The damping mechanism further comprises a one-way valve enabling hydraulic fluid to flow from the high pressure compartment to the low pressure compartment when opening the closure system.

Figure 22:
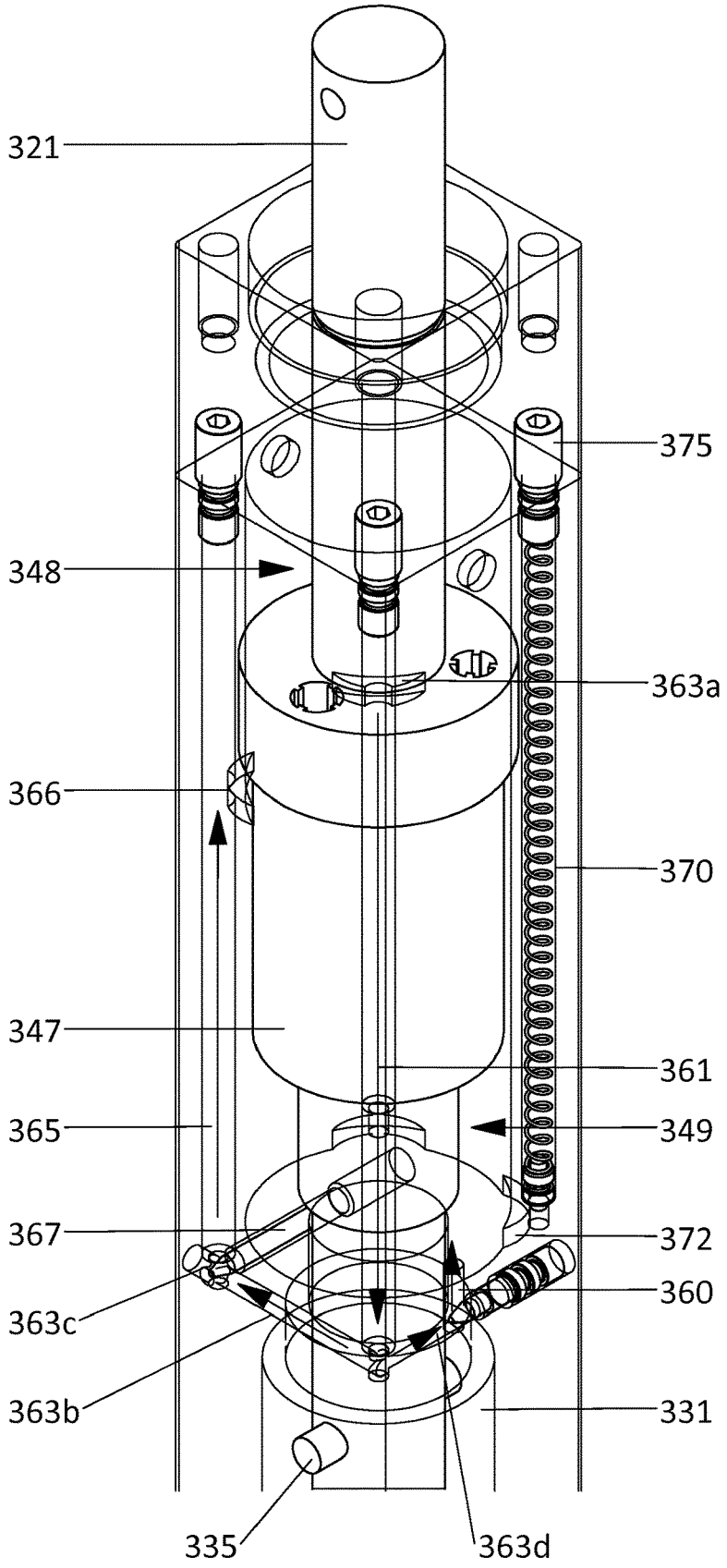
FIG. 22 shows a perspective view of the damping mechanism illustrating the restricted fluid passages.

One of the main differences of the actuator 300 with respect to the actuators 100, 200 is that the second extremity of the shaft 321 is not necessarily readily accessible when the actuator 300 is mounted in the closure member 302. As such, it is not convenient to provide the adjustable valves 360, 367 inside the shaft 321. To overcome this problem, the damping mechanism in actuator 300 is provided with restricted fluid passages formed in the tubular cylinder barrel 318 as illustrated in FIG. 22 which shows a perspective view of the damping mechanism with the piston 347 in its nearly closed position such that hydraulic fluid may flow through both restricted fluid passages from the high pressure compartment 348 to the low pressure compartment 349 of the closed cylinder cavity 344 as indicated by the black arrows.

A first restricted fluid passage is formed by an inlet bore 363*a*, formed by a hole in the interior wall of the tubular cylinder barrel 318. The inlet bore 363*a* connects the high pressure compartment 348 to bore 361 in the tubular cylinder barrel 318 that extends in the direction of the longitudinal axis 319 and ends near the middle of the collar 320 in a bore 363*d* that runs transversally through the collar 320. The adjustable valve 360 is inserted in the bore 363*a* and is, as such, accessible from the outside of the actuator 300. Near the tip of the adjustable valve 360 a bore 362 is provided in the collar 320, which bore 362 extends in the direction of the longitudinal axis 319 and connects the bore 363*d*, and thus the high pressure compartment 348, to the low pressure compartment 349.

A second restricted fluid passage is formed by the same inlet bore 363*a* and the same bore 361 that ends near the middle of the collar 320 and connects with a bore 363*b* that runs transversally through the collar 320. The bore 363*b* intersects with a bore 363*c* which also runs transversally through the collar 320 and in which the adjustable valve 367 is inserted. As such, the adjustable valve 367 is accessible from the outside of the actuator 300. At the intersection of the bores 363*b*, 363*c*, another bore 365 is provided that extends in the direction of the longitudinal axis 319 and connects to an outlet bore 366 formed by a hole in the interior wall of the tubular cylinder barrel 318 located above the piston 347, when the piston 347 is almost in its most extended position.

Figure 23A:
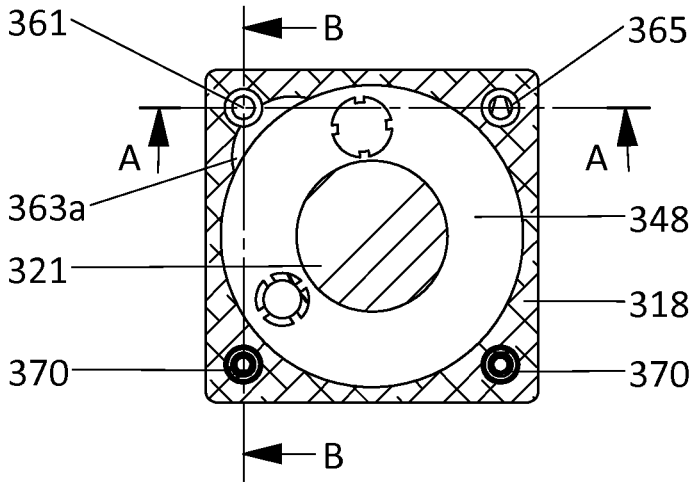
FIGS. 23A to 23C show horizontal cross-sections through the damping mechanism illustrated in FIG. 22.
Figure 23B:
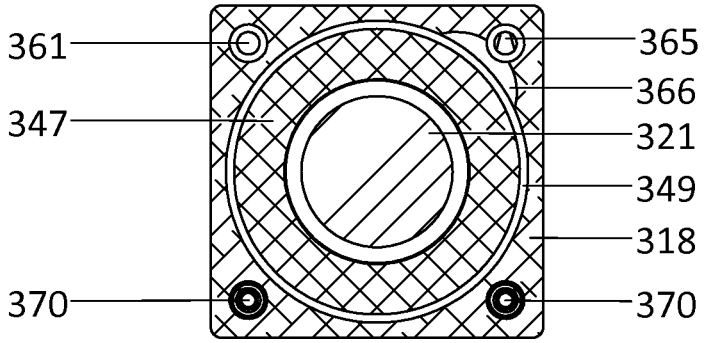
Figure 23C:
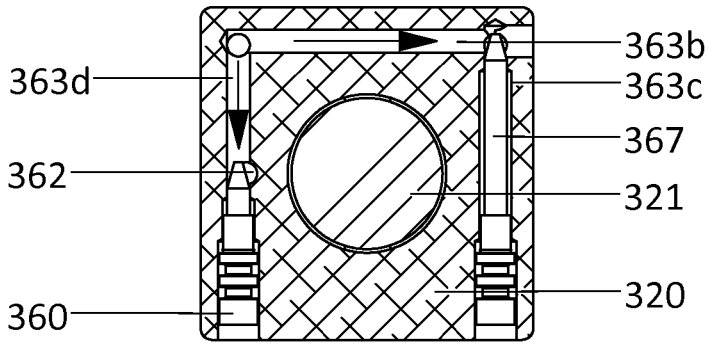
Figure 24A:
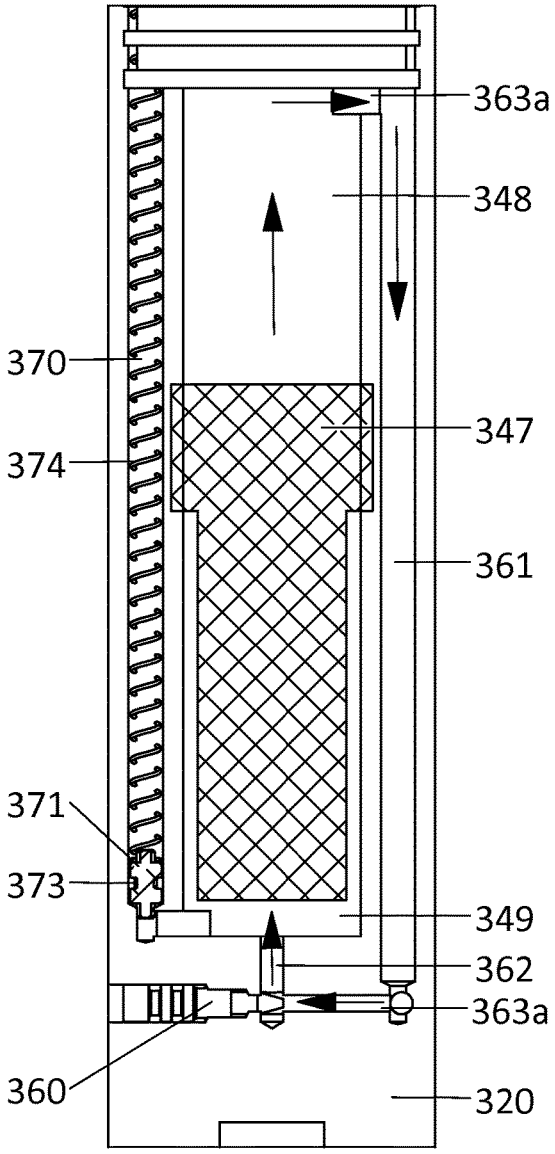
FIGS. 24A and 24B show longitudinal cross-sections through the damping mechanism along the planes indicated in FIG. 23A.
Figure 24B:
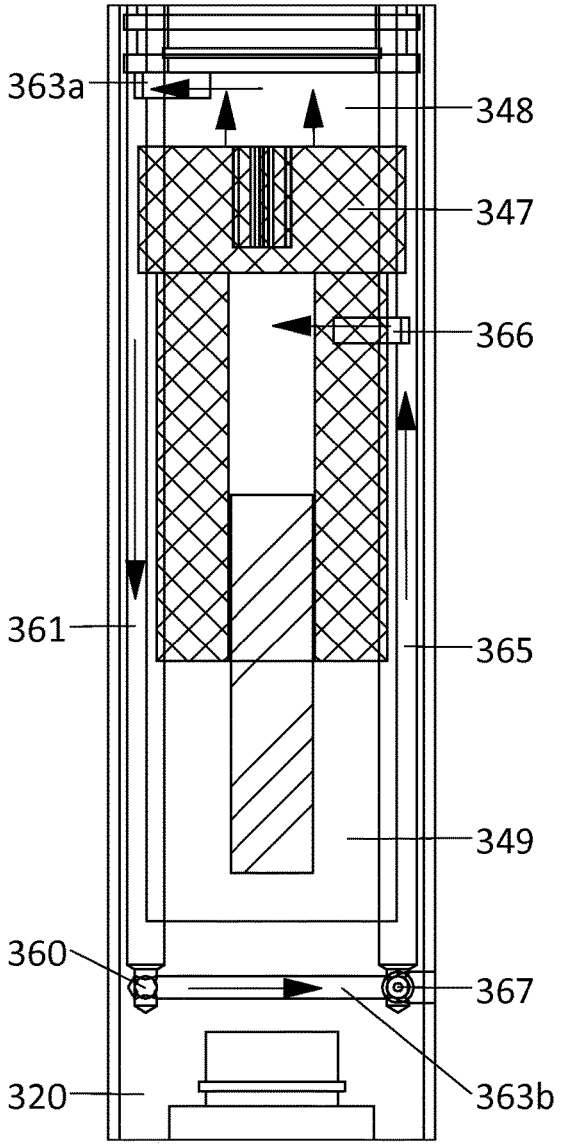

This configuration is shown in more detail in FIGS. 23A to 24B. FIGS. 23A to 23C show three horizontal cross-sections through the damping mechanism. FIG. 23A is taken at the height of the inlet bore 363*a*, FIG. 23B is taken at the height of the outlet bore 366, and FIG. 23C is taken at the height of the collar 320. FIGS. 24A and 24B show longitudinal cross-sections through the damping mechanism along the lines "A" and "B" respectively in FIG. 23A with the piston 347 at different positions.

The main advantage of providing the adjustable valves 360, 367 in the bore 320 is that the bore 320 is centrally located with respect to the actuator 300. As such, irrespective of the orientation of the longitudinal axis 319 of the actuator 300, e.g. upright or upside down, the adjustable valves 360, 367 are positioned at the same height enabling openings 359 (see FIGS. 19A and 19B) to be provided in the closure member 302 to access the adjustable valves 360, 367 thereby enabling adjustment of the adjustable valves 360, 367. As illustrated in FIGS. 19A and 19B a cover 364 is preferably provided that is bolted to the closure member 302 to cover the openings 359 thereby preventing water and/or dirt from entering the openings 359 and preventing access to the adjustable valves 360, 367.

It will be readily appreciated that the restricted fluid passages may also be provided in the shaft 321 as in the actuators 100, 200, especially when there are no adjustable valves 360, 367.

FIGS. 15 to 24B also illustrate the expansion channels 370. Specifically, the expansion channels 370 are connected to the low pressure compartment of the closed cylinder cavity 344 via a channel 372. The expansion channels 370 comprises a compression spring 374 and a slideable piston 371 and are closed of by the end cap 375. The expansion channels 370 operate in an identical fashion as described above for actuators 100, 200.

Although aspects of the present disclosure have been described with respect to specific embodiments, it will be readily appreciated that these aspects may be implemented in other forms.

The invention claimed is:

1. A hydraulically damped actuator for closing a closure system having a first member and a second member that are hingedly connected to each other, the actuator comprising:

a first connection element configured for connecting the actuator to the first member, the first connection element comprising a tubular cylinder barrel having a longitudinal axis;

a second connection element configured for connecting the actuator to the second member;

an energy storing mechanism operatively connected with said first connection element and said second connection element and configured for storing energy when said closure system is being opened and for restoring said energy to effect closure of said closure system; and a hydraulic damping mechanism inside the tubular cylinder barrel and operatively connected with said first connection element and said second connection element and configured for damping a closing movement of said closure system, the damping mechanism comprising:

a closed cylinder cavity in said tubular cylinder barrel, the closed cylinder cavity having a longitudinal axis and being filled with a volume of hydraulic fluid;

a shaft that extends into the closed cylinder cavity and is rotatable with respect to said tubular cylinder barrel about a rotation axis that coincides with said longitudinal axis of the closed cylinder cavity;

a piston disposed within said closed cylinder cavity and dividing the closed cylinder cavity into a high pressure compartment and a low pressure compartment, the piston being operatively coupled to the shaft to be slidable with respect to the tubular cylinder barrel between two extreme positions in the direction of said longitudinal axis; and a guiding element rigidly fixed to the tubular cylinder barrel in the closed cylinder cavity, the piston being irrotatably and slideably in the direction of said longitudinal axis of the closed cylinder cavity coupled to the guiding element, wherein, the tubular cylinder barrel comprises an integrally formed collar that forms part of the wall of the closed cylinder cavity, and the guiding element is bolted to said collar by one or more bolts.

2. The actuator according to claim 1, wherein the tubular cylinder barrel is formed from a metal extrusion, with said closed cylinder cavity and said collar being formed therein by bore milling.

3. The actuator according to claim 1, wherein the damping mechanism further comprises a motion converting mechanism to convert a relative rotational motion of the shaft with respect to the tubular cylinder barrel into a translational motion of the piston in the direction of said longitudinal axis of the closed cylinder cavity.

4. The actuator according to claim 3, wherein the motion converting mechanism comprises a first screw thread fixedly positioned on the shaft and a second screw thread fixedly positioned on the piston and directly engaging the first screw thread.

5. The actuator according to claim 1, wherein the tubular cylinder barrel is integrally formed and houses both the energy storing mechanism and the damping mechanism.

6. An actuator according to claim 1, wherein said one or more bolts extend substantially in the direction of said longitudinal axis of the closed cylinder cavity.

7. The actuator according to claim 1, wherein the guiding element has one or more lugs that extend in the direction of said longitudinal axis of the closed cylinder cavity and fit in corresponding holes in the collar.

8. The actuator according to claim 1, wherein the guiding element has a non-circular cross-section in a transverse plane that is perpendicular to the direction of said longitudinal axis of the closed cylinder cavity, a surface of the piston which that faces said guiding element having a corresponding cross-section in said transverse plane to prevent rotation of the piston with respect to the closed cylinder cavity.

9. The actuator according to any one of the preceding claims, characterised in that claim 1, wherein said shaft extends through an opening formed by said collar, with a sealing ring being placed around surrounding said shaft between the shaft and the collar.

10. The actuator according to claim 1, wherein said guiding element is manufactured from a synthetic material.

11. The actuator according to claim 1, wherein the guiding element is located within said low pressure compartment.

12. The actuator according to claim 1, wherein said shaft is manufactured from steel.

13. The actuator according to claim 1, wherein said piston is manufactured, from a synthetic material.

14. The actuator according to claim 1, wherein the guiding element has one or more grooves, each groove cooperating with a corresponding projection formed on an outer surface of the piston.

15. The actuator according to claim 1, wherein the damping mechanism further comprises:

a one-way valve allowing fluid flow from the low pressure compartment to the high pressure compartment when said closure system is being opened; and at least one restricted fluid passage between the high pressure compartment and the low pressure compartment.

16. The actuator according to claim 1, wherein the damping mechanism further comprises a pressure compensation mechanism configured to compensate changes of the volume of said hydraulic fluid upon temperature variations thereof.

17. The actuator according to claim 16, wherein the pressure compensation mechanism comprises at least one of:

an amount of a gas in the hydraulic fluid to compensate said changes of the volume of the hydraulic fluid; and an expansion channel with a plunger that fits into the expansion channel and is slidably received therein, the plunger dividing the expansion channel into a first compartment that is in fluid communication with said closed cylinder cavity and a second compartment that is sealed off from the first compartment by said plunger, the second compartment allowing the plunger to slide within the expansion channel to compensate said changes of the volume of the hydraulic fluid.

* * * * *